US005474886A

United States Patent [19]

Nakazyo et al.

[11] Patent Number: 5,474,886

[45] Date of Patent: Dec. 12, 1995

[54] SILVER HALIDE COLOR PHOTOGRAPHIC MATERIAL

[75] Inventors: Kiyoshi Nakazyo; Keiji Mihayashi; Seiji Ichijima; Toshio Kawagishi, all of Kanagawa, Japan

[73] Assignee: Fuji Photo Film Co., Ltd., Kanagawa, Japan

[21] Appl. No.: 174,336

[22] Filed: Dec. 28, 1993

[30] Foreign Application Priority Data

Dec. 28, 1992 [JP] Japan ..... 4-358657
Jan. 20, 1993 [JP] Japan ..... 5-023390

[51] Int. Cl.[6] ..... G03C 7/305; G03C 7/36

[52] U.S. Cl. ..... 430/544; 430/549; 430/557

[58] Field of Search ..... 430/544, 557, 430/549

[56] References Cited

U.S. PATENT DOCUMENTS

| | | | |
|---|---|---|---|
| 4,477,563 | 10/1984 | Ichijima et al. | 430/544 |
| 4,782,012 | 11/1988 | DeSelms et al. | 430/544 |
| 5,118,599 | 6/1992 | Lau et al. | 430/556 |
| 5,194,369 | 3/1993 | Mihayashi et al. | 430/544 |
| 5,212,052 | 5/1993 | Sakanoue et al. | 430/557 |
| 5,213,958 | 5/1993 | Motoki et al. | 430/557 |
| 5,238,803 | 8/1993 | Ichijima et al. | 430/557 |
| 5,250,406 | 10/1993 | Yamamoto et al. | 430/544 |
| 5,294,524 | 3/1994 | Ishii et al. | 430/557 |
| 5,294,527 | 3/1994 | Deguchi | 430/557 |
| 5,306,609 | 4/1994 | Mihayashi et al. | 430/557 |
| 5,310,642 | 5/1994 | Vargas et al. | 430/544 |

*Primary Examiner*—Richard L. Schilling
*Attorney, Agent, or Firm*—Sughrue, Mion, Zinn, Macpeak & Seas

[57] ABSTRACT

A silver halide color photographic material is disclosed which comprises a support having thereon at least one light-sensitive silver halide emulsion layer. The silver halide color photographic material contains a developing solution-deactivated type timing DIR which forms either a nondiffusing dye or a dye dissolved out from the light-sensitive material during development and an acylacetamide type coupler having a specific acyl group and/or an N,N-substituted linear or cyclic malondiamide type coupler.

12 Claims, No Drawings

SILVER HALIDE COLOR PHOTOGRAPHIC MATERIAL

FIELD OF THE INVENTION

This invention relates to a silver halide color photographic material, and more particularly to a silver halide color photographic material which provides improved image quality and dye image preservability and which has improved color developability and processability.

BACKGROUND OF THE INVENTION

Attempts to improve image quality, such as high sensitivity, graininess, sharpness and color reproducibility have been made in the field of silver halide color photographic materials, particularly silver halide color photographic materials for photographing. These improvements have also been highly demanded by users.

It is well known that development-restrainer releasing compounds (DIR compounds) are used as a means for improving image quality. Examples of these compounds are described in *Research Disclosure* (herein-after abbreviated to RD) No. 307105, Item VII-F. Similar compounds to those used in the present invention are described in, for example, U.S. Pat. No. 4,782,012, JP-B-63-776 (the term "JP-B" as used herein means an "examined Japanese patent publication") and JP-A-4-204940 (the term "JP-A" as used herein means an "unexamined published Japanese patent application").

Specific acylacetamide type couplers having an acyl group are disclosed in European Patent 447,969A and U.S. Pat. No. 5,118,599. Couplers concerned with the present invention are disclosed in European Patents 447,920A and 482,552A. The use of DIR compounds in combination with the couplers concerned with the present invention is disclosed in European Patents 503,658A and 513,496A.

However, the use of DIR compounds described in JP-A-4-204940 in combination with the couplers described therein and the use of the couplers described in European Patents 447,969A, 447,920A and 482,552A and U.S. Pat. No. 5,118,599 in combination with the DIR compounds described therein do not provide a satisfactory improvement in image quality and dye image fastness or an increase in sensitivity. Further improvement has been demanded.

SUMMARY OF THE INVENTION

Accordingly, an object of the present invention is to provide a silver halide color photographic material which improves image qualities such as sharpness and color reproducibility, provides excellent dye image preservability, high color density and high sensitivity, and is excellent in processing stability.

This and other objects of the present invention have been achieved by the following silver halide color photographic material.

A silver halide color photographic material comprises a support having thereon at least one light-sensitive silver halide emulsion layer, wherein the silver halide color photographic material contains (i) at least one compound represented by the following general formula (I) or (II) and (ii) at least one acylacetamide type coupler having an acyl group represented by the following general formula (YI) and/or at least one coupler represented by the following general formula (1) or (2).

$$A_1\text{-}(TIME)_a\text{-}DI \quad (I)$$

$$A_2\text{-}(TIME)_a\text{-}DI \quad (II)$$

$A_1$ represents a group which has a nondiffusing group and releases $(TIME)_a$-DI by a reaction with an oxidant of an aromatic primary amine developing agent; $A_2$ represents a group which does not have a nondiffusing group and releases $(TIME)_a$-DI by a reaction with an oxidant of an aromatic primary amine developing agent; TIME represents a timing group which releases DI by cleavage between TIME and DI after release thereof from A; DI represents a development-restrainer which is substantially deactivated after DI is dissolved out from the photographic material into a developing solution; and a represents 1 or 2 and when a is 2, the two TIME groups may be the same or different.

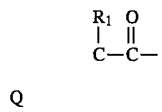

(YI)

Q $R_1$ represents a substituent group; and Q represents a nonmetallic atomic group required for forming a three-membered to five-membered hydrocarbon group together with carbon atom or a three-membered to six-membered heterocyclic ring having at least one hetero-atom, as a member of the ring, selected from the group consisting of N, O, S and P.

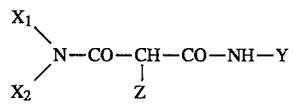

(1)

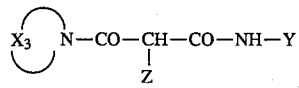

(2)

$X_1$ and $X_2$ each represents an alkyl group, an aryl group or a heterocyclic group; $X_3$ represents an organic group necessary for forming a nitrogen containing heterocyclic group together with >N—; Y represents an aryl group or a heterocyclic group; and Z represents a group which is eliminated when the coupler is reacted with an oxidants of a developing agent.

In some embodiments of the invention, fine silver halide grains which are substantially not sensitive to light are contained in the light-sensitive silver halide emulsion layer and/or a layer adjacent thereto which is nearer the support.

In other embodiments of the invention, the light-sensitive silver halide emulsion layer comprises two or more red-sensitive silver halide emulsion layers which are different in sensitivity from each other, two or more green-sensitive silver halide emulsion layers which are different in sensitivity from each other, and two or more blue-sensitive silver halide emulsion layers which are different in sensitivity from each other. These layers are arranged so as to meet the following conditions (a), (b), (c) and (d):

(a) the light-sensitive silver halide emulsion layer provided on the side which is farthest away from the support is the blue-sensitive silver halide emulsion layer (BH) having the highest sensitivity;

(b) the green-sensitive silver halide emulsion layer (GH) having the highest sensitivity and the red-sensitive silver halide emulsion layer (RH) having the highest sensitivity are provided between the BH and the blue-sensitive silver halide emulsion layer (Bh) having lower sensitivity than that of the BH;

(c) the red-sensitive silver halide emulsion layer (RL) having the lowest sensitivity, the green-sensitive silver halide emulsion layer (GL) having the lowest sensitivity and the blue-sensitive silver halide emulsion layer (BL) having the lowest sensitivity are not provided on the side which is farther away from the support than the Bh; and (d) a non-sensitive layer is provided adjacent to the BH and on the side which is nearer the support, and fine silver halide grains which are substantially not sensitive to light are contained in the BH and/or the non-sensitive layer.

DETAILED DESCRIPTION OF THE INVENTION

The present invention is described in greater detail below.

First, the compounds of general formulas (I) and (II) are described in more detail below.

When $A_1$ and $A_2$ each represents a residue of a yellow dye image forming coupler, examples thereof include residues of pivaloylacetoanilide couplers, benzoylacetoanilide couplers, malonic ester couplers, carbamoylacetamide couplers, malonic ester monoamide couplers, benzimidazolylacetamide couplers and cycloalkanoylacetamide couplers. Further, residues of the couplers described in U.S. Pat. Nos. 5,021,332 and 5,021,330 and European Patent 421,221A may be used.

When $A_1$ and $A_2$ each represents a residue of a magenta dye image forming coupler, examples thereof include residues of 5-pyrazolone couplers, pyrazolobenzimidazole couplers, pyrazolotriazole couplers, pyrazoloimidazole couplers and cyanoacetophenone couplers.

When $A_1$ and $A_2$ each represents a residue of a cyan dye image forming coupler, examples thereof include residues of phenol couplers and naphthol couplers. Further, residues of the couplers described in U.S. Pat. No. 4,746,602 and European Patent 249,453A may be used.

$A_1$ and $A_2$ each may be a residue of a coupler which does not substantially leave a dye image behind. Examples of residues of the coupler of this type include residues of indanone type couplers, acetophenone type couplers and residues of dissolving out type couplers described in European Patents 443,530A and 444,501A.

Preferred examples of $A_1$ and $A_2$ in general formulas (I) and (II) include coupler residues (residues of couplers) represented by the following general formulas (Cp-1), (Cp-2), (Cp-3), (Cp-4), (Cp-5), (Cp-6), (Cp-7), (Cp-8), (Cp-9) or (Cp-10). These couplers are preferred because they have a high coupling rate.

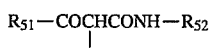

(Cp-1)

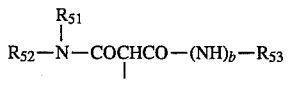

(Cp-2)

-continued

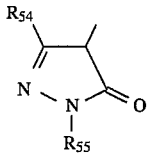

(Cp-3)

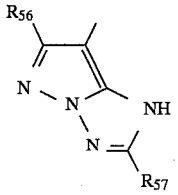

(Cp-4)

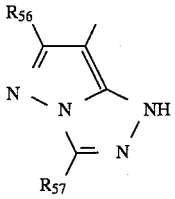

(Cp-5)

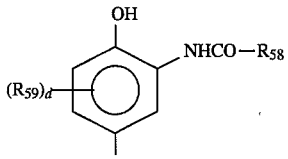

(Cp-6)

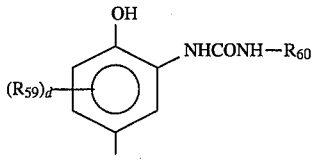

(Cp-7)

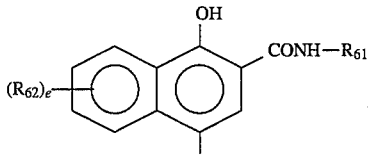

(Cp-8)

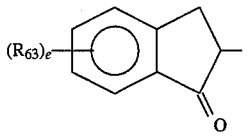

(Cp-d)

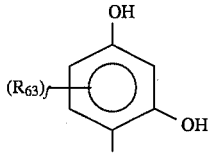

(Cp-10)

In the above general formulas, the free bond derived from the coupling site represents the position where the coupler residue is bonded to the group which is eliminated by coupling.

When the coupler residue is $A_1$ in the above formula, at least one of $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ and $R_{63}$ has a nondiffusing group, and the residue is chosen so that the total number of carbon atoms is 8 to 40, preferably 10 to 30. When the coupler residue is $A_2$ in the above formula and $R_{51}$ to $R_{63}$ each does not have nondiffusing group, the total number of carbon atoms is preferably 15 or less. When the coupler is a bis type, a telomer type or a polymer type, any one of the above substituent groups is a bivalent group and two or more of them are bonded to each other through a repeating group. In this case, the number of carbon atoms may be outside the range described above.

The term "nondiffusing group" as used herein refers to a group which sufficiently increases the molecular weight of the molecule to thereby immobilize the compound in a layer to which the compound is added.

When the coupler residue is $A_2$ in the above formula, the residue is chosen so that the total number of carbon atoms contained in $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ and $R_{63}$ is 0 to 15, preferably 0 to 10.

$R_{51}$ to $R_{63}$, b, d, e and f will be illustrated in greater detail below. In the following definitions, $R_{41}$ represents an alkyl group, an aryl group or a heterocyclic group; $R_{42}$ represents an aryl group or a heterocyclic group; and $R_{43}$, $R_{44}$ and $R_{45}$ each represents a hydrogen atom, an alkyl group, an aryl group or a heterocyclic group.

$R_{51}$ has the same meaning as $R_{41}$. $R_{52}$ and $R_{53}$ each has the same meaning as $R_{43}$, and b is 0 or 1. $R_{54}$ is a group of $R_{41}$, $R_{41}CO(R_{43})N$—, $R_{41}SO_2(R_{43})N$—, $R_{41}(R_{43})N$—, $R_{41}S$—, $R_{43}O$— or $R_{45}(R_{43})NCON(R_{44})$—.

$R_{55}$ has the same meaning as $R_{41}$. $R_{56}$ and $R_{57}$ are each a group of $R_{43}$, $R_{41}S$—, $R_{43}O$—, $R_{41}CO(R_{43})$— or $R_{41}SO_2(R_{43})N$—. $R_{58}$ has the same meaning as $R_{41}$. $R_{59}$ is a group of $R_{41}$, $R_{41}CO(R_{43})N$—, $R_{41}OCO(R_{43})N$—, $R_{41}SO_2(R_{43})N$—, $R_{43}(R_{44})NCO(R_{45})N$—, $R_{41}O$—, $R_{41}S$—, a halogen atom or $R_{41}(R_{43})N$—; and d is an integer of 0 to 3 and when d is 2 or greater, the two or more $R_{59}$ groups may be the same or different. $R_{60}$ has the same meaning as $R_{43}$. $R_{61}$ has the same meaning as $R_{43}$. $R_{62}$ is a group of $R_{41}$, $R_{41}CONH$—, $R_{41}OCONH$—, $R_{41}SO_2NH$—, $R_{43}(R_{44})NCONH$—, $R_{43}(R_{44})NSO_2NH$—, $R_{43}O$—, $R_{41}S$—, a halogen atom or $R_{41}NH$—. $R_{63}$ is a group of $R_{41}$, $R_{43}CO(R_{44})N$—, $R_{43}(R_{44})NCO$—, $R_{41}SO_2(R_{43})N$—, $R_{41}(R_{43})NSO_2$—, $R_{41}SO_2$—, $R_{43}OCO$—, a halogen atom, a nitro group, a cyano group or $R_{43}CO$—; and e is an integer of 0 to 4 and f is an integer of 0 to 3 and the two or more $R_{62}$ or $R_{63}$ groups may be the same or different when e or f are 2 or greater.

The alkyl group, the aryl group and the heterocyclic group in the coupler residue where the residue is $A_1$ are described in more detail below.

The alkyl group is a saturated or unsaturated, linear or cyclic, straight chain or branched, substituted or unsubstituted alkyl group having 1 to 32 carbon atoms, preferably 1 to 22 carbon atoms. Typical examples of the alkyl group include methyl, cyclopropyl, isopropyl, n-butyl, t-butyl, i-butyl, t-amyl, cyclohexyl, 2-ethylhexyl, 1,1,3,3-tetramethylbutyl, n-dodecyl, n-hexadecyl and n-octadecyl.

The aryl group is an aryl group having 6 to 20 carbon atoms, preferably a substituted or unsubstituted phenyl group or a substituted or unsubstituted naphthyl group.

The heterocyclic group is preferably a three-membered to eight-membered substituted or unsubstituted heterocyclic group having at least one hetero-atom of nitrogen, oxygen and sulfur, and 1 to 20 carbon atoms, preferably 1 to 7 carbon atoms. Typical examples of the heterocyclic group include 2-imidazolyl, 2-benzimidazolyl, morpholino, pyrrolidino, 1,2,4-triazole-2-yl and 1-indolinyl.

When the alkyl group, the aryl group and the heterocyclic group are substituted, typical examples of the substituent group include a halogen atom, $R_{47}O$—, $R_{46}S$—, $R_{47}CO(R_{48})N$—, $R_{47}(R_{48})NCO$—, $R_{46}SO_2(R_{47})N$—, $R_{47}(R_{48})NSO_2$—, $R_{46}SO_2$—, $R_{47}OCO$—, $R_{47}CONHSO_2$—, $R_{47}(R_{48})NCONHSO_2$—, a group of $R_{46}$, $R_{47}(R_{48})N$—, $R_{46}COO$—, a cyano group and a nitro group wherein $R_{46}$ is an alkyl group, an aryl group or a heterocyclic group; and $R_{47}$ and $R_{48}$ are each an alkyl group, an aryl group, a heterocyclic group or a hydrogen atom. The definitions of the alkyl group, the aryl group and the heterocyclic group are as described above.

The alkyl group, the aryl group and the heterocyclic group in the coupler residue where the residue is $A_2$ are described in more detail below.

The alkyl group is a saturated or unsaturated, linear or cyclic, straight chain or branched, substituted or unsubstituted alkyl group having 1 to 12 carbon atoms, preferably 1 to 8 carbon atoms. Typical examples of the alkyl group include methyl, cyclopropyl, isopropyl, n-butyl, t-butyl, i-butyl, t-amyl, cyclohexyl, 2-ethylhexyl and 1,1,3,3-tetramethylbutyl.

The aryl group is an aryl group having 6 to 10 carbon atoms, preferably a substituted or unsubstituted phenyl group.

The heterocyclic group is preferably a three-membered to eight-membered substituted or unsubstituted heterocyclic group having at least one hetero-atom of nitrogen, oxygen and sulfur and 1 to 10 carbon atoms, preferably 1 to 5 carbon atoms. Typical examples of the heterocyclic group include 2-imidazolyl, 2-benzimidazolyl, morpholino, pyrrolidino, 1,2,4-triazole-2-yl and 1-indolinyl.

When the alkyl group, the aryl group and the heterocyclic group are substituted, typical examples of the substituent group include a halogen atom, $R_{47}O$—, $R_{46}S$—, $R_{47}CO(R_{48})N$—, $R_{47}(R_{48})NCO$—, $R_{45}SO_2(R_{47})N$—, $R_{47}(R_{48})NSO_2$—, $R_{46}SO_2$—, $R_{47}OCO$—, $R_{47}CONHSO_2$—, $R_{47}(R_{48})NCONHSO_2$—, a group of $R_{46}$, $R_{47}(R_{48}N$—, $R_{46}COO$—, a cyano group or a nitro group, wherein $R_{46}$ is an alkyl group, an aryl group or a heterocyclic group; and $R_{47}$ and $R_{48}$ are each an alkyl group, an aryl group, a heterocyclic group or a hydrogen atom. The definitions of the alkyl group, the aryl group and the heterocyclic group are as described above in connection with the cases in which $A_2$ is the coupler residue.

In the present invention, the compounds of general formula (II) are preferred.

The restrainer represented by DI is described below.

Examples of the development restrainer represented by DI include the restrainers described in U.S. Pat. Nos. 4,477,563, 5,021,331, 4,937,179 and 5,004,677 and EP-A-336411, EP-A-436109, EP-A-440466, EP-A-446863, EP-A-447921, EP-A-451526, EP-A-458315, EP-A-481422 and EP-A-488310. Particularly preferred are tetrazolylthio, 1,3,4-oxadiazolylthio, 1-(or 2-)benztriazolyl, 1,2,4-triazole-1-(or 4-)yl, 1,2,3-triazole-1-yl, 1-(or 2-)-2-benzthiazolylthio, 2-benzimidazolylthio and derivatives thereof.

DI has the effect of restraining development after DI is released from $(TIME)_a$ by cleavage, and a part thereof is allowed to flow into the developing solution. DI which has flowed into the developing solution is decomposed and substantially loses the effect of restraining development.

The terms "DI substantially loses the effect of restraining development" as used herein mean that DI having development restraining property, which is released from $(TIME)_a$ in $(TIME)_a$-DI by cleavage to be present in a photographic layer or in a developing solution after flowing from a photographic layer, loses or decreases in its development restraining property by 1) alkaline hydrolysis reaction of DI, 2) decomposition reaction of DI with chemical species, e.g., hydroxylamine, contained in a developing solution or 3) decreased or lost adsorbability to silver halide of adsorption group, e.g., mercapto group, contained in DI, which is caused by displacement reaction of the adsorbing group with chemical species, e.g., hydroxylamine, contained in a developing solution.

The decomposition rate is a half-life time of 30 seconds to 2 hours, preferably 2 minutes to one hour. Typically, the decomposition reaction thereof is such that DI is hydrolyzed by an alkali, decomposed by reaction with a chemical species (e.g., hydroxylamine) contained in the developing solution or deactivated by a displacement reaction of an adsorption group (e.g., mercapto group contained in DI). The cases in which at least one of substituent groups contained in DI has an ester bond are particularly preferred. Examples of DI include the following groups.

(1)

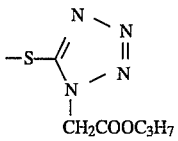

(2)

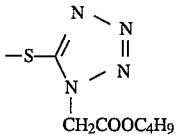

(3)

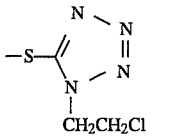

(4)

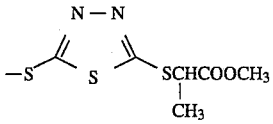

(5)

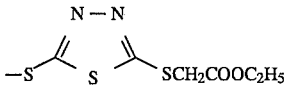

(6)

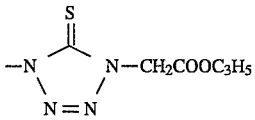

(7)

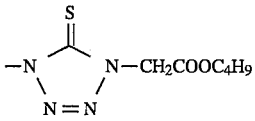

(8)

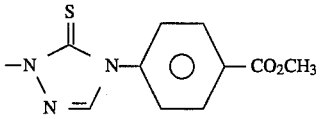

(9)

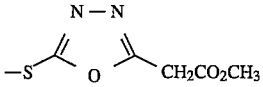

-continued (10)

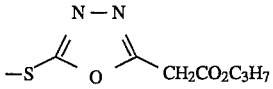

(11)

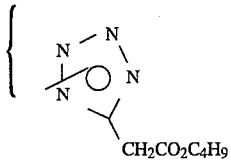

(12)

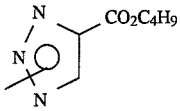

(13)

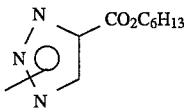

(14)

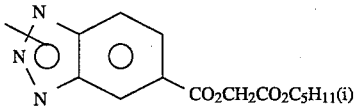

(15)

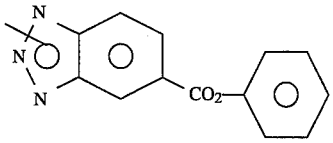

(16)

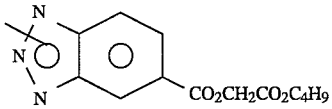

(17)

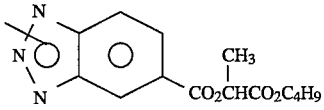

(18)

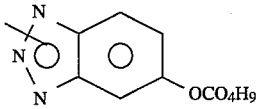

(19)

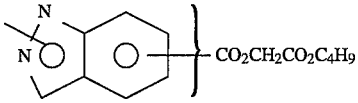

(20)

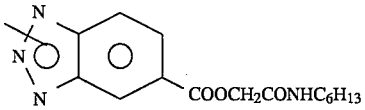

(21)

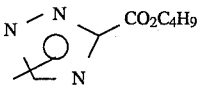

-continued (22)

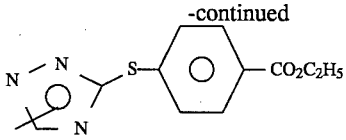

(23)

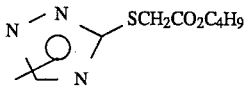

The group represented by TIME is described in more detail below.

The group represented by TIME may be any of bonding groups which can release DI by cleavage after TIME is released from $A_1$ or $A_2$ during development. Examples of TIME include a group which utilizes the cleavage reaction of hemiacetal as described in U.S. Pat. Nos. 4,146,396, 4,652,516 and 4,698,297; a timing group which causes a cleavage reaction by utilizing an intramolecular nucleophilic substitution reaction as described in U.S. Pat. Nos. 4,248,962, 4,847,185, 4,912,028 and 4,857,440; a timing group which causes a cleavage reaction by utilizing an electron transfer reaction as described in U.S. Pat. Nos. 4,409,323, 5,034,311, 5,055,385 and 4,421,845; a group which causes a cleavage reaction by utilizing the hydrolysis reaction of imino-ketal as described in U.S. Pat. No. 4,546,073; and a group which causes a cleavage reaction by utilizing a hydrolysis reaction of an ester described in West German Patent-A-2,626,317. Examples of the case where two TIME groups are bonded to each other (the case where a is 2) include timing groups described in U.S. Pat. Nos. 4,861,701, 5,026,628 and 5,021,322 and EP-A-499279 and EP-A-438129. TIME may be a timing group which releases two DIs. An example thereof includes the timing group described in EP-A-464612. TIME is bonded to $A_1$ or $A_2$ through a hetero-atom, preferably oxygen atom, sulfur atom or nitrogen atom which is a member of TIME.

In the present invention, it is preferred that the group represented by TIME is a timing group which causes a cleavage reaction by utilizing an electron transfer reaction along a conjugated moiety.

It is preferred that at least one of the two TIMEs in general formula (II) has a nondiffusing group. Examples thereof include substituent groups having 8 to 40 total carbon atoms, preferably 10 to 22 total carbon atoms.

A group represented by the following general formula (T-1), (T-2) or (T-3) is preferred as TIME:

$$*—W—(X{=}Y)_j—C(R_{21})R_{22}—** \quad \text{(T-1)}$$

$$*—W—CO—** \quad \text{(t-2)}$$

$$*—W—LINK\text{-}E— \quad **\text{(T-3)}$$

wherein * represents the position where the group is attached to $A_1$ or $A_2$ in general formula (I) or (II); ** represents the position where the group is attached to DI or TIME (when a is 2); W represents an oxygen atom, a sulfur atom or $>N—R_{23}$; X and Y each represents a methine group or nitrogen atom; j represents 0, 1 or 2; and $R_{21}$, $R_{22}$ and $R_{23}$ each represents a hydrogen atom or a substituent group. Further, any two of the substituent groups of a substituted methine group represented by X or Y, and the substituent groups represented by $R_{21}$, $R_{22}$ and $R_{23}$ may be combined together to form a ring structure (e.g., benzene ring, pyrazole ring). Of course, such a ring structure may not be formed. In general formula (T-3), E represents an electronphilic group; and LINK represents a bonding group which sterically behaves so as to allow an intramolecular nucleophilic substitution reaction to take place.

Specific examples of TIME include the following groups.

(1)

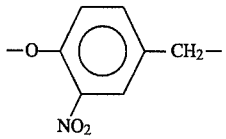

(2)

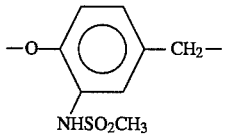

(3)

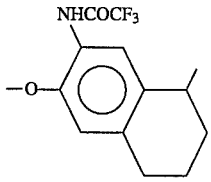

(4)

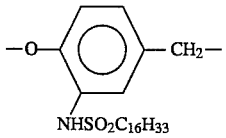

(5)

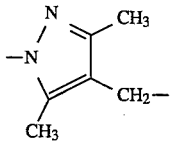

(6)

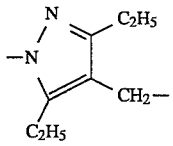

(7)

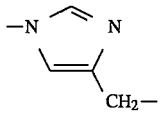

(8)

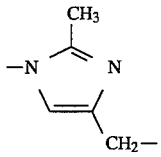

(9)

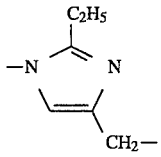

(10)

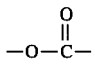

$—O—CH_2—$ (11)

$—S—CH_2—$ (12)

-continued
(13)
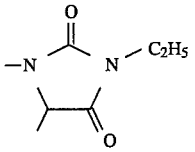
(14)
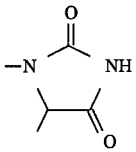
(15)
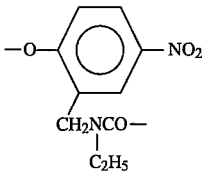
(16)
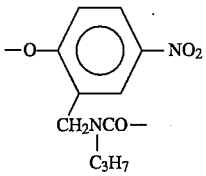
(17)
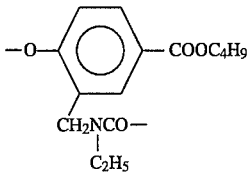
(18)
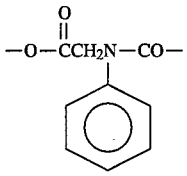
(19)
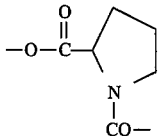
(20)
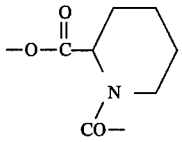
(21)
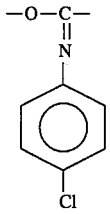
-continued
(22)
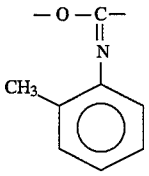
(23)
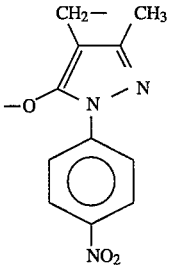
(24)
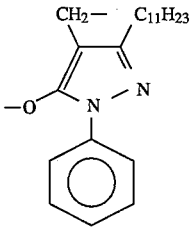
(25)
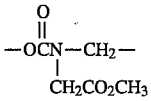
(26)
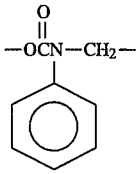
(27)
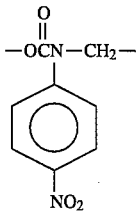
(28)
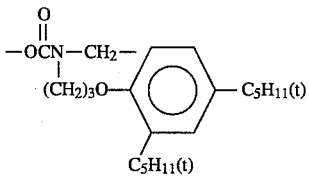
(29)
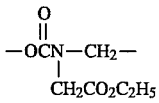
(30)
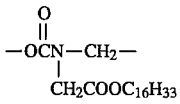

-continued
(31)
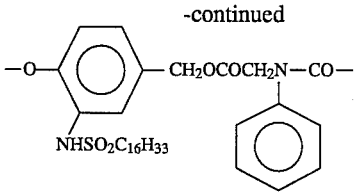
(32)
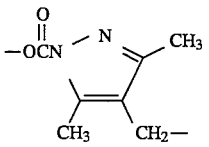
(33)
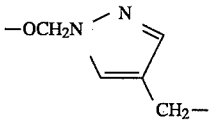
-continued
(34)
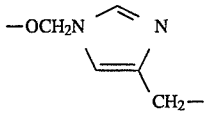
Specific examples of the compounds of general formulas (I) and (II) which can be used in the present invention include, but are not limited to, the following compounds.
(D-1)
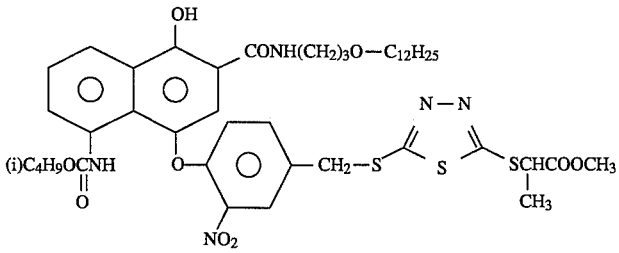
(D-2)
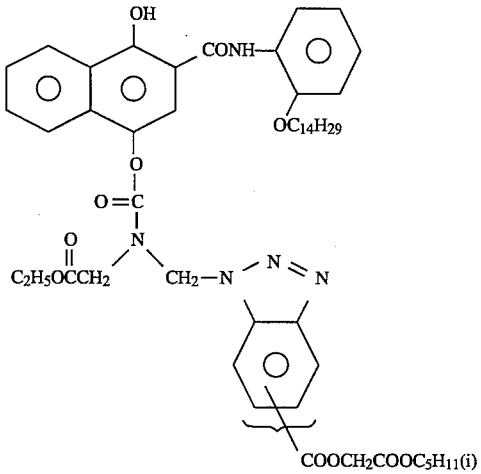
(D-3)
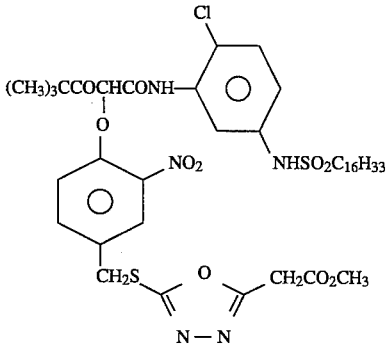

-continued
(D-4)
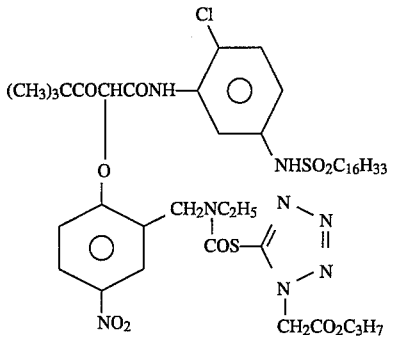
(D-5)
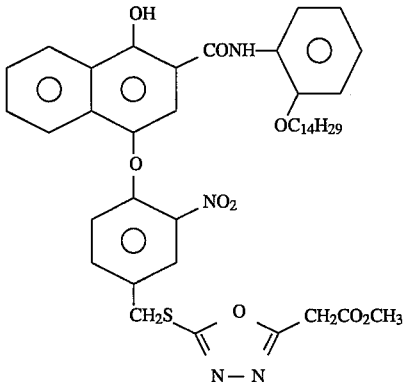
(D-6)
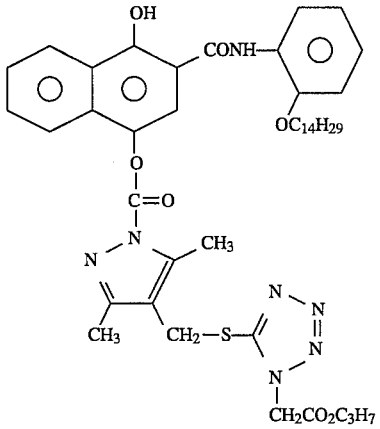
(D-7)
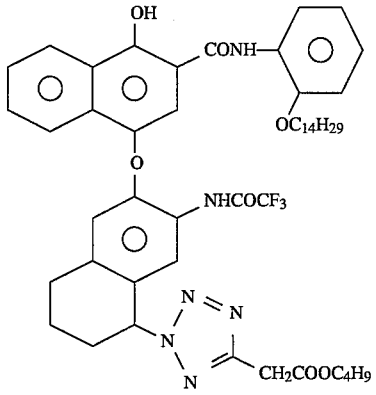

-continued
(D-8)
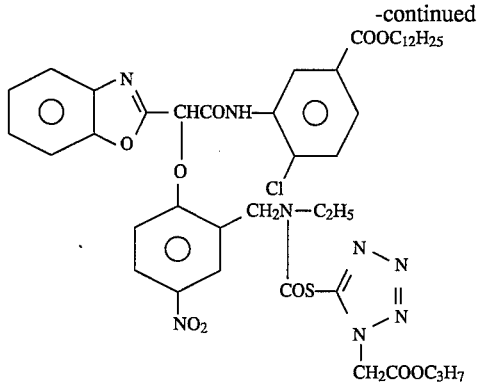
(D-9)
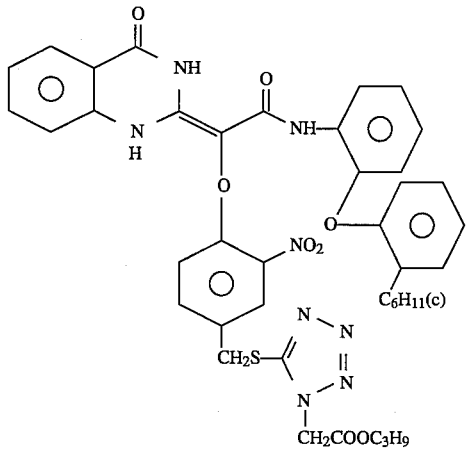
(D-10)
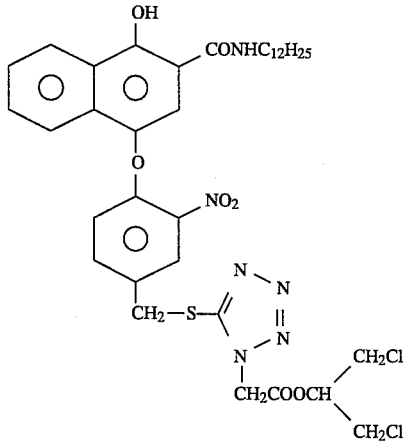
(D-11)
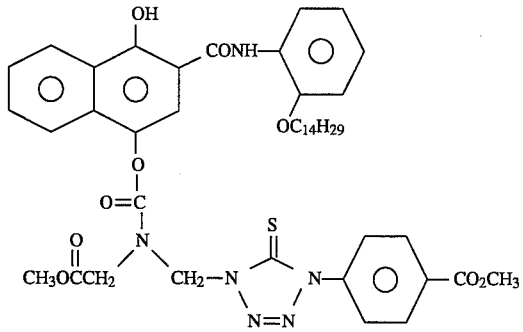

-continued
(D-12)
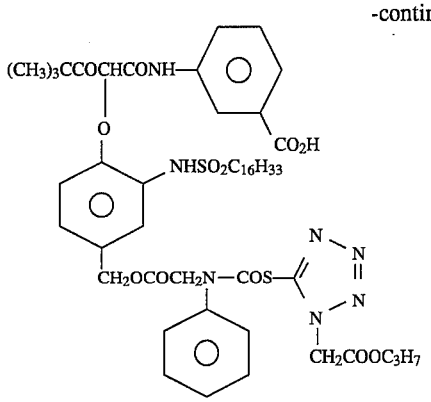
(D-13)
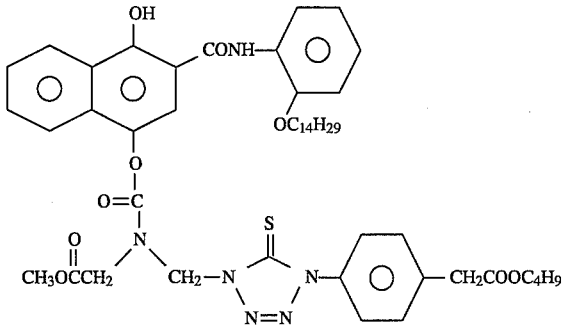
(D-14)
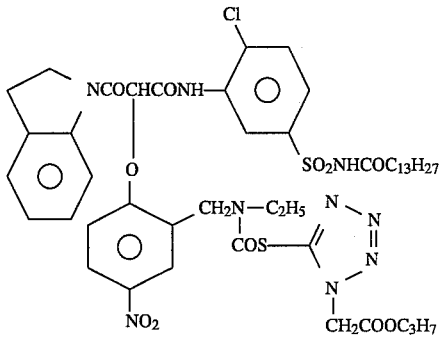
(D-15)
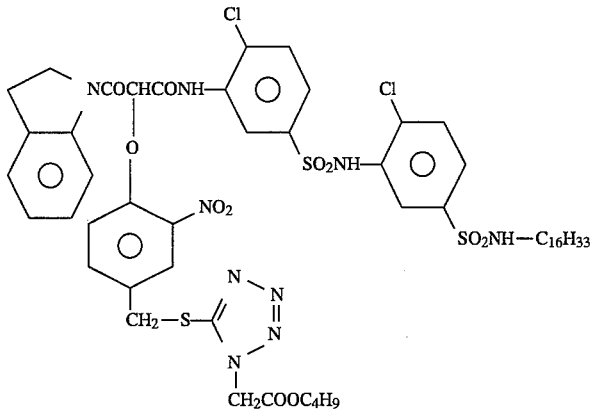

-continued
(D-16)
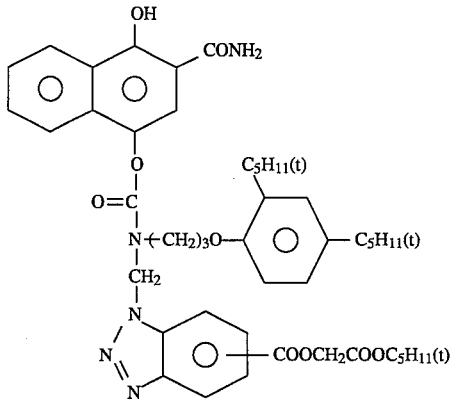
(D-17)
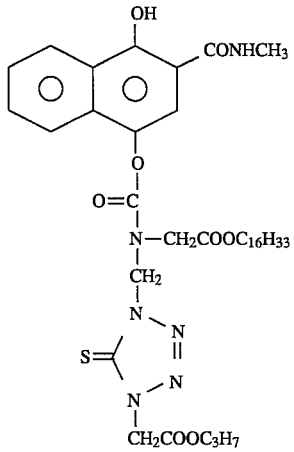
(D-18)
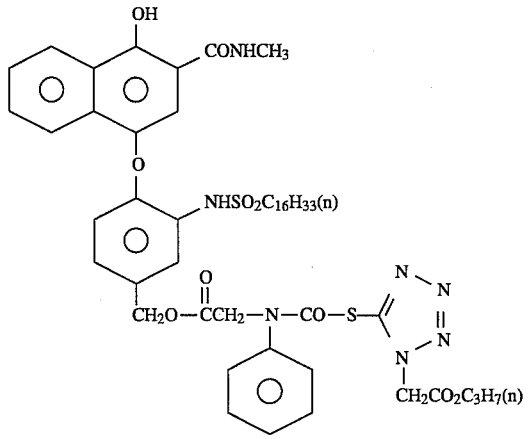
(D-19)
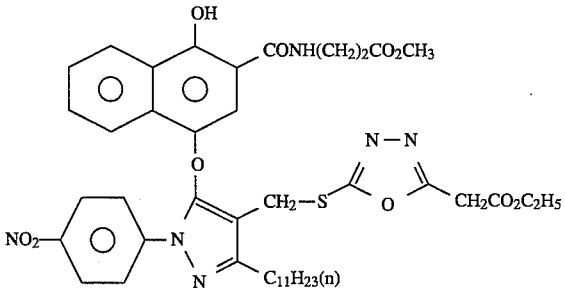

-continued
(D-20)
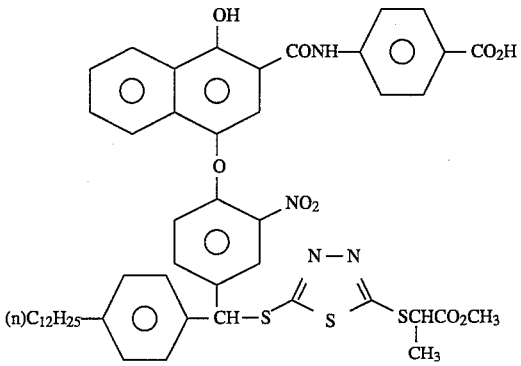
(D-21)
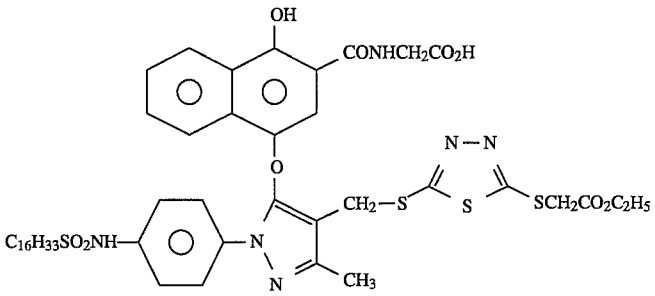
(D-22)
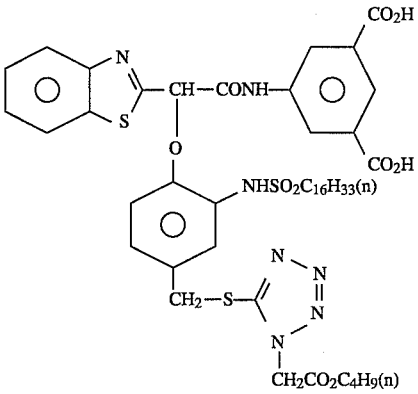
(D-23)
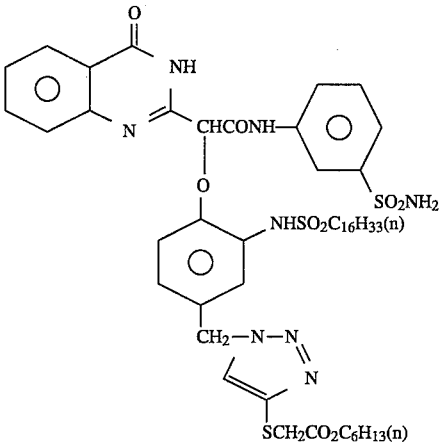

-continued
(D-24)
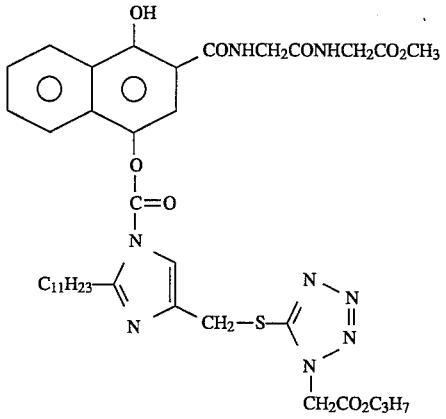
(D-25)
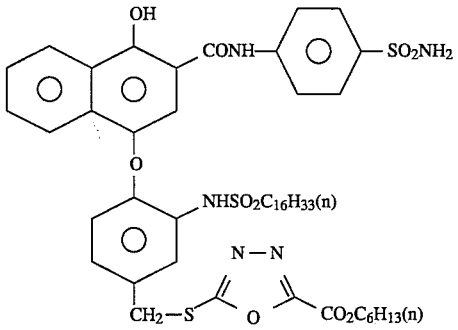
(D-26)
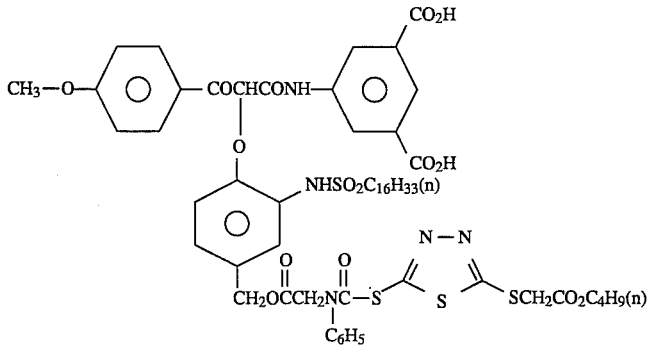
(D-27)
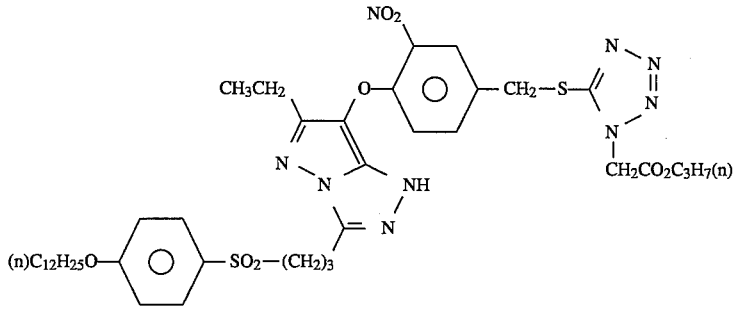

-continued
(D-28)
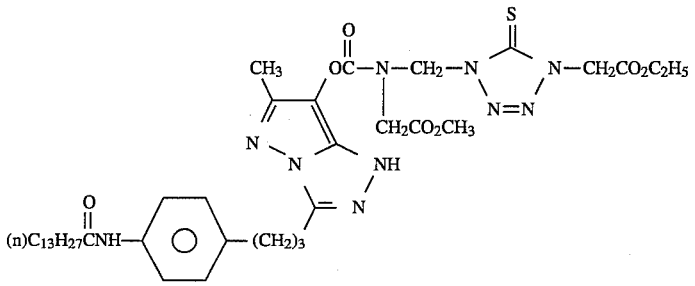
(D-29)
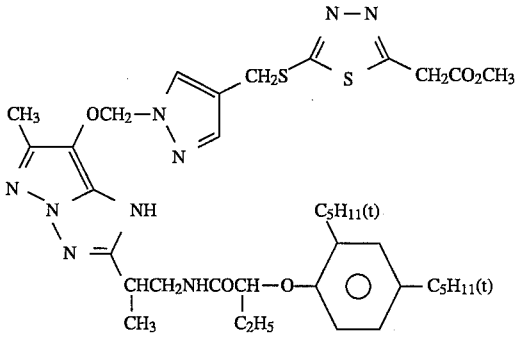
(D-30)
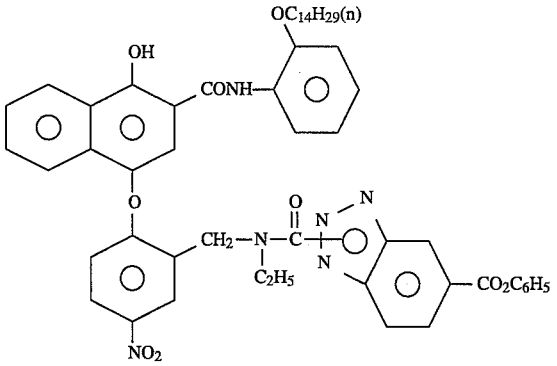
(D-31)
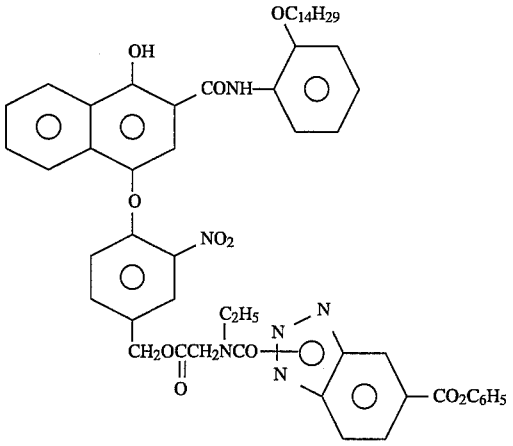

-continued
(D-32)
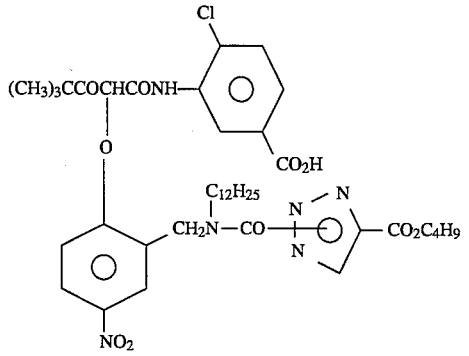
(D-33)
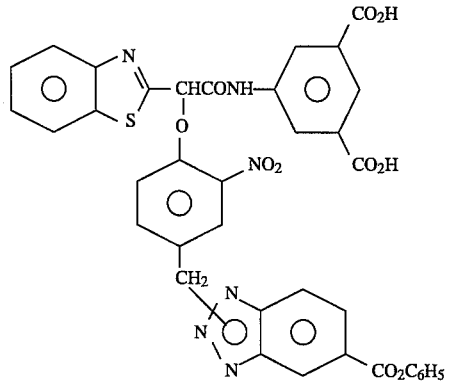
(D-34)
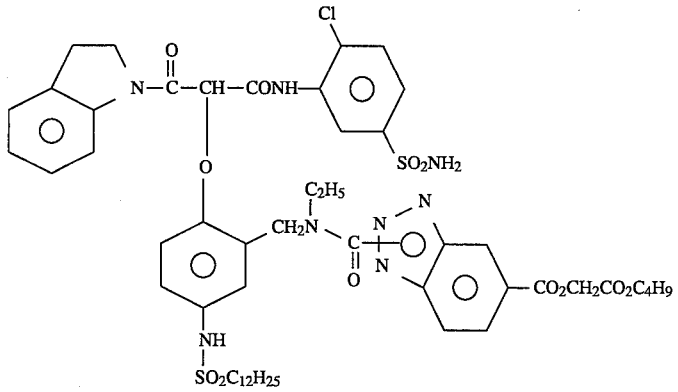
(D-35)
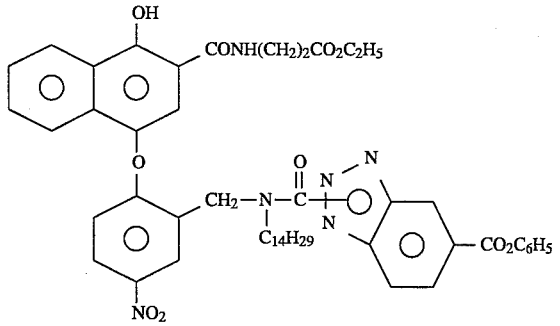

-continued
(D-36)
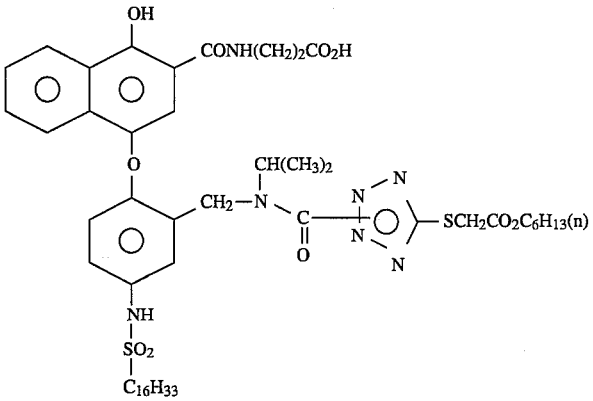
(D-37)
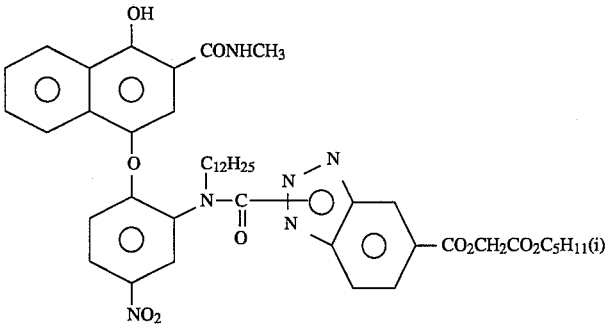
(D-38)
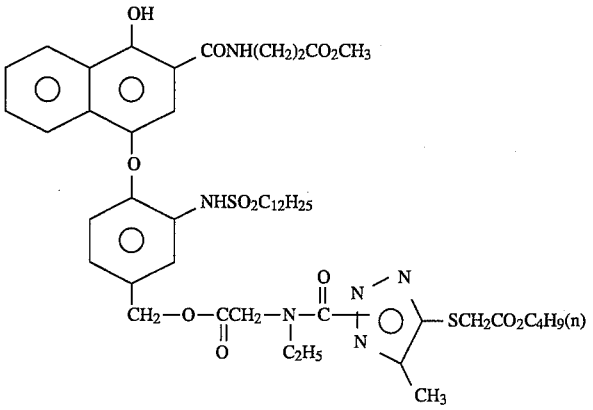
(D-39)
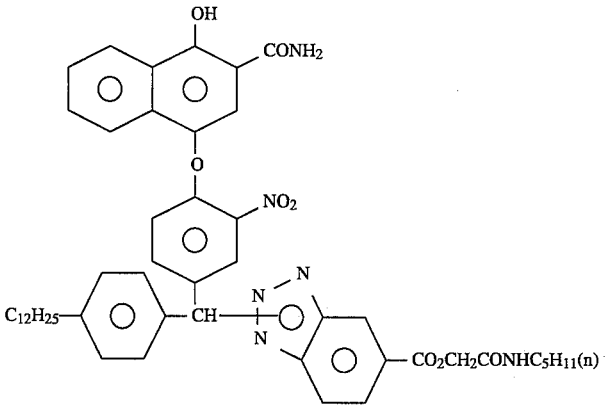

-continued
(D-40)
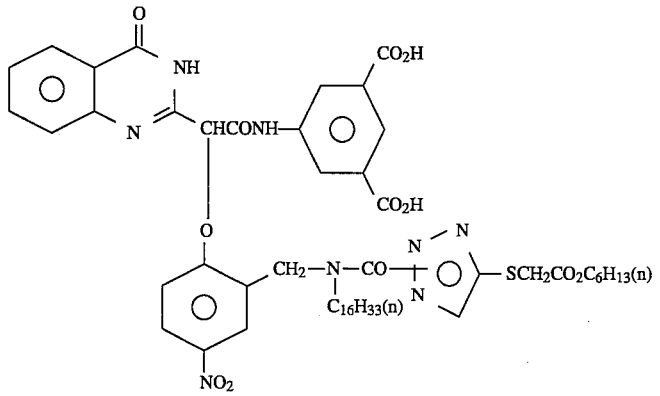
(D-41)
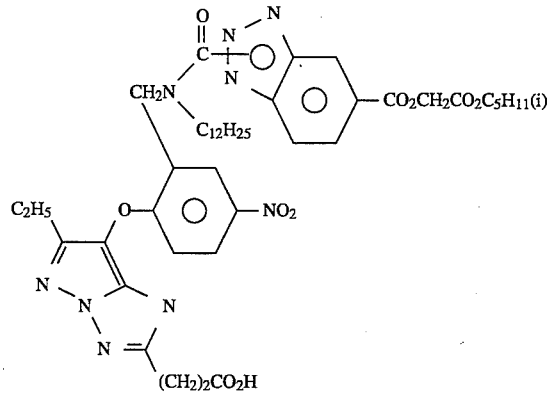
(D-42)
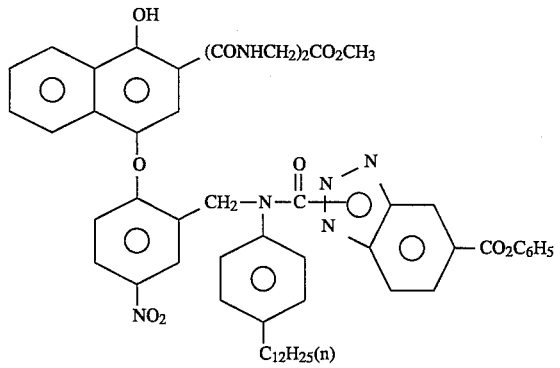
(D-43)
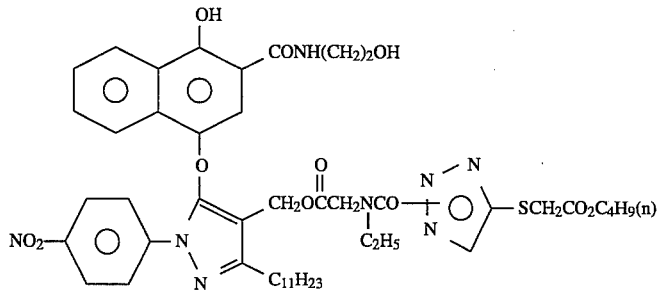

-continued (D-44)

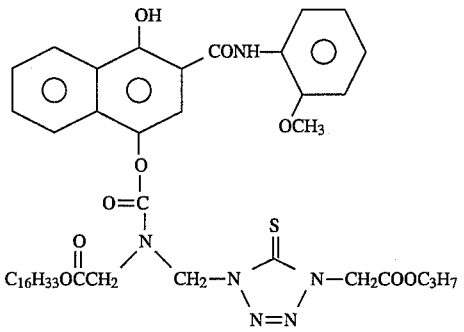

(D-45)

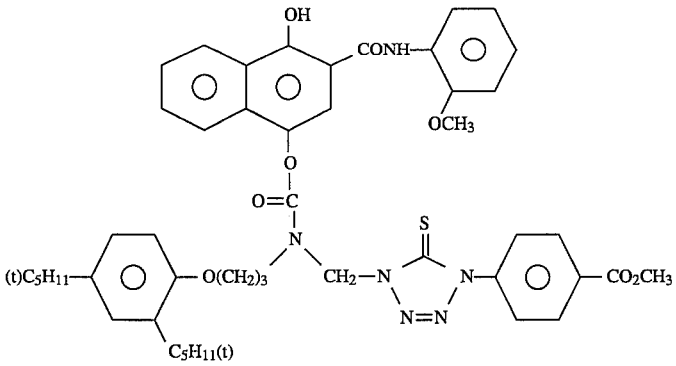

(D-46)

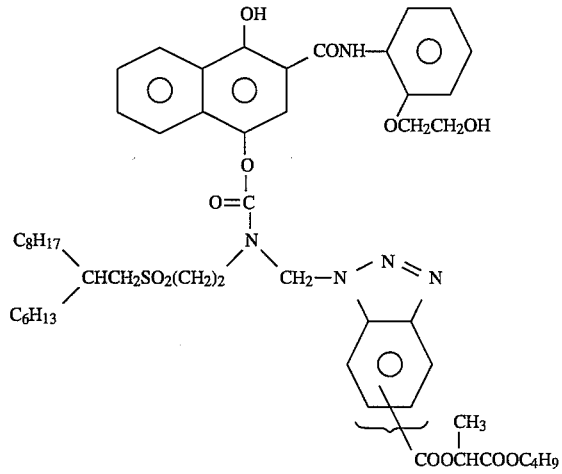

The compounds of general formula (I) or (II) used in the present invention can be synthesized by the methods described in U.S. Pat. No. 4,782,012, JP-A-57-151944, JP-A-58-162949, JP-A-60-128444, JP-A-63-037350, JP-A-3-198048, JP-A-3-228048, JP-A-4-251843, JP-A-4-278942, JP-A-4-279943, JP-A-4-280247, JP-A-4-313750 and the patent specifications cited in the examples of the aforesaid restrainers and timing groups and referring thereto.

The compounds of general formulas (I) and (II) can be used in ally of the light-sensitive silver halide emulsion layers and the non-sensitive layers. However, it is preferred that the compounds are used in the light-sensitive silver halide emulsion layers or the non-sensitive layers adjacent to the light-sensitive silver halide emulsion layers. It is preferred that the compounds of general formula (I) are added to the red-sensitive emulsion layers. The moiety represented by $A_1$ in general formula (I) is preferably a group of general formula (Cp-6), (Cp-7) or (Cp-8), and the group of general formula (Cp-8) is particularly preferred. It is preferred that the compounds of general formula (II) are added to the green-sensitive emulsion layers and/or the blue-sensitive emulsion layers.

The amounts of the compounds to be used vary depending on the performance of the photographic materials required, but the compounds are used in an amount of generally $1\times10^{-8}$ to $1\times10^{-2}$ mol, preferably $1\times10^{-7}$ to $1\times10^{-3}$ mol, per $m^2$ of the layer to which the compounds are added. The compounds are used in an amount of generally $1\times10^{-6}$ to 0.5 mol, preferably $1\times10^{-5}$ to $1\times10^{-1}$ mol, per mol of silver halide present in the light-sensitive silver halide emulsion layer or the layer adjacent thereto.

Two or more compounds of general formulas (I) and (II) may be used in the same layer. One compound may be used in two or more layers. Further, the compounds of general formulas (I) and (II) may be used together with conventional DIR compounds according to the performance required for the photographic materials. Examples of conventional DIR compounds which can be preferably used include those described in patent specifications cited in *RD* No. 17643, Item VII-F, *RD* No. 307105, Item VII-F, JP-A-57-151944, JP-A-57-154234, JP-A-60-184248, JP-A-63-37346, JP-A-63-37350, U.S. Pat. Nos. 4,248,962 and 4,782,012 and European Pat. Nos. 464,612A, 482,552A and 499,279A.

The compounds of general formulas (I) and (II) can be introduced into the photographic materials by various conventional dispersion methods described hereinafter.

These compounds together with various couplers and additives described hereinafter can be introduced into the photographic materials.

The acylacetamide type yellow couplers having an acyl group of general formula (YI) used in the present invention are described in greater detail below.

Compounds represented by the following general formula (YII) are preferred as the acylacetamide type yellow couplers.

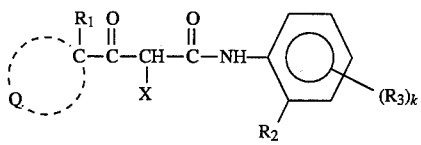

(YII)

In general formula (YII), $R_1$ represents a substituent group other than hydrogen; Q represents a nonmetallic atomic group required for forming a three-membered to five-membered hydrocarbon ring together with C or a three-membered to six-membered heterocyclic ring having at least one hetero-atom, as a member of the ring, selected from the group consisting of N, S, O and P; $R_2$ represents a hydrogen atom, a halogen atom (F, Cl Br, I), an alkoxy group, an aryloxy group, an alkyl group or an amino group; $R_3$ represents a substituent group which can be attached to the benzene ring; X represents a hydrogen atom or a group which can be eliminated by a coupling reaction with an oxidant of an aromatic primary amine developing agent (hereinafter referred to as an eliminable group); and k represents an integer of 0 to 4 and when k is 2 or greater, the two or more $R_3$ groups may be the same or different. $R_1$ is preferably an organic group containing no metal, more preferably a hydrocarbon group which may be substituted.

Examples of substituent group other than hydrogen atom of $R_1$ and substituent group of $R_3$ which can be substituted on benzene ring include a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an aryloxysulfonyl group, an acyloxy group, a nitro group, a heterocyclic group, a cyano group, an acyl group, an acyloxy group, an alkylsulfonyloxy group and an arylsulfonyloxy group.

Examples of the eliminable group represented by X include a heterocyclic group which is bonded to the coupling active site through a nitrogen atom, an aryloxy group, an arylthio group, an acyloxy group, an alkylsulfonyloxy group, an arylsulfonyloxy group, a heterocyclic oxy group, a heterocyclic thio group or a halogen atom.

When $R_1$, $R_2$ or $R_3$ is an alkyl group or has an alkyl portion in general formula (YII), the alkyl group or the alkyl portion is a straight chain, branched or cyclic, substituted or unsubstituted, saturated or unsaturated alkyl group or alkyl portion, unless otherwise stated. The alkyl group or the alkyl portion has 1 to 40 carbon atoms. When the alkyl group or the alkyl portion is a nondiffusing group, carbon number thereof is 8 to 40, and preferably 10 to 30. When the alkyl group or the alkyl portion is not required to be a nondiffusing group, carbon number thereof is 1 to 8. Examples of the alkyl group or the alkyl portion include methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl and phenoxyethyl.

When $R_1$, $R_2$ or $R_3$ is an aryl group or has an aryl portion in general formula (YII), the aryl group or the aryl portion is a substituted or unsubstituted monocyclic or fused ring type aryl group or aryl portion, unless otherwise stated. Examples of the aryl group or the aryl portion include phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl and 3,4-dichlorophenyl.

When the $R_1$, $R_2$ or $R_3$ group is a heterocyclic group or has a heterocyclic portion in general formula (YII), the heterocyclic group or the heterocyclic portion is a three-membered to eight-membered substituted or unsubstituted, monocyclic or fused ring type heterocyclic group or heterocyclic portion, unless otherwise stated. Examples of the heterocyclic group or the heterocyclic portion include 2-furyl, 2-pyridyl, 4-pyridyl, 1-pyrazolyl, 1-imidazolyl, 1-benzotriazolyl, 2-benzotriazolyl, succinimido, phthalimido and 1-benzyl-2,4-imidazolidinedione-3-yl.

The substituent groups which can be preferably used in general formula (YII) are described below.

In general formula (YII), $R_1$ is preferably a halogen atom, a cyano group, an alkyl group, an alkoxy group, an alkylthio group, an aryl group, an aryloxy group or an arylthio group which each has 1 to 30 carbon atoms in total and may be substituted. Examples of the substituent group include a halogen atom, an alkyl group, an alkoxy group, a nitro group, an amino group, a carbonamido group, a sulfonamido group and an acyl group. $R_1$ may be a so-called ballast group. When Q together with C forms a heterocyclic ring having at least one hetero-atom, as a member of the ring, selected from the group consisting of N, O, S and P, $R_1$ together with Q may form a bicyclo ring.

In general formula (YII), Q is preferably a nonmetallic atomic group required for forming a three-membered to five-membered substituted or unsubstituted hydrocarbon ring having 3 to 30 carbon atoms together with C or a three-membered to five-membered substituted or unsubstituted heterocyclic ring having 2 to 30 carbon atoms and at least one hereto-atom, as a member of the ring, selected from the group consisting of N, S, O and P. The ring formed by Q together with C may have unsaturated bonds or may be substituted or unsubstituted except for $R_1$. Examples of the ring formed by Q together with C include a cyclopropane ring, a cyclobutane ring, a cyclopentane ring, a cyclopropene ring, a cyclobutene ring, a cyclopentene ring, an oxetane ring, an oxolan ring, an oxane ring, a 1,3-dioxolan ring, a dioxane (1,3- or 2,4-) ring, a thietane ring, a thiolan ring, a thian ring, a 1,3-dithiolan ring, a dithian (1,3- or 1,4-) ring, a 1,4-oxathian ring and a pyrrolidine ring. Examples of the substituent group has the same meaning as in the definition of the substituent groups for $R_3$. The substituent groups may be further substituted by oxo group (=0) or may be combined together to form a ring.

In general formula (YII), $R_2$, is preferably a halogen atom, an alkoxy group having 1 to 30 carbon atoms which may be substituted, an aryloxy group having 6 to 30 carbon atoms which may be substituted, an alkyl group having 1 to 30 carbon atoms which may be substituted or an amino group having 0 to 30 carbon atoms which may be substituted. Examples of the substituent groups include a halogen atom, an alkyl group, an alkoxy group and an aryloxy group.

In general formula (YII), $R_3$ is preferably a halogen atom, an alkyl group having 1 to 30 carbon atoms, an aryl group having 6 to 30 carbon atoms, an alkoxy group having 1 to 30 carbon atoms, an alkoxycarbonyl group having 2 to 30 carbon atoms, an aryloxycarbonyl group having 7 to 30 carbon atoms, a carbonamido group having 1 to 30 carbon atoms, a sulfonamido group having 1 to 30 carbon atoms, a carbamoyl group having 1 to 30 carbon atoms, a sulfamoyl group having 0 to 30 carbon atoms, an alkylsulfonyl group having 1 to 30 carbon atoms, an arylsulfonyl group having 6 to 30 carbon atoms, a ureido group having 1 to 30 carbon atoms, a sulfamoylamino group having 0 to 30 carbon atoms, an alkoxycarbonylamino group having 2 to 30 carbon atoms, a heterocyclic group having 1 to 30 carbon atoms, an acyl group having 1 to 30 carbon atoms, an alkylsulfonyloxy group having 1 to 30 carbon atoms or an arylsulfonyloxy group having 6 to 30 carbon atoms. These groups may be substituted by one or more substituent groups. Examples of the substituent groups include a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, sulfamoylamino group, a ureido group, a cyano group, a nitro group, an acyloxy group, an alkoxycarbonyl group, an aryloxycarbonyl group, an alkylsulfonyloxy group and an arylsulfonyloxy group.

In general formula (YII), k is preferably an integer of 1 or 2, and $R_3$ is preferably attached to the meta- or para-position with respect to the acylacetamido group.

In general formula (YII ), X is preferably a heterocyclic group which is bonded to the coupling site through a nitrogen atom or an aryloxy group.

When X is a heterocyclic group, X is preferably a five-membered to seven-membered monocyclic or fused ring type heterocyclic group which may be substituted. Examples of the heterocyclic group include succinimido, maleinimido, phthalimido, diglycolimido, pyrrole, pyrazole, imidazole, 1,2,4-triazole, tetrazole, indole, indazole, benzimidazole, benztriazole, imidazolidine-2,4-dione, oxazolidine-2,4-dione, thiazolidine-2,4-dione, imidazolidine-2-one, oxazolidine-2-one, thiazolidine-2-one, benzimidazoline-2-one, benzoxazoline-2-one, benzthiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine and 2-imino-1,3,4-thiazolidine-4-one. These heterocyclic rings may be substituted. Examples of substituent groups for the heterocyclic rings include a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group and a sulfamoylamino group.

When X is an aryloxy group, X is preferably an aryloxy group having 6 to 30 carbon atoms which may be substituted by one or more of the substituent groups already described above in the definition of the substituent groups for the heterocyclic group represented by X. Preferred examples of the substituent groups for the aryloxy group include a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group and a cyano group.

The substituent groups which can be particularly preferably used in general formula (YII) are described below.

Particularly preferably, $R_1$ is an alkyl group having 1 to 30 carbon atoms (e.g., methyl, ethyl, n-propyl, n-butyl, isobutyl, n-octyl, n-dodecyl, phenoxymethyl, phenylthiomethyl, p-toluenesulfonylmethyl, benzyl, cyclohexylmethyl, methoxyethyl), with an alkyl group having 1 to 4 carbon atoms being most preferred.

Particularly preferably, Q is a nonmetallic atomic group required for forming a three-membered to five-membered hydrocarbon ring together with C. Examples of Q include an ethylene group, a trimethylene group and a tetramethylene group. These groups may be substituted. Examples of the substituent group include an alkyl group, an alkoxy group, an aryl group and a halogen atom. Most preferably, Q is a substituted or unsubstituted ethylene group.

Particularly preferably, $R_2$ is a chlorine atom, a fluorine atom, an alkyl group having 1 to 6 carbon atoms (e.g., methyl, trifluoromethyl, ethyl, isopropyl, t-butyl), an alkoxy group having 1 to 30 carbon atoms (e.g., methoxy, ethoxy, methoxyethoxy, butoxy, hexadecyloxy) or an aryloxy group having 6 to 24 carbon atoms (e.g., phenoxy, p-tolyloxy, p-methoxyphenoxy). Most preferably, $R_2$ is a chlorine atom, a methoxy group or a trifluoromethyl group.

Particularly preferably, $R_3$ is a halogen atom, a cyano group, a trifluoromethyl group, an alkoxy group, an alkoxycarbonyl group, an aryloxycarbonyl group, a carbonamido group, a sulfonamido group, a carbamoyl group or a sulfamoyl group. Most preferably, $R_3$ is a chlorine atom, an alkoxy group, an alkoxycarbonyl group, a sulfamoyl group, a carbonamido group or a sulfonamido group.

Particularly preferably, X is a group represented by the following general formula (Y-1), (Y-2) or

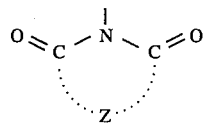
(Y-1)

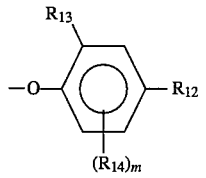
(Y-2)

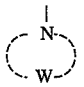
(Y-3)

In general formula (Y-1), Z represents —O—$CR_4(R_5)$—, —S—$CR_4(R_5)$—, —$NR_6$—$CR_4(R_5)$—, —$NR_6$—$NR_7$—, —$NR_6$—C(O=)—, —$CR_4(R_5)$—$CR_8(R_9)$— or —$CR_{10}$=$CR_{11}$—.

$R_4$, $R_5$ , $R_8$ and $R_9$ each represents a hydrogen atom, an alkyl group, an aryl group, an alkoxy group, an aryloxy group, an alkylthio group, an arylthio group, an alkylsulfonyl group, an arylsulfonyl group or an amino group; $R_6$ and $R_7$ each represents a hydrogen atom, an alkyl group, an aryl group, an alkylsulfonyl group, an arylsulfonyl group or an alkoxycarbonyl group; and $R_{10}$ and $R_{11}$ each represents a hydrogen atom, an alkyl group or an aryl group; or $R_{10}$ and $R_{11}$ may be combined together to form a benzene ring, and $R_4$ and $R_5$, $R_5$ and $R_6$, $R_6$ and $R_7$, or $R_4$ and $R_8$ may be combined together to form a ring (e.g., cyclobutane, cyclohexane, cycloheptane, cyclohexene, pyrrolidine, piperidine).

The heterocyclic group of general formula (Y-1) where Z is —O—$CR_4(R_5)$—, —$NR_6$—$CR_4(R_5)$—, or —$NR_6$—$NR_7$— is particularly preferred. The heterocyclic group of general formula (Y-1) has 2 to 30 carbon atoms, preferably 4 to 20 carbon atoms, more preferably 5 to 16 carbon atoms.

In general formula (Y-2), at least one of $R_{12}$ and $R_{13}$ is a member selected from the group consisting of a halogen atom, a cyano group, a nitro group, a trifluoromethyl, a carboxyl group, an alkoxycarbonyl group, a carbonamido group, a sulfonamido group, a carbamoyl group, a sulfamoyl group, an alkylsulfonyl group, an arylsulfonyl group and an acyl group, and the other may be a hydrogen atom, an alkyl group or an alkoxy group; $R_{14}$ has the same meaning as $R_{12}$ or $R_{13}$; and m represents an integer of 0 to 2. In general formula (Y-2), the aryloxy group has 6 to 30 carbon atoms, preferably 6 to 24 carbon atoms, more preferably 6 to 15 carbon atoms.

In general formula (Y-3), W represents a nonmetallic atomic group required for forming a pyrrole ring, a pyrazole ring, an imidazole ring or a triazole ring together with N. The ring of general formula (Y-3) may have one or more substituent groups. Preferred examples of the substituent groups include a halogen atom, a nitro atom, a cyano atom, an alkoxycarbonyl group, an alkyl group, an aryl group, an amino group, an alkoxy group, an aryloxy group and a carbamoyl group. The heterocyclic group of general formula (Y-3) has 2 to 30 carbon atoms, preferably 2 to 24 carbon atoms, more preferably 2 to 16 carbon atoms.

Most preferably, X is a group of general formula (Y-1).

The couplers of general formula (YII) may be in the form of a dimer or a higher polymer where two or more members thereof are bonded to each other at the position of $R_1$, $R_2$, $R_3$, Q or X through a bond or a bivalent or polyvalent group. In this case, the number of carbon atoms described above in the definition of each substituent group may be outside the range specified above.

Specific examples of the yellow couplers of general formula (YII) include the following compounds.

(Y-1)

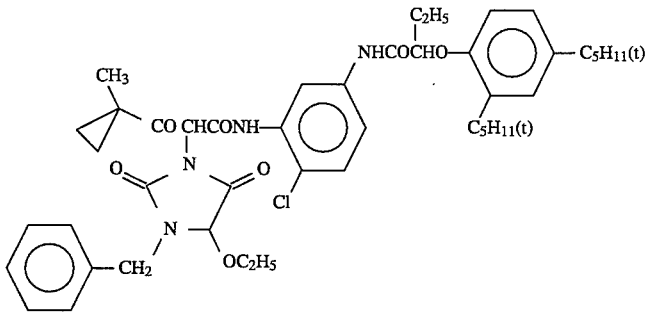

(Y-2)

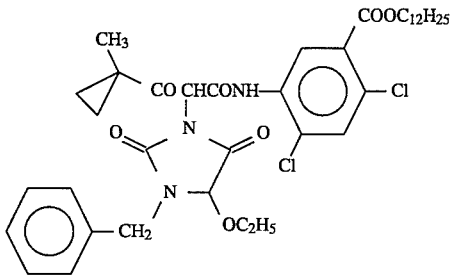

(Y-3)

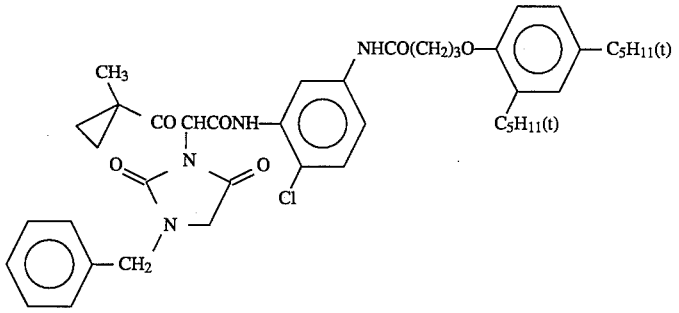

-continued
(Y-4)
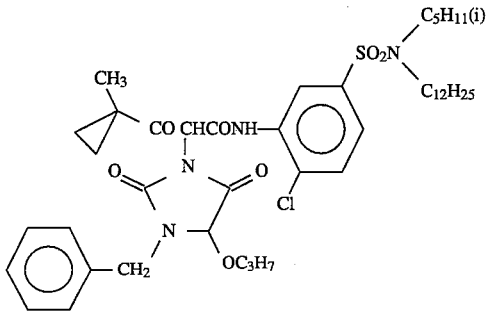
(Y-5)
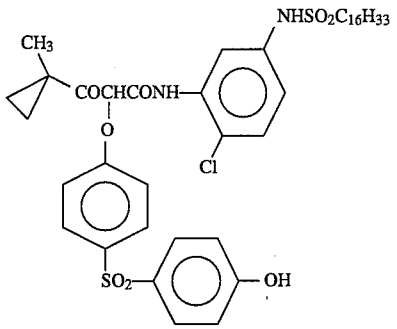
(Y-6)
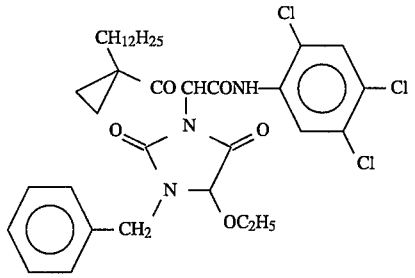
(Y-7)
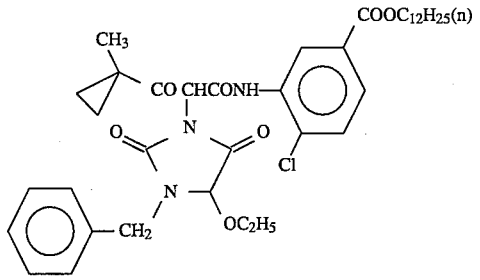
(Y-8)
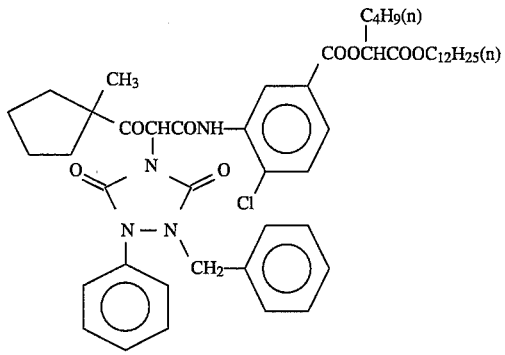

-continued
(Y-9)
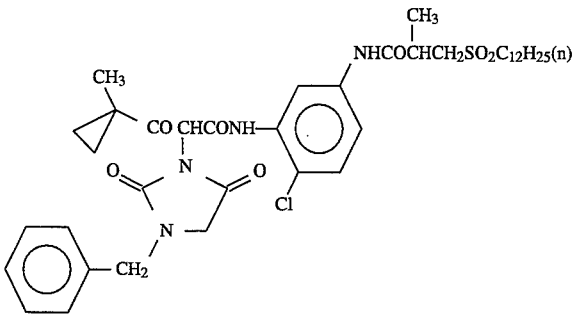
(Y-10)
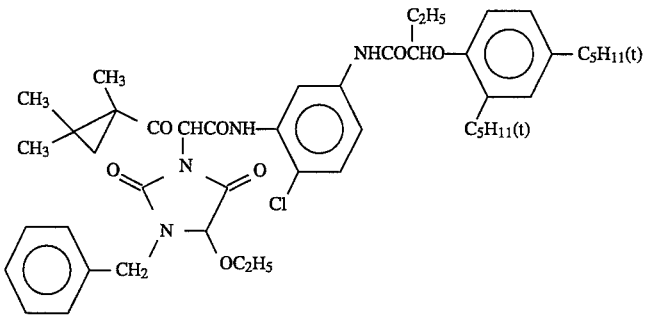
(Y-11)
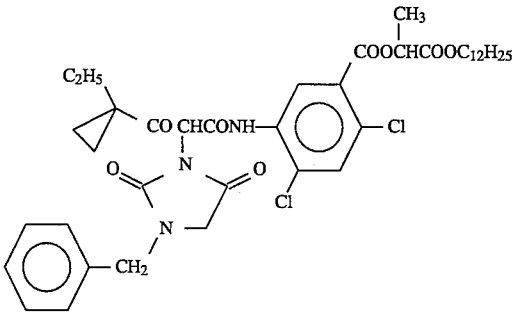
(Y-12)
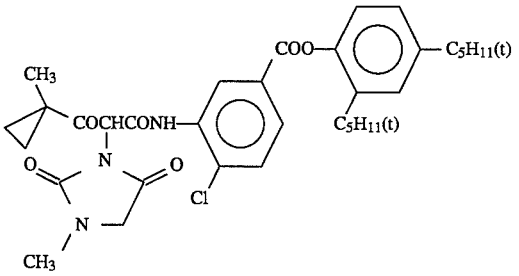
(Y-13)
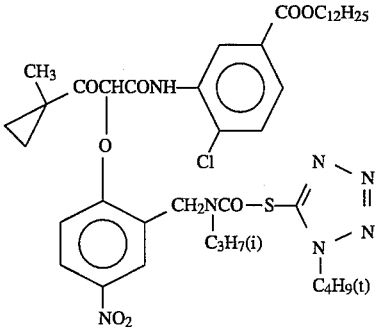

-continued
(Y-14)
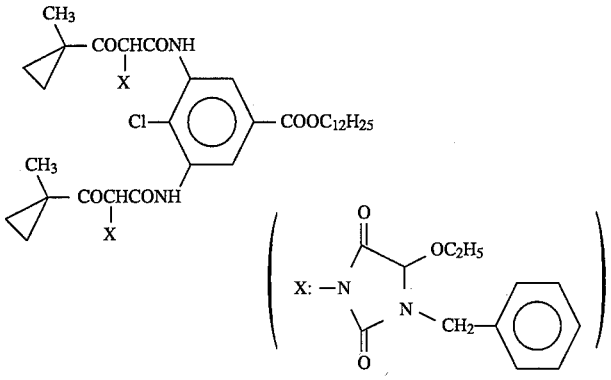
(Y-15)
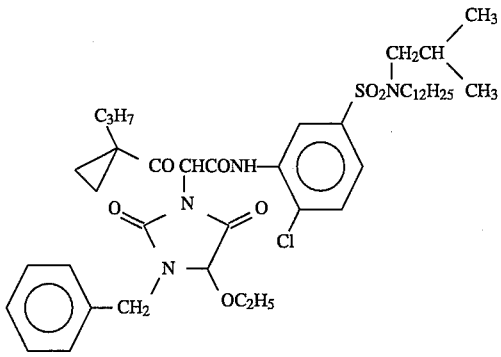
(Y-16)
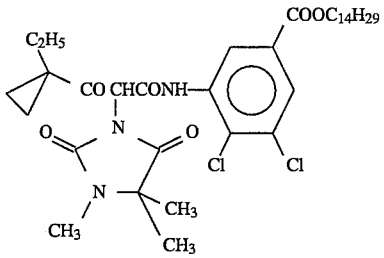
(Y-17)
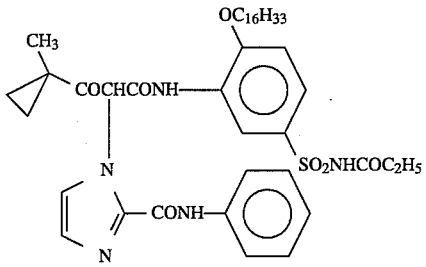
(Y-18)
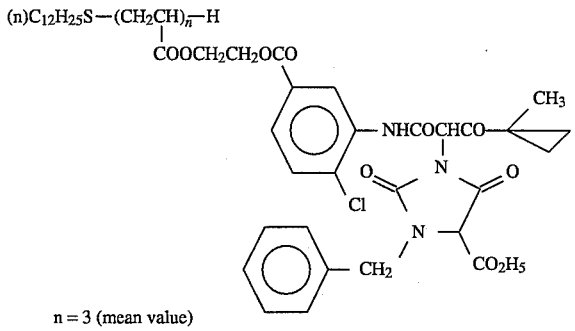
n = 3 (mean value)

-continued
(Y-19)
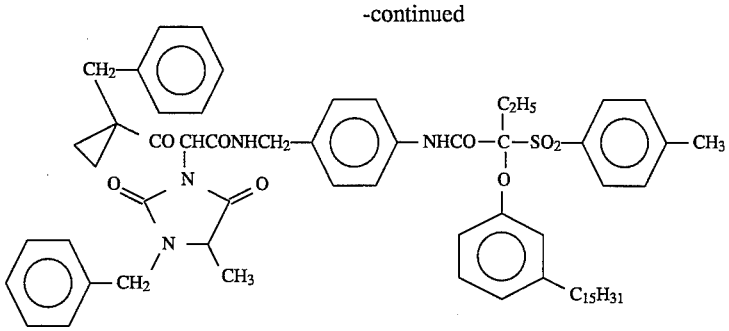
(Y-20)
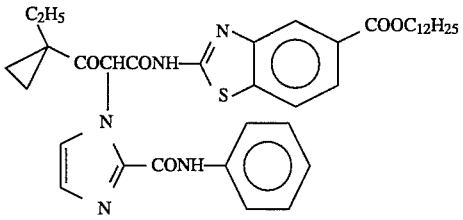
(Y-21)
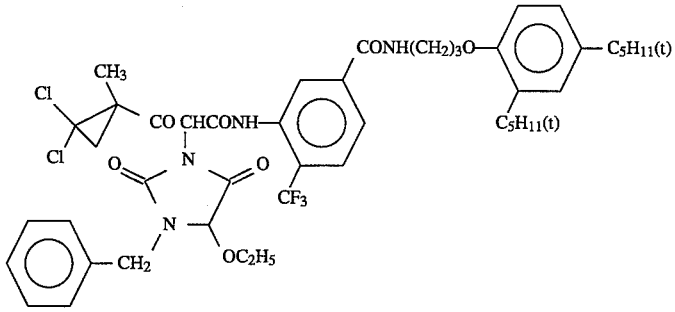
(Y-22)
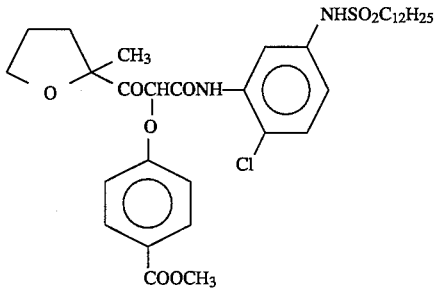
(Y-23)
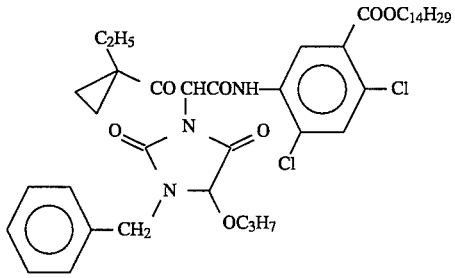

-continued
(Y-24)
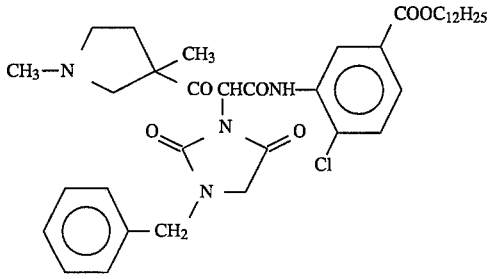
(Y-25)
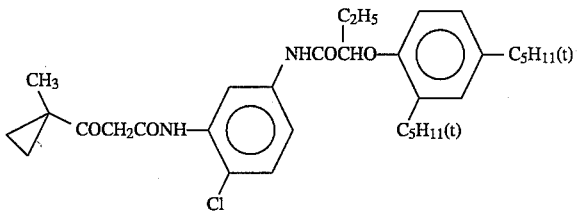
(Y-26)
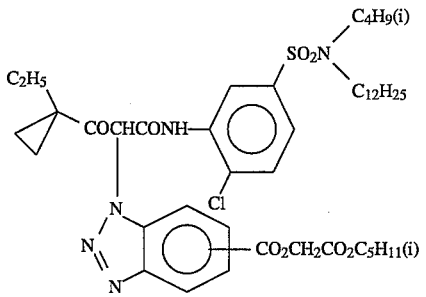
(Y-27)
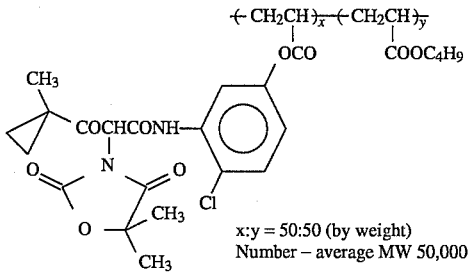
(Y-28)
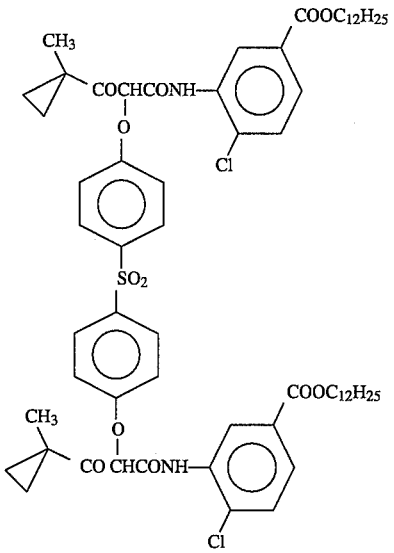

-continued
(Y-29)
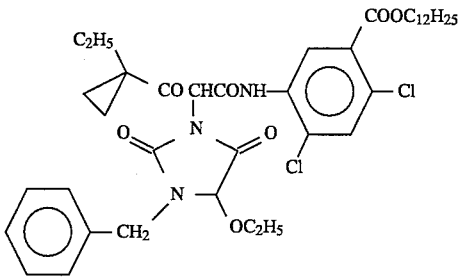
(Y-30)
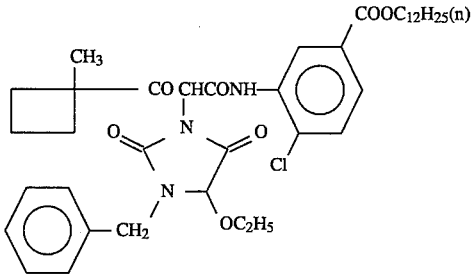
(Y-31)
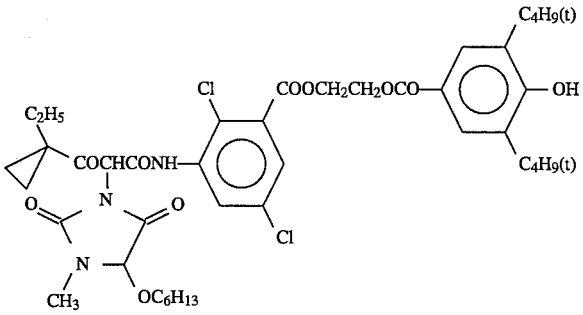
(Y-32)
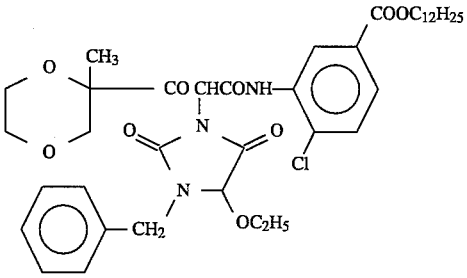
(Y-33)
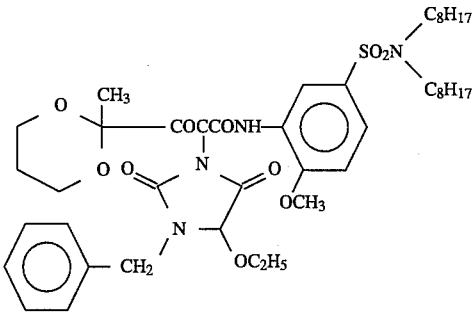

-continued
(Y-34)
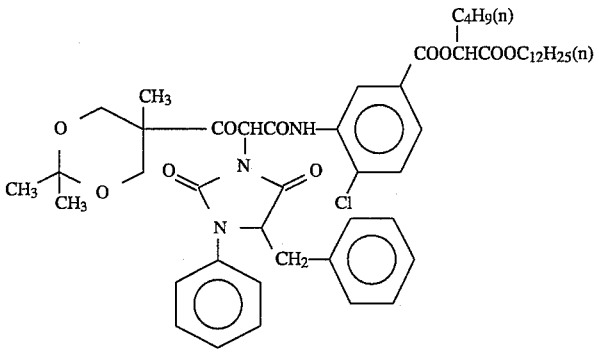
(Y-35)
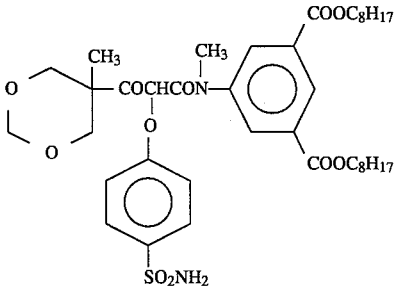
(Y-36)
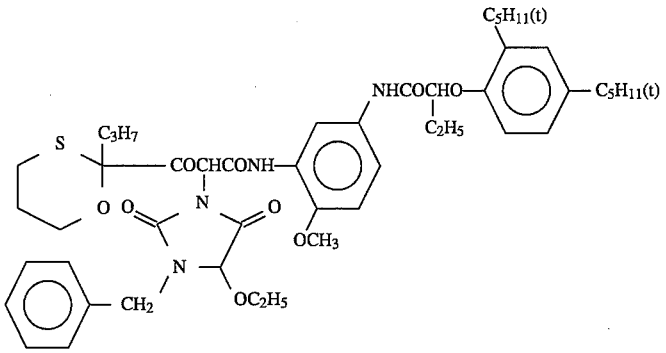
(Y-37)
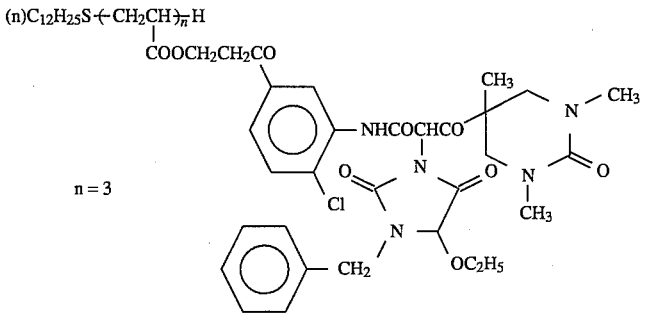
n = 3

-continued
(Y-38)
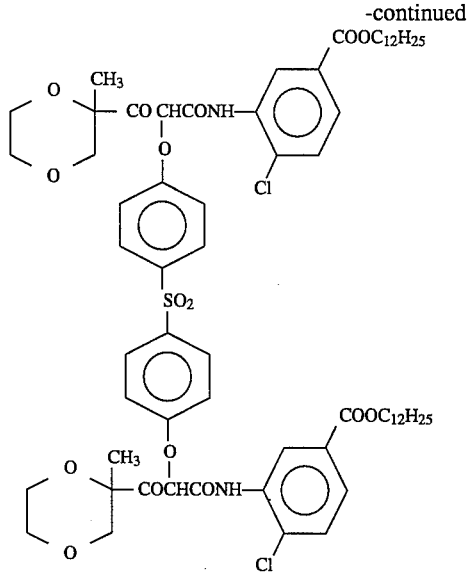
(Y-39)
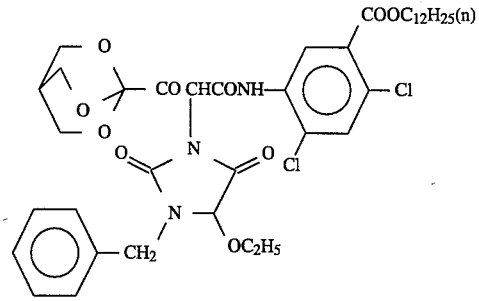
(Y-40)
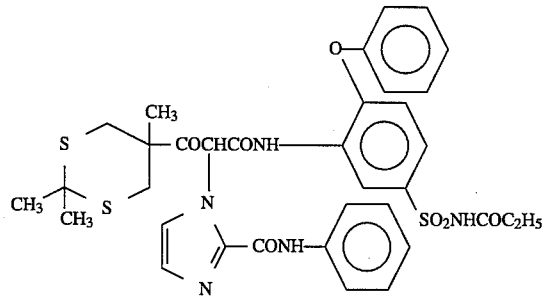
(Y-41)
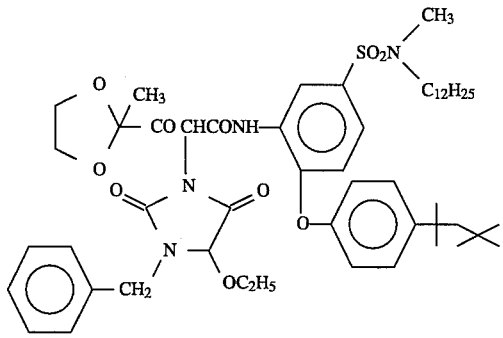

-continued
(Y-42)
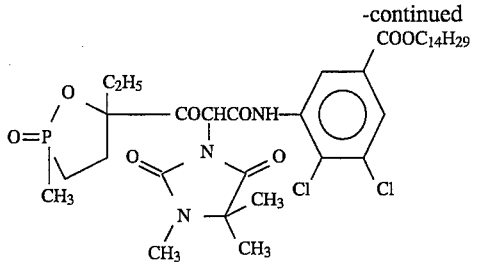
(Y-43)
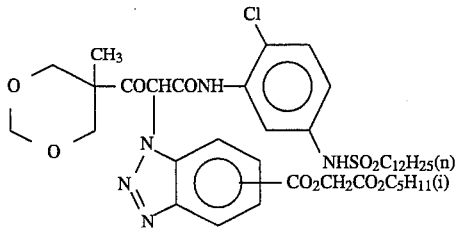
(Y-44)
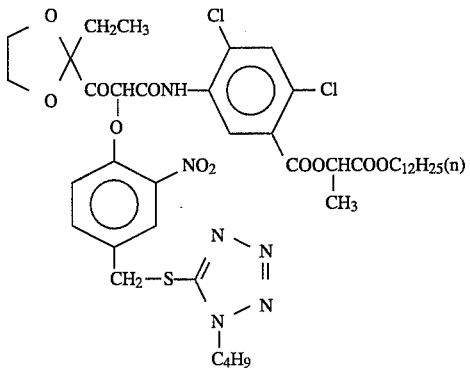
(Y-45)
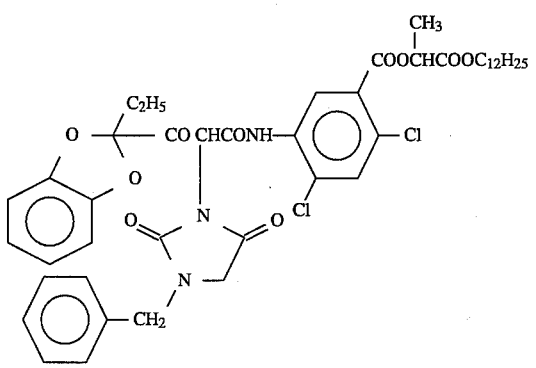
(Y-46)
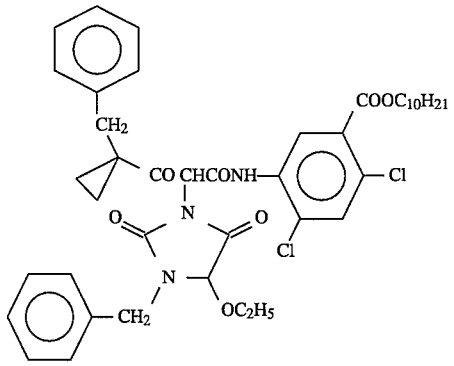
The yellow couplers of general formula (YII) can be synthesized by conventional synthesis methods, for example, the method described in EP-A-447969 and U.S. Pat. No. 5,118,599.

The couplers of general formula (YII) can be used in any layer of the photographic materials. Namely, the couplers can be used in any of the light-sensitive layers (blue-sensitive emulsion layer, green-sensitive emulsion layer, red-sensitive emulsion layer) and the non-sensitive layers (e.g., protective layer, yellow filter layer, interlayer, antihalation layer). However, it is particularly preferred that the couplers are used in a blue-sensitive emulsion layer or a non-light-sensitive layer adjacent thereto.

The couplers of general formula (YII) are used in an amount of preferably 0.05 to 5.0 mmol/$m^2$, more preferably 0.1 to 2.0 mmol/$m^2$.

When the couplers of general formula (YII) are used in the light-sensitive layers, the couplers and silver halide are used in a ratio by mol of the coupler: silver halide of from 1:0.1 to 1:200, preferably from 1:2 to 1:150. When the couplers are used in the non-light-sensitive layers, the couplers and silver halide contained in the silver halide emulsion layer adjacent to the non-light-sensitive layer are used in a ratio by mol of the coupler: silver halide of preferably from 1:2 to 1:200.

The couplers of general formula (YII) may be used alone or in combination with other yellow couplers (e.g., benzoylacetanilide yellow couplers, pivaloylacetanilide yellow couplers).

The couplers of general formula (YII) used in the present invention have high color developability and excellent dye image fastness, and particularly the couplers have excellent spectral absorption characteristics wherein spectral absorption in the long wavelength side (in the region of green light) is low, whereby excellent color reproducibility can be provided and further sharpness can be improved.

The couplers of general formula (YII) can be introduced into the photographic materials by oil-in-water dispersion methods using a fine emulsified dispersion in a high boiling organic solvent described hereinafter. Even when the amount of the high boiling organic solvent based on the amount of the coupler is reduced, the couplers have an excellent performance capable of displaying high color developability. Accordingly, the couplers can be preferably used in the blue-sensitive layers of the color photographic materials for photographing, which are farther away from the support (nearer incident light), whereby the layer thickness can be reduced, and the sharpness of the light-sensitive layers nearer the support can be advantageously affected.

The couplers of general formulas (1) and (2) are described in greater detail below.

The alkyl group represented by $X_1$ or $X_2$ is a straight chain, branched or cyclic, saturated or unsaturated, substituted or unsubstituted alkyl group having 1 to 30 carbon atoms, preferably 1 to 20 carbon atoms. Examples of the alkyl group include methyl, ethyl, propyl, butyl, cyclopropyl, allyl, t-octyl, i-butyl, dodecyl and 2-hexyldecyl.

The heterocyclic group represented by $X_1$ or $X_2$ is a three-membered to twelve-membered, preferably five-membered or six-membered saturated or unsaturated, substituted or unsubstituted monocyclic or fused ring type heterocyclic group having at least one hetero-atom, as a member of the ring, of a nitrogen atom, an oxygen atom and a sulfur atom and 1 to 20 carbon atoms, preferably 1 to 10 carbon atoms. Examples of the heterocyclic group include 3-pyrrolidinyl, 1,2,4-triazole-3-yl, 2-pyridyl, 4-pyrimidinyl, 3-pyrazolyl, 2-pyrrolyl, 2,4-dioxo-1,3-imidazolidine-5-yl and pyranyl.

The aryl group represented by $X_1$ or $X_2$ is a substituted or unsubstituted aryl group having 6 to 20 carbon atoms, preferably 6 to 10 carbon atoms. Typical examples of the aryl group include phenyl and naphthyl.

When $X_3$ forms a nitrogen containing heterocyclic group together with >N—, the heterocyclic group is a three-membered to twelve-membered, preferably five-membered or six-membered, substituted or unsubstituted, saturated or unsaturated monocyclic or fused ring type heterocyclic group having a nitrogen atom as a heteroatom and optionally other hetero-atoms such as an oxygen atom and a sulfur atom and having 1 to 20 carbon atoms, preferably 1 to 15 carbon atoms. Examples of the heterocyclic group include pyrrolidino, piperidino, morpholino, 1-piperazinyl, 1-indolinyl, 1,2,3,4 -tetrahydroquinoline-1-yl, 1-imidazolidinyl, 1-pyrazolyl, 1-pyrrolinyl, 1-pyrazolidinyl, 2,3-dihydro-1-indazoline, 2-isoindolinyl, 1-indolyl, 1-pyrrolyl, 4-thiazine—S,S-dioxo-4-yl and benzoxazine-4-yl.

When the alkyl group, the aryl group or the heterocyclic group represented by $X_1$ or $X_2$ or the nitrogen containing heterocyclic group formed by $X_3$ together with >N— is substituted, examples of the substituent groups include a halogen atom (e.g., fluorine, chlorine), an alkoxycarbonyl group (having 2 to 30 carbon atoms, preferably 2 to 20 carbon atoms, such as methoxycarbonyl, hexadecyloxycarbonyl), an acylamino group (having 2 to 30 carbon atoms, preferably 2 to 20 carbon atoms, such as acetamido, tetradecaneamido, 2-(2,4-di-t-amylphenoxy)butaneamido, benzamido), a sulfonamido group (having 1 to 30 carbon atoms, preferably 1 to 20 carbon atoms, such as methanesulfonamido, hexadecylsulfonamido, benzenesulfonamido), a carbamoyl group (having 1 to 30 carbon atoms, preferably 1 to 20 carbon atoms, such as N-butylcarbamoyl, N,N-diethylcarbamoyl), an N-sulfonylcarbamoyl group (having 1 to 30 carbon atoms, preferably 1 to 20 carbon atoms, such as N-mesylcarbamoyl, N-dodecylsulfonylcarbamoyl), a sulfamoyl group (having 0 to 30 carbon atoms, preferably 1 to 20 carbon atoms, such as N—butylsulfamoyl, N-hexadecylsulfamoyl, N-3-(2,4-di-t-amylphenoxy)butylsulfamoyl, N,N-diethylsulfamoyl), an alkoxy group (having 1 to 30 carbon atoms, preferably 1 to 20 carbon atoms, such as methoxy, hexadecyloxy, isopropoxy), an aryloxy group (having 6 to 20 carbon atoms, preferably 6 to 10 carbon atoms, such as phenoxy, 4-methoxyphenoxy, 3-t-butyl-4-hydroxyphenoxy, naphthoxy), an aryloxycarbonyl group (having 7 to 21 carbon atoms, preferably 7 to 11 carbon atoms, such as phenoxycarbonyl), an N-acylsulfamoyl group (having 2 to 30 carbon atoms, preferably 2 to 20 carbon atoms, such as N-propanoylsulfamoyl, N-tetradecanoylsulfamoyl), a sulfonyl group (having 1 to 30 carbon atoms, preferably 1 to 20 carbon atoms, such as methanesulfonyl, 4-hydroxyphenylsulfonyl, dodecanesulfonyl), an alkoxycarbonylamino group (having 2 to 30 carbon atoms, preferably ethoxycarbonylamino), a cyano group, a nitro group, a carboxyl group, a hydroxyl group, a sulfo group, an alkylthio group (having 1 to 30 carbon atoms, preferably 1 to 20 carbon atoms, such as methylthio, dodecylthio, dodecylcarbamoylmethylthio), a ureido group (having 1 to 30 carbon atoms, preferably 1 to 20 carbon atoms, such as N-phenylureido, N-hexadecylureido), an aryl group (having 6 to 20 carbon atoms, preferably 6 to 10 carbon atoms, such as phenyl, naphthyl, 4-methoxyphenyl), a heterocyclic group (e.g., a three-membered to twelve-membered preferably five-membered or six-membered monocyclic or fused ring type heterocyclic group having at least one hetero-atom of nitrogen atom, oxygen atom and sulfur atom and having 1 to 20 carbon atoms, preferably 1 to 10 carbon atoms, such as 2-pyridyl, 3-pyrazolyl, 1-pyrrolyl, 2,4-dioxo-1,3-imidazolidine-1-yl, 2-benzoxazolyl, morpholino, indolyl), an alkyl group (e.g., a straight chain, branched or cyclic saturated or unsaturated alkyl group having 1 to 30 carbon atoms, preferably 1 to 20 carbon atoms, such as methyl, isopropyl, cyclopropyl, t-octyl, cyclopentyl, s-butyl, 2-hexyldecyl), an acyl group (having 2 to 30 carbon atoms, preferably 2 to 20 carbon atoms, such as acetyl, benzoyl), an acyloxy group (having 2 to 30 carbon atoms, preferably 2 to 20 carbon atoms, such as propanoyloxy, tetradecanoyloxy), an arylthio group (having 6 to 20 carbon atoms, preferably 6 to 10 carbon atoms, such as phenylthio, naphthylthio), a sulfamoylamino group (having 0 to 30 carbon atoms, preferably 0 to 20 carbon atoms, such as N-butylsulfamoylamino, N-dodecylsulfamoylamino, N-phenylsulfamoylamino) and an N-sulfonylsulfamoyl group (having 1 to 30 carbon atoms, preferably 1 to 20 carbon atoms, such as N-mesylsulfamoyl, N-ethanesulfonylsulfamoyl, N-dodecanesulfonylsulfamoyl, N-hexadecanesulfonylsulfamoyl). These substituent groups may be further substituted. Examples of these further substituent groups include those already described above.

Of these substituent groups, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group and an aryl group are preferred.

The aryl group represented by Y in general formulas (1) and (2) is a substituted or unsubstituted aryl group having 6 to 20 carbon atoms, preferably 6 to 10 carbon atoms. Typical examples of the aryl group include phenyl and naphthyl.

The heterocyclic group represented by Y in general formulas (1) and (2) has the same meaning as that represented by $X_1$ or $X_2$ described above.

When Y is a substituted aryl group or a substituted heterocyclic group, examples of the substituent groups include those already described above in the definition of the substituent groups for $X_1$ or $X_2$. When Y is substituted, preferred examples of the substituent are a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

Particularly preferably, Y is a phenyl group having at least one substituent group at the orthoposition.

The group represented by Z in general formulas (1) and (2) may be any of the conventional groups which can be eliminated by coupling (coupling eliminable groups). Preferably, Z is a nitrogen containing heterocyclic group which is bonded to the coupling site through a nitrogen atom, an aryloxy group, an arylthio group, a heterocyclic oxy group, a heterocyclic thio group, an acyloxy group, a carbamoyloxy group, an alkylthio group or a halogen atom.

The eliminable groups represented by Z may be any of non-photographically useful groups, photographically useful groups and precursors thereof (e.g., development restrainer, development accelerator, desilverization accelerator, fogging agent, dye, hardening agent, coupler, scavenger for the oxidant of the developing agent, fluorescent dye, developing agent, electron transfer agent).

When Z is a photographically useful group, conventional groups are useful. Examples of the photographically useful groups represented by Z include photographically useful groups and eliminable groups which release a photographically useful group (e.g., timing group) described in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994 and EP-A-193389, EP-A-348139 and EP-A-272573.

When Z is a nitrogen containing heterocyclic group which is bonded to the coupling site through the nitrogen atom, the nitrogen containing heterocyclic group is preferably a five-membered or six-membered substituted or unsubstituted, saturated or unsaturated monocyclic or fused ring type heterocyclic group having 1 to 15 carbon atoms, preferably 1 to 10 carbon atoms. The heterocyclic group may have other hetero-atom such as an oxygen atom or a sulfur atom in addition to nitrogen atom. Preferred examples of the heterocyclic group include 1-pyrazolyl, 1-imidazolyl, pyrrolino, 1,2,4-triazole-2-yl, 1,2,3-triazole-1-yl, benztriazolyl, benzimidazolyl, imidazolidine-2,4-dione-3-yl, oxazolidine-2,4-dione-3-yl, 1,2,4-triazolidine-3,5-dione-4-yl, imidazolidine-2,4,5-trione-3-yl, 2-imidazolinone-1-yl, 3,5-dioxomorpholino and 1-imidazoline. When the heterocyclic group is substituted, examples of the substituent groups include those already described above in the definition of the substituent groups for $X_1$ or $X_2$. When Z is substituted, the case where at least one of the substituent group is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, a cyano group or a sulfonyl group are preferred.

The aryloxy group represented by Z is preferably a substituted or unsubstituted aryloxy group having 6 to 10 carbon atoms, particularly preferably a substituted or unsubstituted phenoxy group. Examples of the substituent groups include those already described above in the definition of the substituent groups for $X_1$ or $X_2$. The case where at least one substituent group is an electron attractive group is preferred. Examples of the electron attractive group include a sulfonyl group, an alkoxycarbonyl group, a sulfamoyl group, a halogen atom, a carbamoyl group, a nitro group, a cyano group and an acyl group.

The alkylthio group represented by Z is preferably a substituted or unsubstituted arylthio group having 6 to 10 carbon atoms, particularly preferably a substituted or unsubstituted phenylthio group. Examples of the substituent groups include those already described above in the definition of the substituent groups for $X_1$ or $X_2$. The case where at least one substituent group is an alkyl group, an alkoxy group, a sulfonyl group, an alkoxycarbonyl group, a sulfamoyl group, a halogen atom, a carbamoyl group or a nitro group is preferred.

The heterocyclic oxy group represented by Z has a heterocyclic group moiety which is a three-membered to twelve-membered, preferably five-membered or six-membered, substituted or unsubstituted, saturated or unsaturated monocyclic or fused ring type heterocyclic ring having at least one hetero-atom of a nitrogen atom, an oxygen atom and a sulfur atom and having 1 to 20 carbon atoms, preferably 1 to 10 carbon atoms. Examples of the heterocyclic oxy group include pyridyloxy, pyrazolyloxy and furyloxy. Examples of the substituent groups include those already described above in the definition of the substituent groups for $X_1$ or $X_2$. The case where at least one substituent group is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group and a sulfonyl group is preferred.

The heterocyclic thio group represented by Z has a heterocyclic moiety which is a three-membered to twelve-membered, preferably five-membered or six-membered, substituted or unsubstituted, saturated or unsaturated monocyclic or fused ring type heterocyclic ring having at least one hetero-atom of a nitrogen atom, an oxygen atom and a sulfur atom and having 1 to 20 carbon atoms, preferably 1 to 10 carbon atoms. Examples of the heterocyclic thio group include tetrazolylthio, 1,3,4-thiadiazolylthio, 1,3,4-oxadiazolylthio, 1,3,4-triazolylthio, benzimidazolylthio, benzthiazolylthio and 2-pyridylthio. When the heterocyclic thio group is substituted, examples of the substituent groups include those already described above in the definition of the substituent groups for $X_1$ or $X_2$. The case where at least one substituent group is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group and a sulfonyl group is preferred.

The acyloxy groups represented by Z preferably include a substituted or unsubstituted monocyclic or fused ring type arylacyloxy group having preferably 6 to 10 carbon atoms and a substituted or unsubstituted alkylacyloxy group having 2 to 30 carbon atoms, preferably 2 to 20 carbon atoms. When the acyloxy group is substituted, examples of the substituent groups include those described above in the definition of the substituent groups for $X_1$ or $X_2$.

The carbamoyloxy group represented by Z is a substituted or unsubstituted alkyl-, aryl- or heterocyclic carbamoyloxy group. Examples of the carbamoyloxy group include N-diethylcarbamoyloxy, N-phenylcarbamoyloxy, 1-imidazolylcarbamoyloxy and 1-pyrrolocarbamoyloxy. When the carbamoyloxy group is substituted, examples of the substituent groups include those already described above in the definition of the substituent groups for $X_1$ or $X_2$.

The alkyl thio group represented by Z is a straight chain, branched or cyclic, saturated or unsaturated, substituted or unsubstituted alkylthio group having 1 to 30 carbon atoms, preferably 1 to 20 carbon atoms. When the alkylthio group is substituted, examples of the substituent groups include those already described above in the definition of the substituent groups for $X_1$ or $X_2$.

Preferred embodiments of the couplers of general formulas (1) and (2) are described below.

The group represented by $X_1$ or $X_2$ in general formula (1) is preferably an alkyl group, particularly preferably an alkyl group having 1 to 10 carbon atoms.

The group represented by Y in general formulas (1) and (2) is preferably an aryl group, particularly preferably a phenyl group having at least one substituent group at the ortho-position. Examples of the substituent groups are those described above in the definition of the substituent groups for the aryl group represented by Y, and preferred examples of the substituent groups are the same as described above.

The group represented by Z in general formulas (1) and (2) is preferably a five-membered or six-membered nitrogen containing heterocyclic group which is bonded to the coupling site through a nitrogen atom, an aryloxy group, a five-membered or six-membered heterocyclic oxy group or a five-membered to six-membered heterocyclic thio group.

Among the couplers of general formula (1) or (2), couplers represented by the following general formula (3), (4) or (5) are preferred.

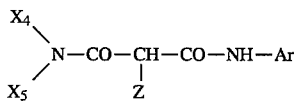

(3)

-continued

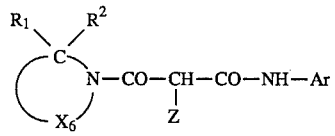

(4)

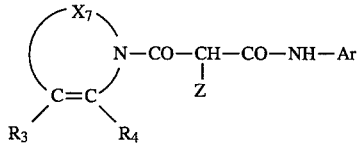

(5)

wherein Z is as defined above in general formula (1); $X_4$ represents an alkyl group; $X_5$ represents an alkyl group or an aryl group; Ar represents a phenyl group having at least one substituent group at the ortho-position; $X_6$ represents an organic group required for forming a nitrogen containing heterocyclic group (monocyclic or fused ring) together with —C($R_1R_2$)—N<; $X_7$ represents an organic group required for forming a nitrogen containing heterocyclic group (monocyclic or fused ring) together with —C($R_3$)=C($R_4$)—N<; and $R_1$, $R_2$, $R_3$ and $R_4$ each represents a hydrogen atom or a substituent group.

The details and preferred embodiments of the groups represented by $X_4$ and $X_5$; $X_6$ and $X_7$; and Z in general formulas (3) to (5) has the same meaning as $X_1$ and $X_2$; $X_3$; and Z in general formulas (1) and (2), respectively. When the groups of $R_1$ to $R_4$represent substituent groups, examples of the substituent groups include those already described above in the definition of the substituent groups for $X_1$ or $X_2$.

Of the couplers, the couplers of general formula (4) or (5) are particularly preferred.

The couplers of general formulas (1) to (5) may be in the form of a dimer or a higher polymer (telomer or polymer) where two or more members are bonded to each other through a bis compound or a bivalent or polyvalent group at the position of Y, $X_1$ to $X_7$, Ar, $R_1$ to $R_4$ or Z. In this case, the number of carbon atoms of each substituent group may be outside the range described above.

It is preferred that the couplers of general formulas (1) to (5) are nondiffusing couplers. The term "nondiffusing coupler" as used herein refers to a coupler which contains a group capable of sufficiently increasing its molecular weight (nondiffusing group) is introduced to thereby immobilize the coupler in the layer to which the coupler is added. Usually, an alkyl group having 8 to 30 carbon atoms, preferably 10 to 20 carbon atoms, in total or an aryl group having a substituent group having 4 to 20 carbon atoms in total is used as the nondiffusing group. The nondiffusing group may be introduced into any position of the molecule, and two or more nondiffusing groups may be introduced into the molecule.

Specific examples of the couplers of general formulas (1) to (5) (the yellow couplers) include, but are not limited to, the following compounds.

(YB-1)
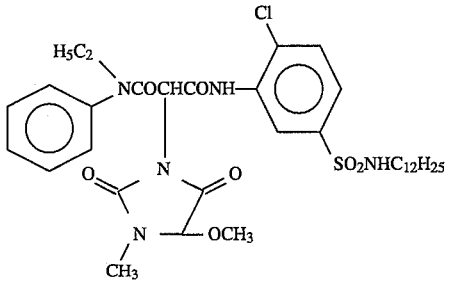
(YB-2)
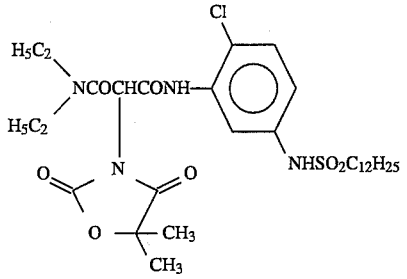
(YB-3)
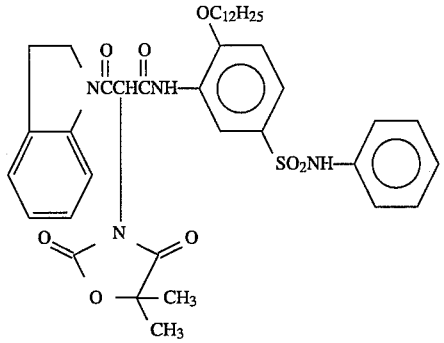
(YB-4)
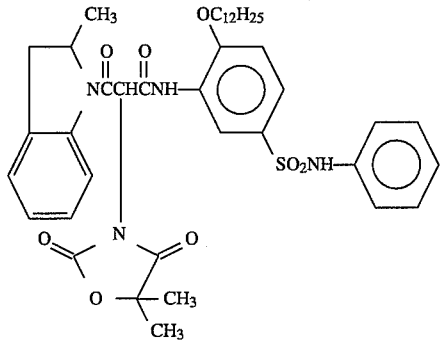
(YB-5)
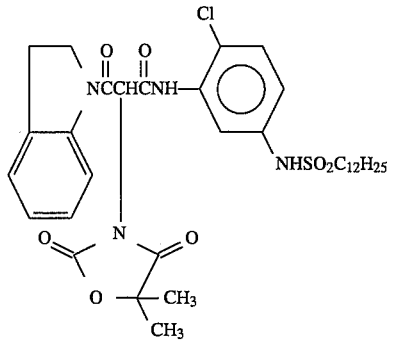

-continued
(YB-6)
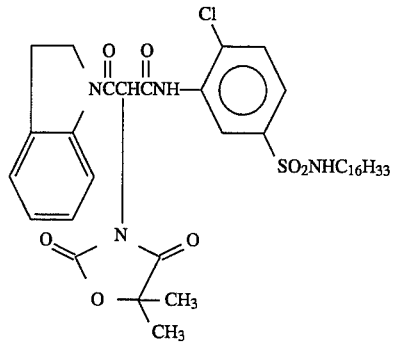
(YB-7)
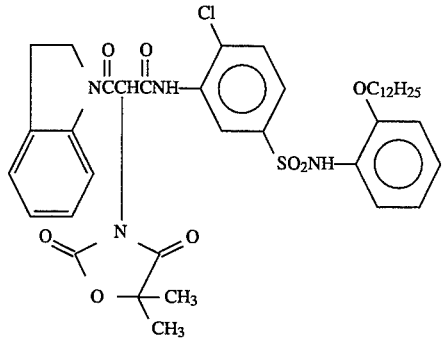
(YB-8)
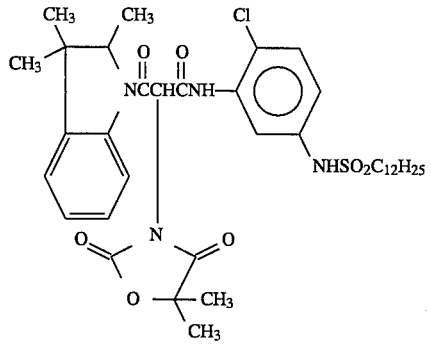
(YB-9)
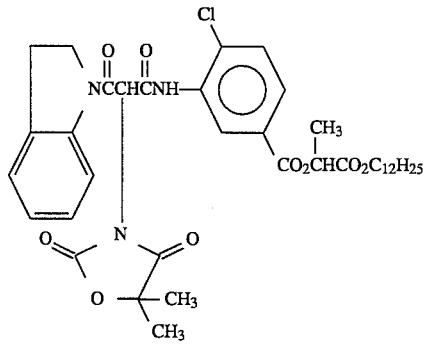

-continued
(YB-10)
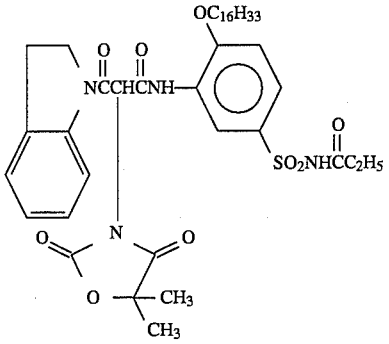
(YB-11)
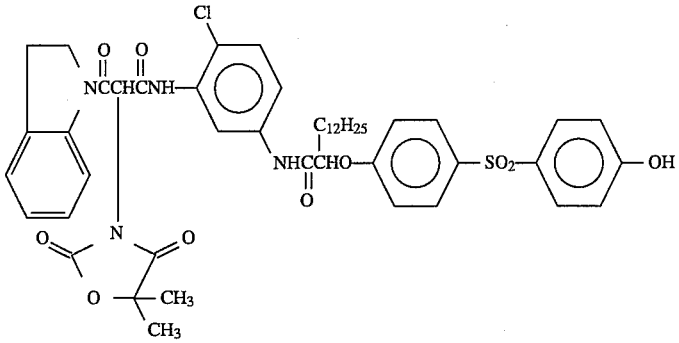
(YB-12)
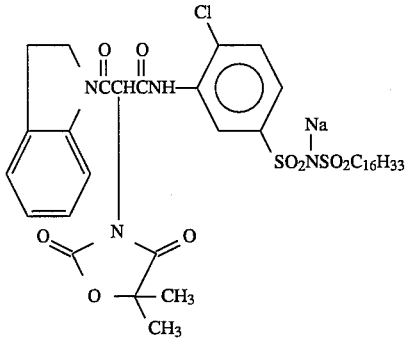
(YB-13)
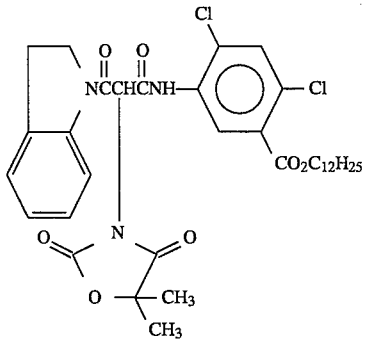

-continued
(YB-14)
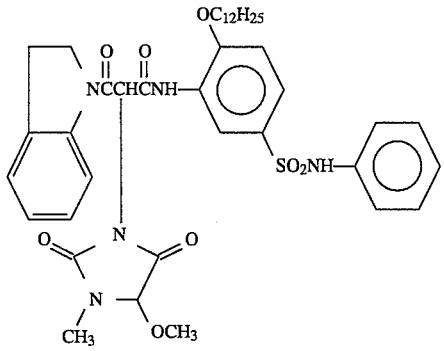
(YB-15)
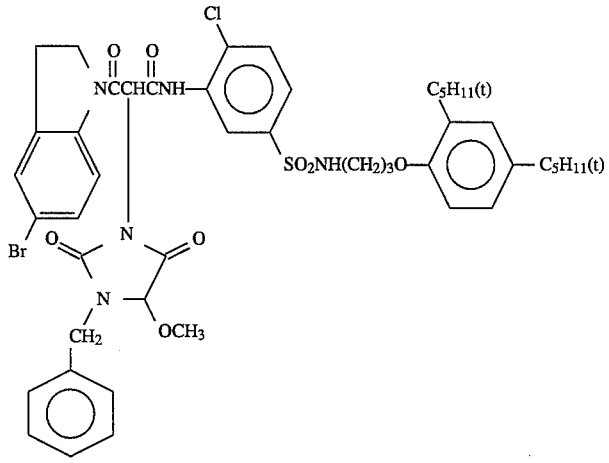
(YB-16)
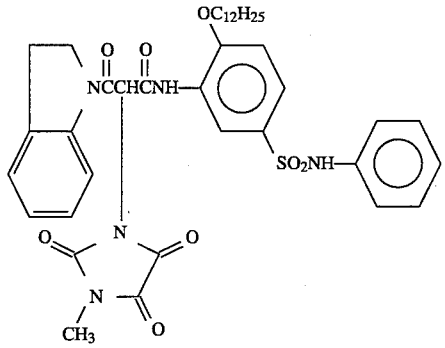
(YB-17)
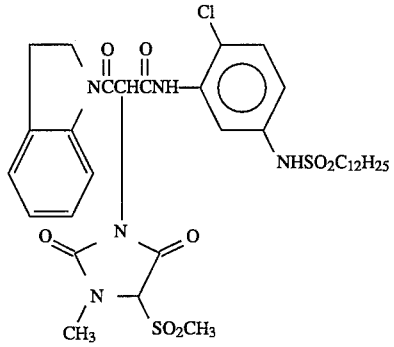

-continued
(YB-18)
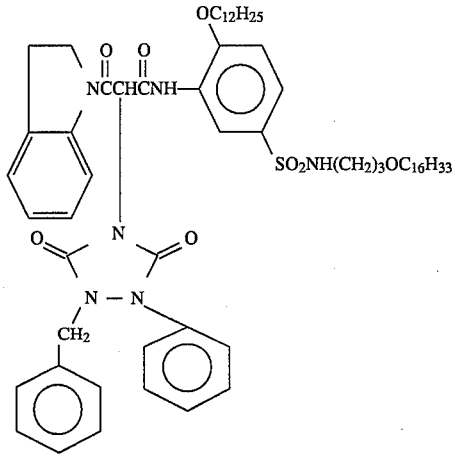
(YB-19)
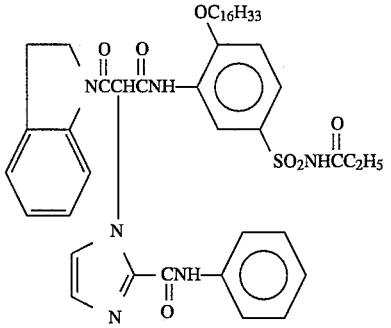
(YB-20)
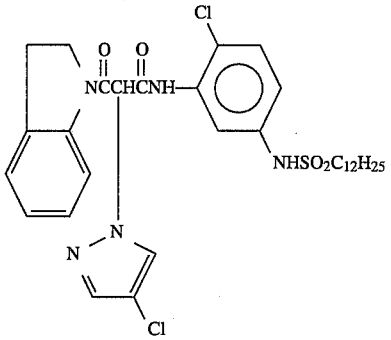
(YB-21)
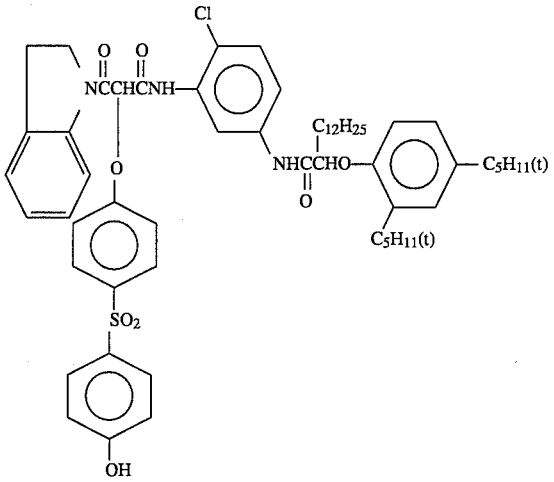

-continued
(YB-22)
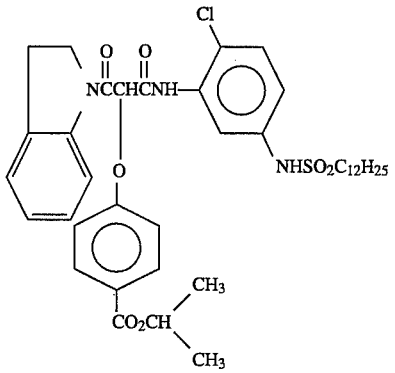
(YB-23)
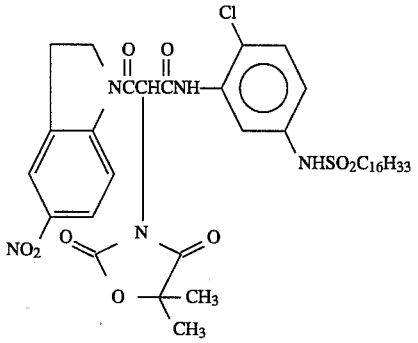
(YB-24)
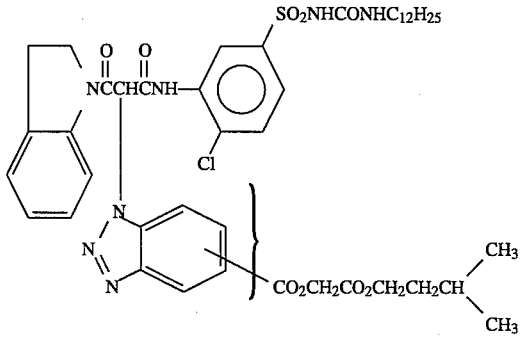
(YB-25)
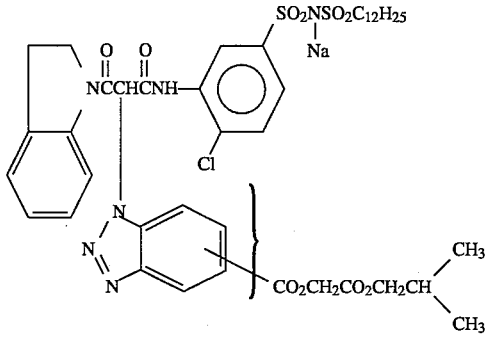

-continued
(YB-26)
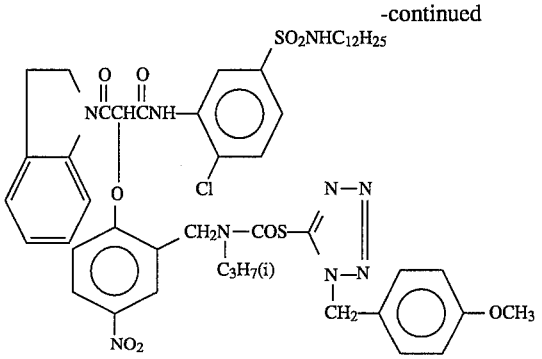
(YB-27)
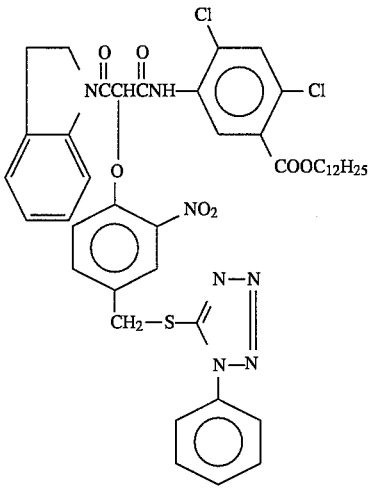
(YB-28)
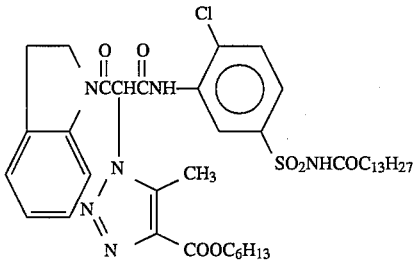
(YB-29)
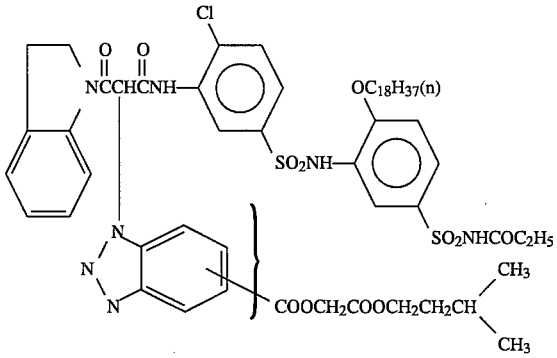

-continued (YB-30)

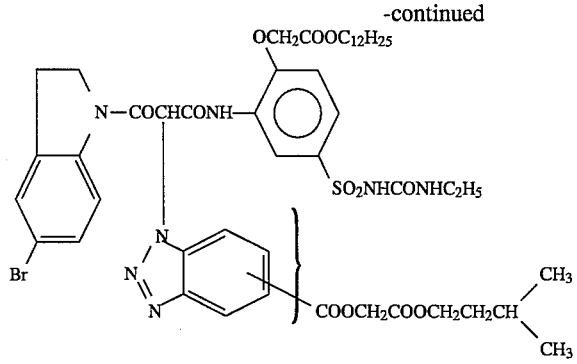

(YB-31)

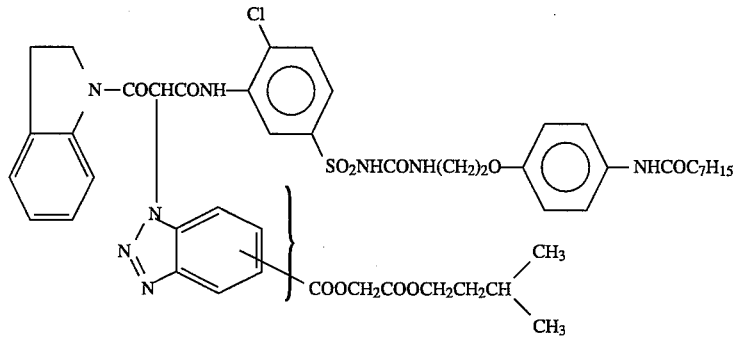

(YB-32)

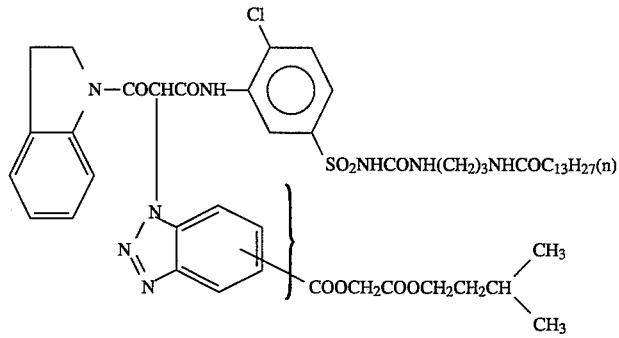

(YB-33)

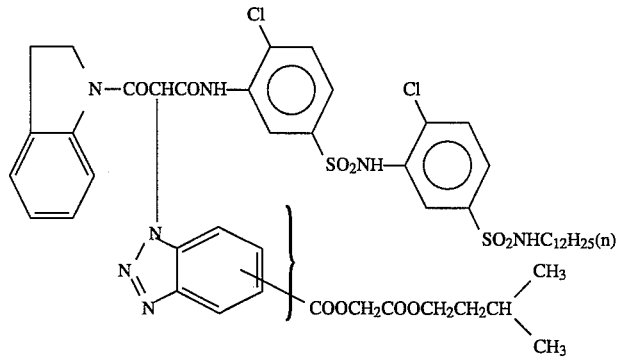

The mark "}" in compounds (YB-24), (YB-25), (YB-29), (YB-30), (YB-31), (YB-32), (YB-33) indicates that the substituent group is attached to the position-5 or 6 of benztriazolyl group.

The yellow couplers of general formulas (1) to (5) used in the present invention can be synthesized by referring to the methods described in European Patents 447,920A corresponding to U.S. Pat. No. 5,194,369 and 482,552A corresponding to U.S. Pat. No. 5,213,958.

The yellow couplers of general formulas (1) to (5) are used in an amount of 1.0 to $1.0\times10^{-3}$ mol, preferably $5.0\times10^{-1}$ to $2.0\times10^{-2}$ mol, more preferably $4.0\times10^{-1}$ to $5.0\times10^{-2}$ mol, per mol of light-sensitive silver halide coated in the photographic material.

It is preferred that the couplers of general formulas (1) to (5) are added to the blue-sensitive silver halide emulsion layer or a non-light-sensitive layer adjacent thereto when the yellow couplers are used as the principal couplers. When the couplers of general formulas (1) to (5) are couplers which release a photographically useful group, they are added to the light-sensitive silver halide emulsion layers or the non-light-sensitive layers according to the intended purpose.

The yellow couplers of general formulas (1) to (5) may be used in combinations of two or more thereof or together with conventional couplers.

The couplers of general formulas (1) to (5) can be introduced into the color photographic materials by various conventional dispersion methods.

In the oil-in-water dispersion method which is such a conventional dispersion method, a low-boiling organic solvent (e.g., ethyl acetate, butyl acetate, methyl ethyl ketone, isopropanol) is used, and a fine dispersion is coated so that the low-boiling organic solvent is substantially not left behind in the dry layers. When a high-boiling organic solvent is used, any solvent having a boiling point of not lower than 175° C. may be used, and two or more thereof in combination may be used. The ratio of the couplers of general formulas (1) to (5) to the high-boiling organic solvent can be widely varied, but the ratio of the coupler to the solvent is usually 1:5.0 or below, preferably 1:0 to 2.0, more preferably 1:0.01 to 1.0, by weight.

Latex dispersion methods described hereinafter can be used in the present invention.

Further, the couplers can be used together with various couplers and compounds described hereinafter.

It is preferred that the acylacetamide type couplers having acyl group of general formula (YI) and/or the couplers of general formula (1) or (2) are used together with compounds represented by the following general formula (B).

$$A—(L_1)_k—Z \qquad (B)$$

wherein A represents a group which reacts with an oxidant of a developing agent to release $(L_1)_k$—Z by cleavage; $L_1$ represents a group which releases Z by cleavage between $L_1$ and Z after cleavage between A and $L_1$; k represents 0 or 1; and Z represents a residue of a mercapto compound.

The compounds of general formula (B) are described in greater detail below.

More specifically, A in general formula (B) is a residue of a coupler (a coupler residue) or a redox group.

Examples of the residue of the coupler represented by A include the residues of yellow couplers (e.g., the residue of open chain keto-methylene type couplers such as malondianilide type couplers, acylacetanilide type couplers), the residues of magenta couplers (e.g., the residues of 5-pyrazolone couplers, pyrazolotriazole couplers, imidazopyrazole couplers), the residues of cyan couplers (e.g., the residues of phenol couplers, naphthol couplers, imidazole couplers described in EP-A-249453 and pyrazolopyrimidine couplers described in EP-A-304001) and the residues of non-color forming couplers (e.g., the residues of indanone type couplers and acetophenone type couplers ). Further, A may be a residue of the heterocyclic ring type couplers described in U.S. Pat. Nos. 4,315,070, 4,183,752, 4,174,969, 3,961,959 and 4,171,223 and JP-A-52-82423.

The redox group represented by A refers to a group which is cross-oxidized by oxidants of developing agents. Examples thereof include hydroquinones, catechols, pyrogallols, 1,4-naphthohydroquinones, 1,2-naphthohydroquinones, sulfonamidophenols, hydrazides and sulfonamidonaphthols. Specific examples of the group include those described in JP-A-61-230135, JP-A-62-251746, JP-A-61-278852, U.S. Pat. Nos. 3,364,022, 3,379,529, 3,639,417 and 4,684,604 and *J. Org. Chem.*, 29, 585 (1984).

Preferred examples of $L_1$ in general formula (B) include the following groups.

(1) Groups which utilize the cleavage reaction of hemiacetal

Examples of these groups include groups of the following general formula (T-1) described in U.S. Pat. Nos. 4,146,396, JP-A-60-249148 and JP-A-60-249149 wherein the mark * represents the position where the group is attached to A in general formula (B), and the mark ** represents the position where the group is attached to Z.

$$*—(W—CR_{11}(R_{12}))_t—** \qquad (T\text{-}1)$$

wherein W represents an oxygen atom, a sulfur atom or —$NR_{13}$—; $R_{11}$ and $R_{12}$ each represents a hydrogen atom or a substituent group; $R_{13}$ represents a substituent group; and t represents 1 or 2 and when t is 2, the two —W—$CR_{11}(R_{12})$ groups may be the same or different. Typical examples of the substituent groups represented by $R_{11}$, $R_{12}$ and $R_{13}$ include $R_{15}$, $R_{15}CO$—, $R_{15}SO_2$—, $R_{15}(R_{16})NCO$— and $R_{15}(R_{16})NSO_2$— wherein $R_{15}$ represents an aliphatic group, an aromatic group or a heterocyclic group; and $R_{16}$ represents a hydrogen atom, an aliphatic group, an aromatic group or a heterocyclic group. The case where $R_{11}$, $R_{12}$ and $R_{13}$ are each a bivalent group and are bonded to each other to form a ring structure is included within the scope of the present invention. Specific examples of the group of general formula (T-1) include the following groups.

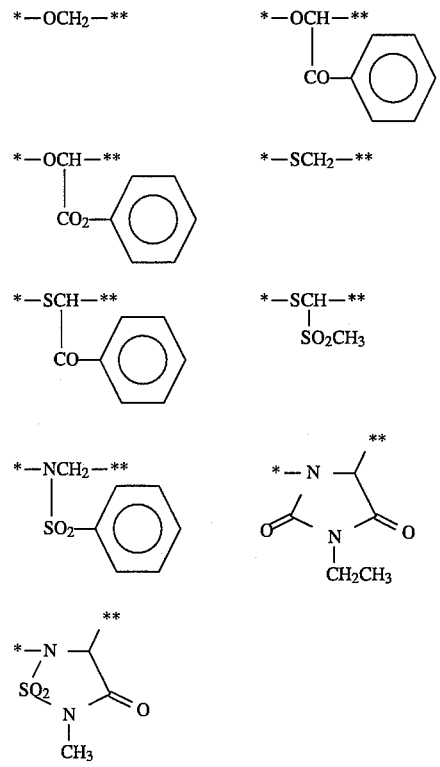

(2) Groups which cause a cleavage reaction by utilizing an intramolecular nucleophilic substitution reaction Examples of the groups include timing groups of the following general formula (T-2) described in U.S. Pat. No. 4,248,292.

$$*—Nu\text{-}Link\text{-}E—** \qquad (T\text{-}2)$$

wherein the marks * and  are as described above in general formula (T-1); Nu represents a nucleophilic group, and examples of nucleophilic species include an oxygen atom and a sulfur atom; E represents an electron attractive group and a group which is cleaved from  when nucleophilically attacked by Nu; and Link represents a group which sterically behaves so as to allow an intramolecular nucleophilic substitution reaction between Nu and E to take place. Specific examples of the group of general formula (T-2) include the following groups.

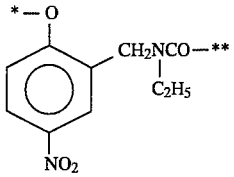

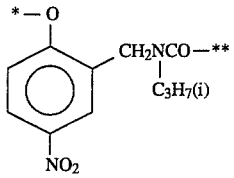

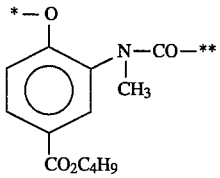

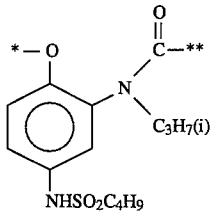

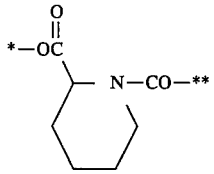

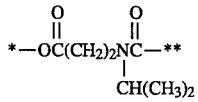

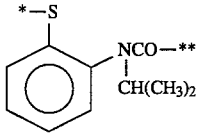

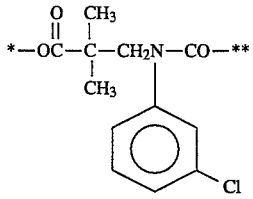

(3) Groups which cause a cleavage reaction by utilizing an electron transfer reaction along a conjugated moiety Examples of the groups are described in U.S. Pat. Nos. 4,409,323 and 4,421,845, JP-A-57-188035, JP-A-58-98728, JP-A-58-209736, JP-A-58-209737 and JP-A-58-209738. The group is represented by the following general formula (T-3).

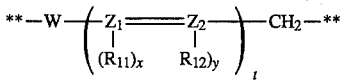

(T-3)

wherein the marks * and , W, $R_{11}$, $R_{12}$ and t are as defined above in general formula (T-1) provided that $R_{11}$ and $R_{12}$ may be combined together to form a benzene ring or a heterocyclic ring, or $R_{11}$ or $R_{12}$ and W may be combined together to form a benzene ring or a heterocyclic ring; $Z_1$ and $Z_2$ independently represent a carbon atom or a nitrogen atom; x and y each represents 0 or 1; when $Z_1$ is carbon atom, x is 1; when $Z_1$ is nitrogen atom, x is 0; the relationship between $Z_2$ and y is the same as that between $Z_1$ and x; and t represents 1 or 2 and when t is 2, the two —$[Z_1(R_{11})_x{=}Z_2(R_{12})_y]$— groups may be the same or different. Further, —$CH_2$— adjacent to  may be substituted by an alkyl group having 1 to 6 carbon atoms or a phenyl group.

Specific examples of the group of general formula (T-3) include the following groups.

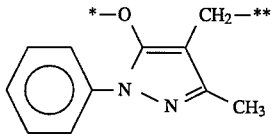

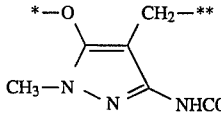

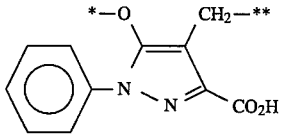

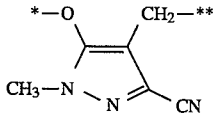

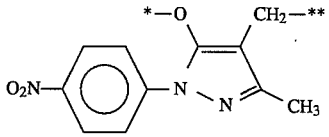

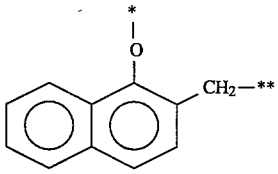

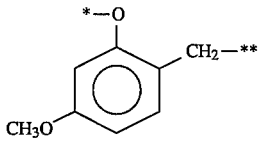

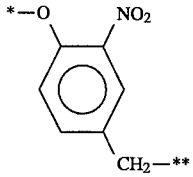

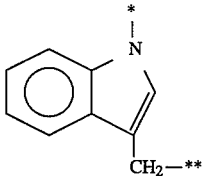

-continued

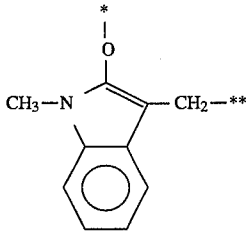

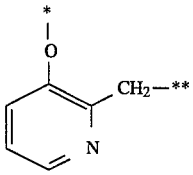

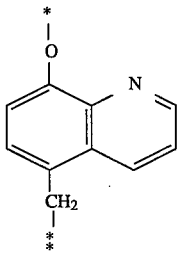

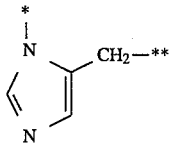

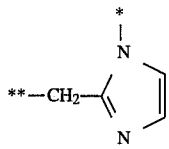

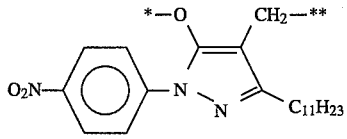

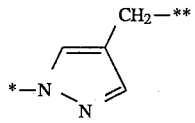

(4) Groups which utilize a cleavage reaction caused by the hydrolysis of ester

Examples of the groups include bonding groups of the following general formulas (T-4) and (T-5) described in West German Patent Laid-Open No. 2,626,315.

$$*\text{—OCO—}** \qquad \text{(T-4)}$$

$$*\text{—SCS—}** \qquad \text{(T-5)}$$

Wherein the marks * and ** are as defined above in general formula (T-1).

(5) Groups which utilize a cleavage reaction of iminoketal

Examples of the groups include bonding groups of the following general formula (T-6) described in U.S. Pat. No. 4,546,073.

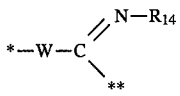

(T-6)

wherein the marks * and ** and W are as defined above in general formula (T-1); $R_{14}$ has the same meaning as $R_{13}$. Specific examples of the groups of general formula (T-6) include the following groups.

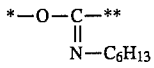

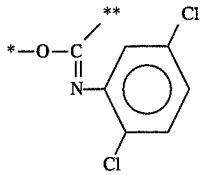

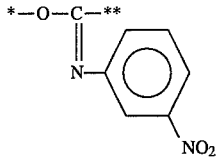

(6) Groups which become a residue of a coupler or a redox group after release from A.

Examples of the groups include groups represented by B in general formula (I) of JP-A-63-214752. More preferably, the group is a redox group.

In general formula (B), $L_1$ is preferably a group of general formula (T-1), (T-2), (T-3), (T-4) or (T-5), particularly preferably (T-1), (T-3) or (T-4).

Examples of the group represented by Z in general formula (B) include the residues of mercapto compounds described in U.S. Pat. No. 3,893,858, U.K. Patent 1,138,842 and JP-A-53-141623; the residues of compounds having a disulfide bond described in JP-A-53-95630; the residues of thiazolidine derivatives described in JP-B-53-9854; the residues of isothiourea derivatives described in JP-A-53-94927; the residues of thiourea derivatives described in JP-B-45-8506 and JP-B- 49-26586; the residues of thioamide compounds described in JP-A-49-42349; the residues of dithiocarbamates described in JP-A-55-26506; and the residues of arylenediamine compounds described in U.S. Pat. No. 4,552,834. It is preferred that the residues of these compounds are bonded to $A\text{—}(L_1)_k\text{—}$ in general formula (B) through a hetero-atom contained in the molecules of these residue compounds.

Preferably, Z is a group represented by the following general formula (V), (VI) or (VII).

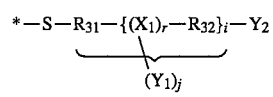

(V)

-continued $$*-S-X_2-\underbrace{\{(X_1)_r-R_{32}\}_i}_{(Y_1)_j}-Y_2 \quad \text{(VI)}$$

$$*-S-X_3-\underbrace{\{(X_1)_r-R_{32}\}_j}_{(Y_1)_k}-Y_2 \quad \text{(VII)}$$

wherein the mark * represents the position where the group is attached to $A-(L_1)_k-$; $R_{31}$ represents a bivalent aliphatic group having 1 to 8 carbon atoms, preferably 1 to 5 carbon atoms; $R_{32}$ represents a group of $R_{31}$, a bivalent aromatic group having 6 to 10 carbon atoms or a three-membered to eight-membered preferably five-membered or six-membered bivalent heterocyclic group; $X_1$ represents —O—, —S— —COO—, $-SO_2-$, $-NR_{33}-$, $-NR_{33}-CO-$, $-NR_{33}-SO_2-$, —S—CO—, —CO—, $-NR_{33}-COO-$, $-N=CR_{33}-$, $-NR_{33}CO-NR_{34}-$ or $-NR_{33}SO_2NR_{34}-$; $X_2$ represents an aromatic group having 6 to 10 carbon atoms; $X_3$ represents a three-membered to eight-membered preferably five-membered or six-membered heterocyclic group having at least one carbon atom, as a member of the ring, which is bonded to S; $Y_1$ represents a carboxyl group or a salt thereof, a sulfo group or a salt thereof, a hydroxyl group, a phosphonic acid group or a salt thereof, an amino group (which may be substituted by an aliphatic group having 1 to 4 carbon atoms), $-NHSO_2-R_{35}$ or $-SO_2NH-R_{35}$ (wherein examples of the salt include sodium salt, potassium salt and ammonium salt); $Y_2$ represents a group of $Y_1$ or a hydrogen atom; r represents 0 or 1; i represents an integer of 0 to 4; j represents an integer of 1 to 4; and k represents an integer of 0 to 4; one or more $Y_1$ groups in general formula (V) or (VI) are attached to $R_{31}-\{(X_1)_r-R_{32}\}_i$ or $X_2-\{((X_1)_r-R_{32}\}_i$ at a position or positions where $Y_1$ can be attached thereto; one or more $Y_1$ groups in general formula (VII) are attached to $X_3-\{(X_1)_r-R_{32}\}_i$ at a position or positions where Y1 can be attached thereto; when k or j is 2 or greater, the two or more $Y_1$ groups may be the same or different; when i is 2 or greater, the two or more $(X_1)_r-R_{32}$ groups may be the same or different; $R_{33}$, $R_{34}$ and $R_{35}$ each represents a hydrogen atom or an aliphatic group having 1 to 8 carbon atoms, preferably 1 to 5 carbon atoms. The aliphatic group represented by $R_{31}$ to $R_{35}$ may be a linear or cyclic, straight chain or branched, saturated or unsaturated, substituted or unsubstituted group. However, an unsubstituted group is preferred. Examples of substituent groups include a halogen atom, an alkoxy group (e.g., methoxy, ethoxy) and an alkylthio group (e.g., methylthio, ethylthio).

The aromatic group represented by $X_2$ and $R_{32}$ may be substituted. Examples of substituent groups include those already described above in the definition of the substituent groups for the aliphatic group.

The heterocyclic group represented by $X_3$ and $R_{32}$ is a saturated or unsaturated, substituted or unsubstituted heterocyclic group having at least one hetero-atom of an oxygen atom, a sulfur atom and a nitrogen atom. Examples of substituent groups include pyridine, imidazole, piperidine, oxirane, sulfolane, imidazolidine, thiazepine and pyrazole. Examples of substituent groups include those already described above in the definition of the substituent groups for the aliphatic group.

Specific examples of the groups of general formula (V) include the following groups.

$-SCH_2CH_2CO_2H$, $-SCH_2CO_2H$, $-SCH_2CH_2N(CH_3)_2$, $-SCH_2CH(OH)CH_2OH$, $-SCH_2CH_2NH_2$, $-SCH_2CH(NH_2)CO_2H$, $-S(CH_2)_2C(=O)CH_2OH$, $-SCH_2CH_2NHCOCH_3$, $-S(CH_2)_4CO_2H$, $-SCH(CH_3)CO_2H$, $-SCH_2CH_2OH$, $-SCH_2CONHCH_2CH_2OH$, $-SCH_2CONHCH_2CH_2OH$, $-SCH_2CONHCH_2CH(OH)CH-OH$, $-SCH_2CONHCH_2CH_2COOH$, $-SCH_2CH_2OCH_2CO_2H$, $-SCH_2COOCH_2CH_2OH$, $-SCH_2CH_2OCH_2CH_2OCH_2CH_2OH$,

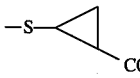

$-SCH_2CH(OH)-CH_3$, $-SCH_2CH_2SCH_2CO_2H$, $-SCH_2CH_2CH_2CO_2H$,

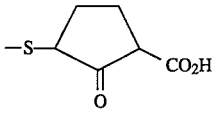

Specific examples of the groups of general formula (VI) include the following groups.

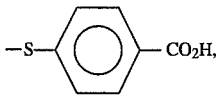

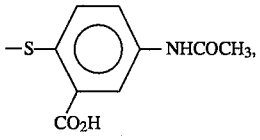

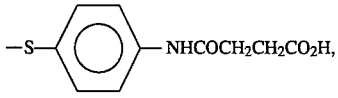

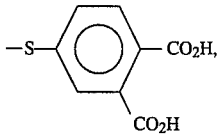

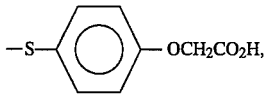

-continued
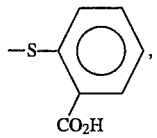
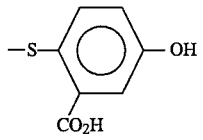
Specific examples of the groups of general formula (VII) include the following groups.
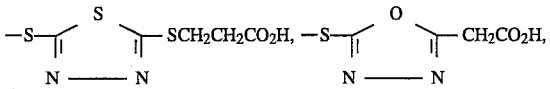
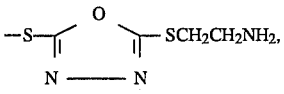
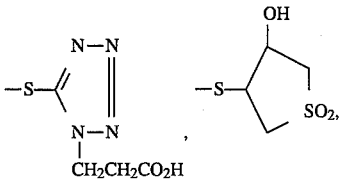
-continued
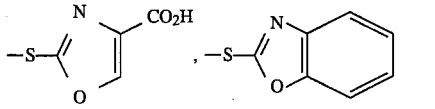
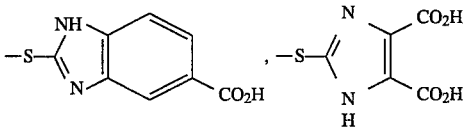
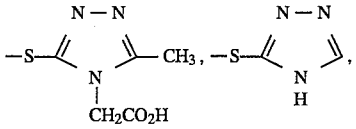
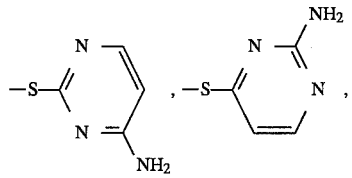
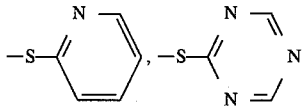
Specific examples of the compounds of general formula (B) which can be preferably used in the present invention include, but are not limited to, the following compounds.
(B-1)
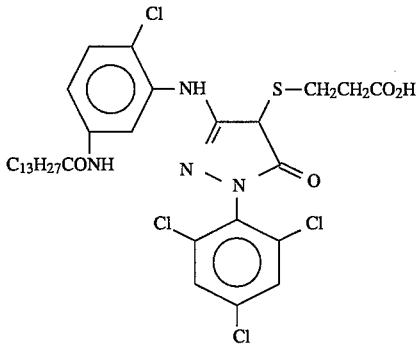
(B-2)
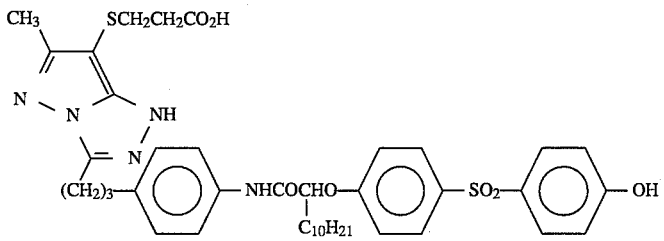

-continued
(B-3)
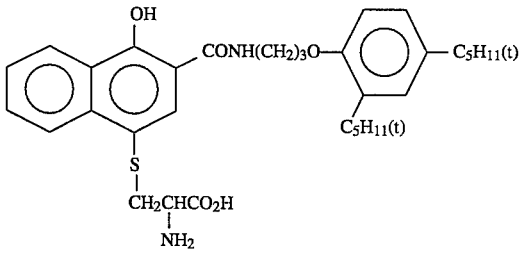
(B-4)
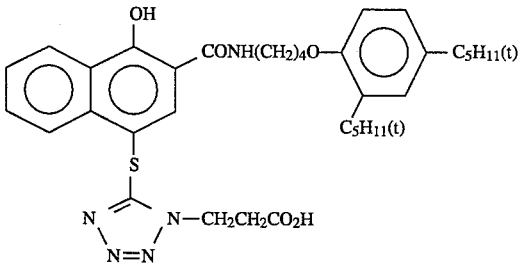
(B-5)
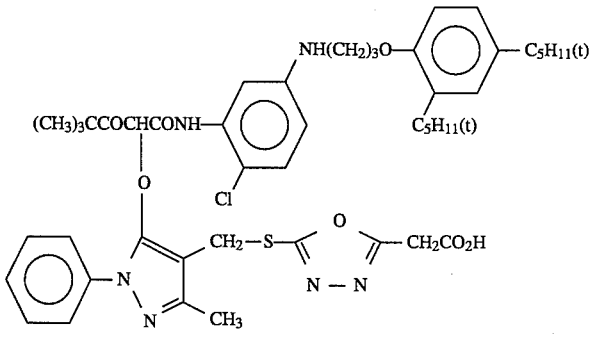
(B-6)
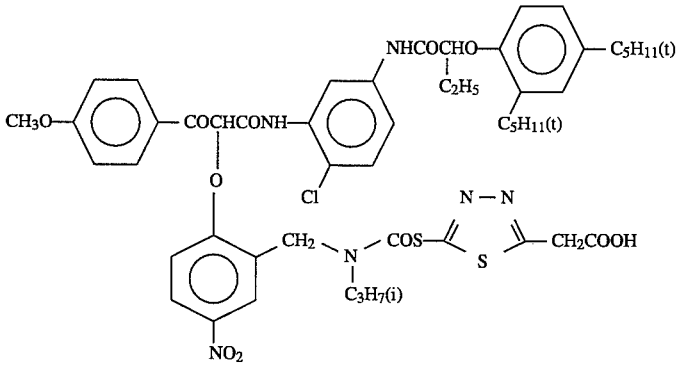
(B-7)
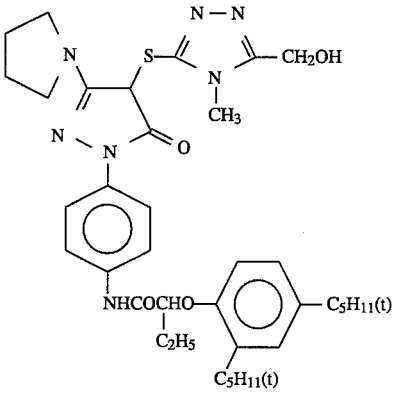

-continued
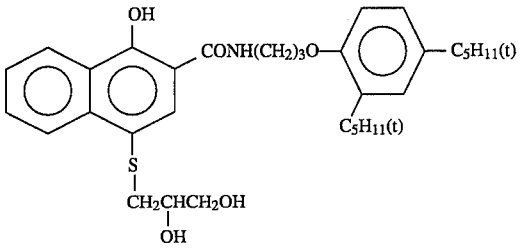
(B-8)
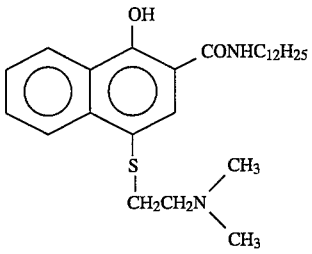
(B-9)
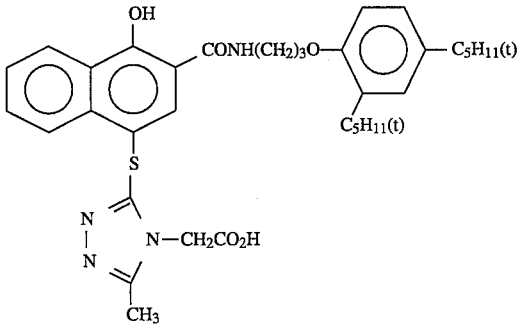
(B-10)
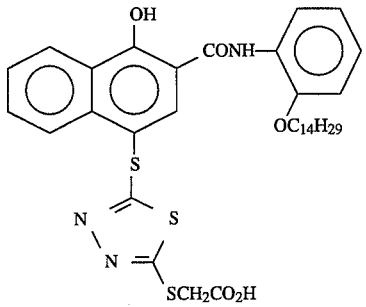
(B-11)
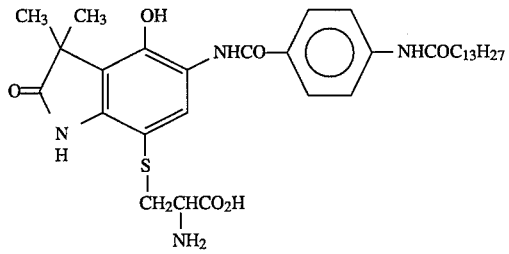
(B-12)

-continued
(B-13)
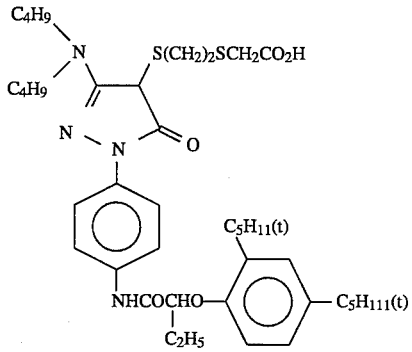
(B-14)
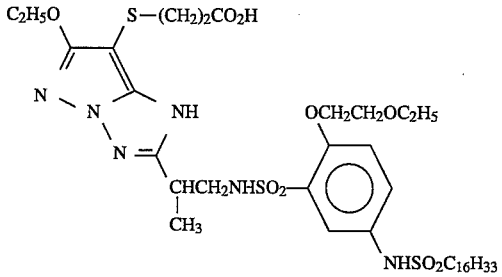
(B-15)
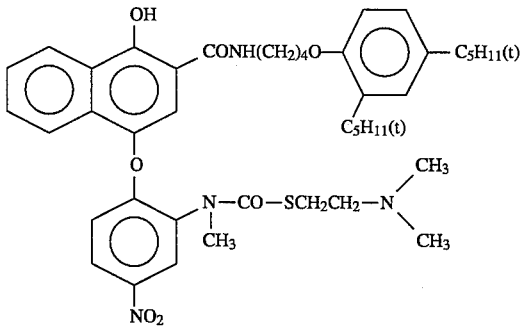
(B-16)
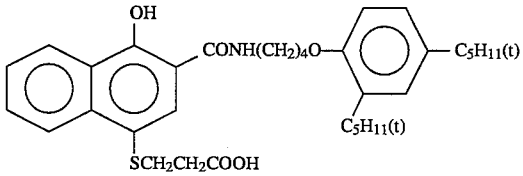
(B-17)
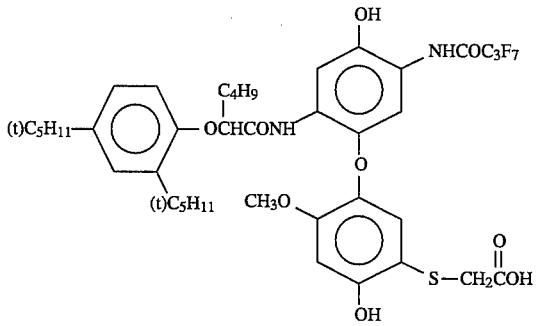

-continued
(B-18)
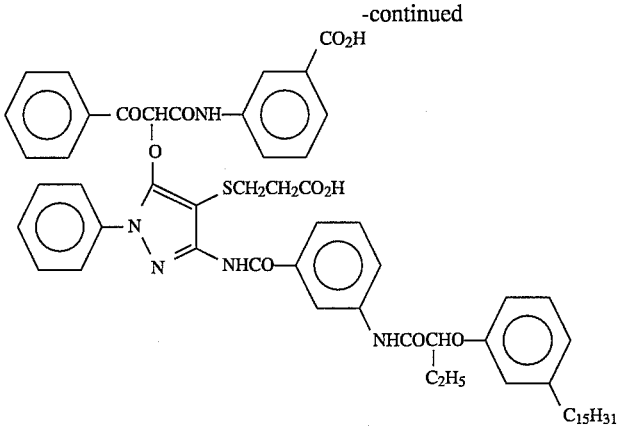
(B-19)
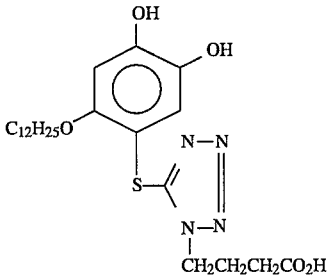
(B-20)
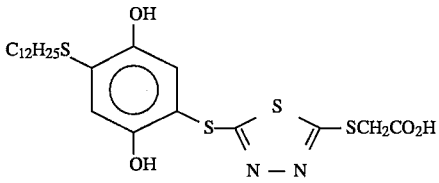
(B-21)
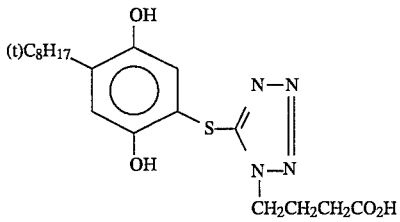
(B-22)
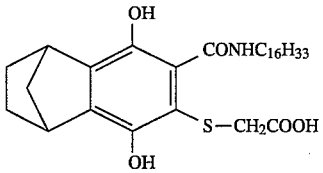
(B-23)
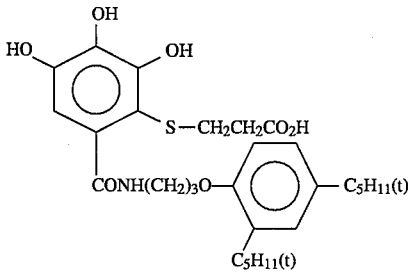

-continued
(B-24)
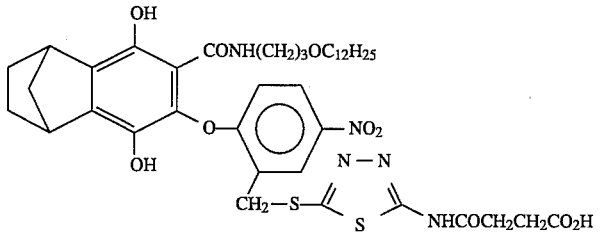
(B-25)
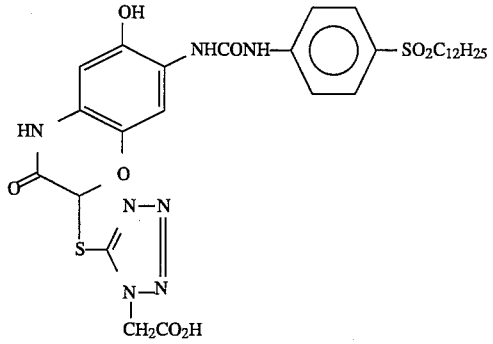
(B-26)
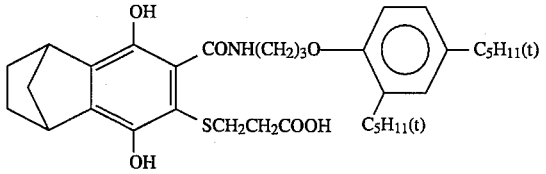
(B-27)
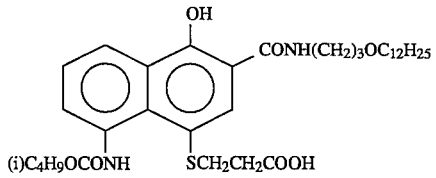
(B-28)
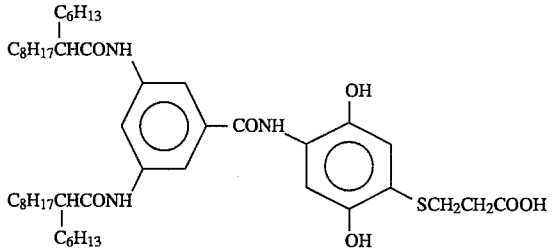
(B-29)
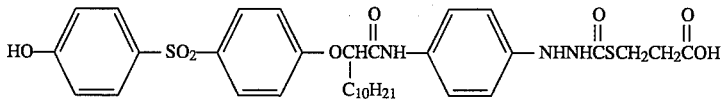
(B-30)
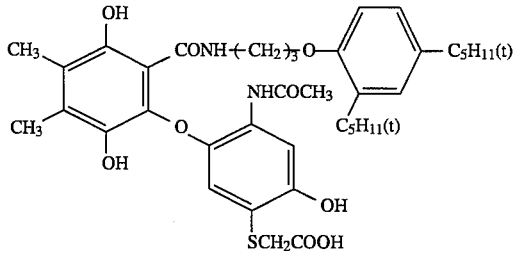

-continued

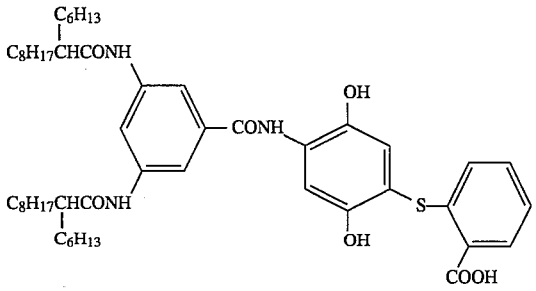

(B-31)

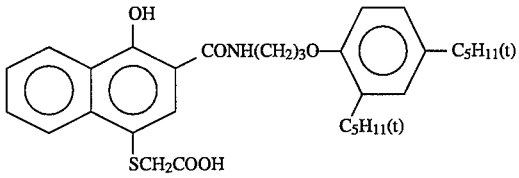

(B-32)

In addition to the above compounds, the compounds described in *Research Disclosure*, Item No. 24241, ibid., 11449, JP-A-61-201247, JP-A-63-106749, JP-A-63-121843, JP-A-121844, JP-A-63-214752 and JP-A-2 -93454 can be used.

The compounds of general formula (B) used in the present invention can be synthesized by referring to the disclosures of JP-A-61-201247 corresponding to EP-A-193,389, JP-A-63-106749, JP-A-63-121843, JP-A-63-121844, JP-A-63-214752 and JP-A-2-093454.

The compounds of general formula (B) may be added to any layer of the photographic material. However, it is preferred that the compounds of general formula (B) are added to the light-sensitive silver halide emulsion layers or layers adjacent thereto. In the present invention, it is preferred that the compounds of general formula (B) are used in the same layer as the acylacetamide type couplers having an acyl group of general formula (YI) and/or the couplers of general formula (1) or (2).

The amounts of the compounds of general formula (B) to be added vary depending on the structures of the compounds, but the compounds are used in an amount of generally $1\times10^{-4}$ to 1.0 g/m$^2$, more preferably $5\times10^{-4}$ to $1\times10^{-1}$ g/m$^2$, particularly preferably $1\times10^{-3}$ to $5\times10^{-2}$ g/m$^2$.

When the acylacetamide type couplers having an acyl group of general formula (YI) and/or the couplers of general formula (1) or (2) are used together with the compounds of general formula (B), not only can color reproducibility of the dye image be improved, but also photographic characteristics such as sensitivity and color density can be prevented from being fluctuated during color development, particularly in running processing.

The layer structure of the photographic material of the present invention is illustrated below.

The photographic material of the present invention has preferably three kinds of light-sensitive layers, a blue-sensitive emulsion layer, a green-sensitive emulsion layer and a red-sensitive layer. Further, the photographic material may have non-light-sensitive layers such as a yellow filter layer for reducing the blue-sensitivity of the green-sensitive emulsion layer and the red-sensitive emulsion layer, an interlayer for reducing color mixture between light-sensitive layers which are different in color sensitivity from each other during development, or an interlayer between light-sensitive layers having the same color sensitivity and an antihalation layer for preventing halation. Furthermore, a donor layer having an interlayer effect having a different spectral sensitivity distribution from that of the main light-sensitive layers such as the blue-sensitive emulsion layer, the green-sensitive emulsion layer and the red-sensitive emulsion layer as described in U.S. Pat. Nos. 4,663,271, 4,705,744 and 4,707,436, JP-A-62-160448 and JP-A-63-89850 may be provided adjacent to or in the vicinity of the main light-sensitive layers to improve color reproducibility.

It is preferred that each light-sensitive layer unit comprising a plurality of silver halide emulsion layers is composed of a two-layer structure consisting of a high-sensitivity emulsion layer and a low-sensitivity emulsion layer as described in West German Patent 1,121,470 and U.K. Patent 923,045. Usually, it is preferred that the emulsion layers are arranged so that light sensitivity is lowered toward the support. A non-light-sensitive layer may be provided between the silver halide emulsion layers. The low-sensitivity emulsion layer may be provided on the side which is farther away from the support, and the high-sensitivity emulsion layer may be provided on the side nearer the support as described in JP-A-57-112751, JP-A-62-200350, JP-A-62-206541 and JP-A-62-206543. In one embodiment, the arrangement may be made in the order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), in the order of BH/BL/GL/GH/RH/RL or in the order of BH/BL/GH/GL/RL/RH from the side which is farthest away from the support.

The arrangement may be made in the order of blue-sensitive layer/GH/RH/GL/RL from the side which is farthest away from the support as described in JP-B-55-34932. The arrangement may be made in the order of blue-sensitive layer/GL/RL/GH/RH from the side which is farthest away from the support as described in JP-A-56-25738 and JP-A-62-63936.

Further, a three-layer structure comprising three light-sensitive silver halide emulsion layers having a different light sensitivity from one another may be used. Specifically, the layers are arranged so that light sensitivity is lowered toward the support. The upper layer is a silver halide emulsion layer having the highest light sensitivity, the intermediate layer is a silver halide emulsion layer having a lower light sensitivity than that of the upper layer, and the lower layer is a silver halide emulsion layer having a lower light sensitivity than that of the intermediate layer as described in JP-B-49-15495. Even when each light-sensitive layer unit is composed of a three-layer structure comprising three layers having a different light sensitivity from one another, the arrangement of the layers having the same color sensitivity may be made in the order of the intermediate-sensitivity emulsion layer/the high-sensitivity emulsion layer/the low-sensitivity emulsion layer as described in JP-A-59-202464.

In another embodiment, the arrangement may be made in the order of the high-sensitivity emulsion layer/the low-sensitivity emulsion layer/the intermediate-sensitivity emulsion layer or in the order of the low-sensitivity emulsion layer/the intermediate-sensitivity emulsion layer/the high-sensitivity emulsion layer. The light-sensitive layer unit may be composed of a four- or more-layer structure, and the arrangement may be as described above.

In the present invention, various layer structures and layer arrangements may be made as described above according to the purposes of the photographic materials.

Though the photographic materials may have various layer structures and layer arrangements as described above, it is preferred that fine silver halide grains which are substantially not sensitive to light are contained in at least one light-sensitive silver halide emulsion layer and/or a layer which is adjacent to the above emulsion layer and is nearer the support. This embodiment will be illustrated in greater detail below.

Typical examples of the layer structures and the layer arrangements which can be preferably used are shown in Table A below.

and arrangement. Light-sensitive silver halide emulsion layers are BH, BL, GH, GL, RH and RL. It is preferred that substantially non-light-sensitive fine silver halide grains (fine grains of silver halide which is substantially not sensitive to light) are contained in at least one layer of the light-sensitive silver halide emulsion layers and/or a layer which is adjacent to said light-sensitive silver halide emulsion layer and provided on the side nearer the support.

Examples of the layer which is adjacent to that light-sensitive silver halide emulsion layer and provided on the side nearer the support include the layer nearer the support shown in Table A above and the above-described non-light-sensitive layers such as an interlayer which may be optionally provided.

The light-sensitive silver halide emulsion layers in which substantially non-light-sensitive fine silver halide grains are to be contained are preferably the blue-sensitive emulsion layers (BH and BL in Table A), the layer having the highest sensitivity (GH in Table A) of the green-sensitive emulsion layers and the layer having the highest sensitivity (RH in Table A) of the red-sensitive emulsion layers, more preferably the blue-sensitive emulsion layers (BH and BL in Table A), and most preferably the highest-sensitivity blue-sensitive emulsion layer.

The layer which is adjacent to the light-sensitive silver halide emulsion layer and provided on the side nearer the support is preferably a non-light-sensitive layer, more preferably an interlayer described above, and most preferably a hydrophilic colloid layer containing neither couplers nor other compounds.

Substantially non-light-sensitive fine silver halide grains are described below.

TABLE A

| Typical | Layer Typical Basic Layer Structure and Arrangement | | | | | | | | | | | | | |
|---|---|---|---|---|---|---|---|---|---|---|---|---|---|---|
| Example | 0 | 1 | 2 | 3 | 4 | 5 | 6 | 7 | 8 | 9 | 10 | 11 | 12 | 13 |
| Example 1 | support | AH | RL | RH | M | GL | GH | YF | BL | BH | P | — | — | — |
| Example 2 | support | AH | RL | M | GL | M | RH | M | GH | YF | BL | BH | P | — |
| Example 3 | support | AH | RL | M | GL | M | BL | M | RH | M | GH | M | BH | P |

In the above Table,
AH; antihalation layer, M: interlayer, YF: yellow filter layer, P: protective layer, R: red-sensitive layer, G: green-sensitive layer, B: blue-sensitive layer, H: high-sensitivity layer, L: low-sensitivity layer In the typical basic layer structures and arrangements shown in Table A above, each unit light-sensitive layer is shown by a two-layer structure composed of a low-sensitivity layer and a high-sensitivity layer. However, the unit light-sensitive layer may be a three- or more-layer structure (e.g., a three-layer structure composed of a high-sensitivity layer, an intermediate-sensitivity layer and a low-sensitivity layer). In this case, RH may be composed of RH-1 and RH-2, and RL may be composed of RL-1 and RL-2. It is preferred that the arrangement is made in the order of the low-sensitivity layer, the intermediate-sensitivity layer and the high-sensitivity layer from the side nearer the support. An interlayer M may be optionally provided between RH-1 and RH-2 and between RL-1 and RL-2. In the arrangement of Example 1 shown in Table A above, an interlayer M may be optionally provided between RL and RH, GL and GH, and BL and BH. Further, an interlayer may be provided between AH and RL or adjacent to YF on the side which is nearer the support or farther away from the support. Each of these non-light-sensitive layers and the protective layer may be composed of two or more layers which adjoin.

The photographic materials will be further illustrated below on the basis of the above typical basic layer structure The term "substantially non-light-sensitive" in the substantially non-light-sensitive fine silver halide grains as used herein means that sensitivity is lower by at least 0.5 in log unit than the sensitivity of the layer having the lowest sensitivity of the adjoining light-sensitive silver halide emulsion layers. It is preferred that the sensitivity is lower by at least 1.0 in log unit than that of the layer having the lowest sensitivity.

Substantially non-sensitive fine silver halide grains used in the present invention may be grains of pure silver chloride, pure silver bromide, pure silver iodide, silver chlorobromide, silver iodobromide and silver chloroiodobromide. However, it is preferred that the silver chloride content is low, particularly not higher than 30 mol %, because it is preferred that silver halide grains are not dissolved during development. It is also preferred that the content of silver bromide is high, particularly at least 60 mol %. The content of silver iodide is not higher than 40 mol %, preferably not higher than 10 mol %. Silver iodobromide grains having a silver iodide content of not higher than 10 mol % are particularly preferred.

The grains have a grain size of preferably not larger than 0.6 μm, more preferably from 0.04 to 0.4 μm, though there is no particular limitation with regard to grain size. When substantially non-light-sensitive fine silver halide grains are contained in the blue-sensitive emulsion layers, the layer between the blue-sensitive emulsion layers, or the lowest-sensitivity blue-sensitive emulsion layer provided nearer the support, the grain size is preferably in the range of 0.08 to 0.25 μm. When substantially non-light-sensitive fine silver halide grains are contained in the green-sensitive emulsion layers, the layer between the green-sensitive emulsion layers, or the lowest-sensitivity green-sensitive emulsion layer provided nearer the support, the grain size is preferably in the range of 0.1 to 0.3 μm. When substantially non-light-sensitive fine silver halide grains are contained in the red-sensitive emulsion layers, the layer between the red-sensitive emulsion layers, or the lowest-sensitivity red-sensitive emulsion layer provided nearer the support, the grain size is preferably in the range of 0.1 to 0.4 μm. The substantially non-light-sensitive fine silver halide grains used in the present invention may have a quite wide grain size distribution. However, it is preferred that the grain size distribution is narrow. It is particularly preferred that 90% (in terms of the weight or the number of the silver halide grains) of the grains are composed of grains having a grain size within a mean grain size of ±40%.

The coating weight of the substantially non-light-sensitive fine silver halide grains used in the present invention is 0.03 to 5.0 g/m$^2$, preferably 0.05 to 1.0 g/m$^2$, in terms of silver. When the layer containing the substantially non-light-sensitive silver halide grains is a non-light-sensitive layer other than the light-sensitive emulsion layers, any of hydrophilic polymers can be used as the binder, but gelatin can be advantageously used. It is preferred that the amount of binder is less than 250 g per mol of the fine silver halide grain.

The substantially non-sensitive fine silver halide grains used in the present invention can be prepared by conventional methods. Namely, the acid process, the neutral process or the ammonia process can be used. A soluble silver salt and a soluble halide salt can be reacted by the single jet process, the double jet process or a combination thereof. As a type of the double jet process, a controlled double jet process wherein the pAg in the liquid phase in which silver halide is formed, is kept constant can be used. This process is preferred as a method for preparing the substantially non-light-sensitive fine silver halide grains because grains having a narrow grain size distribution can be obtained.

The substantially non-light-sensitive fine silver halide grains used in the present invention may have a regular crystal form such as a cubic, octahedral, dodecahedral or tetradecahedral form or a crystal form such as a spherical or tabular form. Tabular grains having an aspect ratio of 2 or more are preferred.

In connection with the substantially non-light-sensitive tabular fine silver halide grains, the term "aspect ratio" as used herein refers to the ratio of the diameter of the silver halide grain to the thickness thereof. Namely, the aspect ratio is a value obtained by dividing the diameter of one grain by the thickness thereof. The diameter of the grain is defined as the diameter of a circle having an area equal to the projected area of the grain when the grain is examined through an electron microscope. Accordingly, the description "an aspect ratio of 2 or more" means that the diameter of the grain is at least twice as large as the thickness of the grain.

In the tabular silver halide grains used in the present invention, the diameter of the grain is at least twice, preferably 2 to 15 times, more preferably 3 to 10 times, particularly preferably 4 to 8 times, as large as the thickness of the grain. It is preferred that the tabular grains account for at least 50%, more preferably at least 70%, particularly preferably at least 85%, of the entire projected areas of the substantially non-light-sensitive fine silver halide grains.

The tabular silver halide emulsions used in the present invention can be easily prepared by referring to a paper read by Cugnac, Chatea and the methods described in Duffin, *Photographic Emulsion Chemistry* (Focal Press New York 1986), pp. 66–72, A. P. H. Trivelli, W. F. Smith, *Phot. Journal,* 80 (1940) page 285, JP-A-58-113927, JP-A-58-113928 and JP-A-58-127921.

The substantially non-light-sensitive fine silver halide grains may be different in halogen composition between the interior of the grain and the surface layer thereof, or may have a uniform halogen composition throughout the grain. The substantially non-light-sensitive fine silver halide grains may contain impurities such as a cadmium ion, a lead ion, a zinc ion, an iridium ion, a rhodium ion, a thallium ion and an iron ion.

The substantially non-light-sensitive fine silver halide grains may be a surface latent image type and an internal latent image type, or may be a type wherein the grains have a fog nucleus in the interior thereof.

The substantially non-light-sensitive fine silver halide grains may be subjected to conventional chemical sensitization such as sulfur sensitization, gold sensitization and reduction sensitization. However, it is preferred that the degree of chemical sensitization is conducted as moderately as possible. In the present invention, emulsions which are not chemically sensitized, that is, un-after-ripened emulsions, are preferred. The preparation methods and forms of these silver halide grains are described in more detail hereinafter.

The substantially non-light-sensitive fine silver halide grains may be spectrally sensitized. Namely, conventional dyes such as cyanine dyes, merocyanine dyes, complex cyanine dyes, complex merocyanine dyes, holopolar cyanine dyes, hemicyanine dyes, styryl dyes and hemioxonol dyes may be added to the grains. Further, desensitizing dyes which greatly decrease sensitivity and are not preferred for conventional negative emulsions can be used.

The substantially non-light-sensitive fine silver halide grains may contain conventional anti-fogging agents or stabilizers. Examples of the anti-fogging agents or the stabilizers which can be added to the grains include azoles, heterocyclic mercapto compounds, thio-keto compounds, azaindenes, benzenethiosulfonic acids and benzenesulfinic acids.

In the present invention, dyes may be added to the layer containing the substantially non-light-sensitive fine silver halide grains, or the dispersions of difficultly soluble synthetic polymers may be contained in the layer.

As described above, in a silver halide color photographic material having at least one light-sensitive silver halide emulsion layer containing an acylacetamide type coupler having an acyl group of general formula (YI) and/or a coupler of general formula (1) or (2), the substantially non-light-sensitive fine silver halide grains are contained in at least one light-sensitive silver halide emulsion layer and/or a layer which is adjacent to said light-sensitive silver halide emulsion layer and is provided on the side nearer the support, whereby higher sensitivity can be provided and image qualities (color reproducibility, sharpness) can be improved. In addition, photographic materials prepared according to the present invention have high processing stability.

Any conventional support can be used as the support for the photographic materials of the present invention.

Examples of the supports which can be used in the present invention include the films of semi-synthetic or synthetic polymers (e.g., the films of cellulose acetate, polystyrene, polyvinyl chloride, polyethylene terephthalate, polycarbonates, polyamides, etc.), flexible supports formed by providing a reflective layer on the films, flexible reflective supports obtained by laminating paper or synthetic paper with an α-olefin polymer, glass, metal or earthenware.

In the present invention, transparent supports composed of fibrous polymers (e,g., cellulose acetate) and polyester polymers (e.g., polyethylene terephthalate) are preferred.

Particularly, films composed of copolymers of diols [e.g., aliphatic diols (e.g., ethylene glycol, 1,4-butanediol, 1,4-cyclohexanediol), aromatic diols (e.g., hydroquinone, catechol, resorcinol)] with dicarboxylic acids [e.g., aliphatic dicarboxylic acids (e.g., succinic acid, maleic acid, sebacic acid, 1,4-cyclohexanedicarboxylic acid), aromatic dicarboxylic acids (e.g., terephthalic acid, isophthalic acid, phthalic anhydride)] or the polymers of blends of these compounds are preferred, said copolymer and polymers having an average molecular weight of $1\times10^4$ to $5\times10^5$ and a glass transition point (Tg) of not lower than 90° C., but not higher than 200° C.

Examples of the polyester polymers which can be used as supports include, but are not limited to, the following polymers.

| Examples of Compounds (parenthesized numerals represent molar ratio) | | |
|---|---|---|
| PEN: | [2,6-Naphthalenedicarboxylic Acid (NDCA)/Ethylene Glycol (EG) (100/100)] | Tg = 119° C. |
| PCT: | [Terephthalic Acid (TPA)/Cyclohexanedimethanol (CHDM) (100/100)] | Tg = 93° C. |
| PAr: | [TPA/Bisphenol A (BPA) (100/100)] | Tg = 192° C. |
| | 2,6-NDCA/TPA/EG (50/50/100) | Tg = 92° C. |
| | 2,6-NDCA/TPA/EG (75/25/100) | Tg = 102° C. |
| | 2,6-NDCA/TPA/EG/BPA (50/50/75/25) | Tg = 112° C. |
| | TPA/EG/BPA (100/50/50) | Tg = 105° C. |
| | TPA/EG/BPA (100/25/75) | Tg = 135° C. |
| | TPA/EG/CHDM/BPA (100/25/25/50) | Tg = 115° C. |
| | Isophthalic Acid (IPA)/p-Phenylenedicarboxylic Acid (PPDC)/TPA/EG (20/50/30/100) | Tg = 95° C. |
| | NDCA/Neopentyl Glycol (NPG)/EG (100/70/30) | Tg = 105° C. |
| | TPA/EG/Biphenol (BP) (100/20/80) | Tg = 115° C. |
| | p-Hydroxybenzoic Acid (PHBA)/EG/TPA/(200/100/100) | Tg = 125° C. |
| | PEN/PET (60/40) | Tg = 95° C. |
| | PEN/PET (80/20) | Tg = 104° C. |
| | PAr/PEN (50/50) | Tg = 142° C. |
| | PAr/PCT (50/50) | Tg = 118° C. |
| | PAr/PET (60/40) | Tg = 101° C. |
| | PEN/PET/PAr (50/25/25) | Tg = 108° C. |

These polyester polymer films may contain ultraviolet light absorbers to prevent fluorescence and to impart long-term stability. Further, the films may contain dyes or pigments.

Conventional methods can be used to treat these films so as to provide photographic layers or back layers thereon. For example, the films may be subjected to a surface activation treatment such as a chemical treatment, a mechanical treatment, a corona discharge treatment or a glow discharge treatment. A subbing layer may be provided after or without the surface activation treatment, and photographic layers and back layers can be coated thereon by conventional methods.

When the subbing layer or the back layers are provided, these layers may optionally contain conventional antistatic agents, lubricants, matting agents, surfactants, dyes and pigments.

Further, the silver halide color photographic materials of the present invention may be provided with a magnetic recording layer to record various information. Conventional ferromagnetic substances can be used. It is preferred that the magnetic recording layer is provided on the back side of the support. The magnetic recording layer can be provided by coating or printing. The photographic materials may be provided with an optical recording space to record various information.

Silver halides, couplers and other photographic additives for use in light-sensitive silver halide emulsion layers, the method of use thereof, color development and processing methods, described in European Patent 482,552A (the 30th line of page 36 to the 38th line of page 37; the 55th line of page 37 to the 32nd line of page 41; and the 40th line of page 41 to the 25th line of page 45) corresponding to U.S. Pat. No. 5,213,958 can be applied to the silver halide color photographic materials of the present invention.

The silver halide color photographic materials of the present invention can be applied to film units equipped with a lens described in JP-B-2-032615 and JP-B-U-3-039784 (the term "JP-B-U" as used herein means an "examined Japanese utility model publication").

The present invention is now illustrated in greater detail by reference to the following examples which, however, are not to be construed as limiting the invention in any way.

EXAMPLE 1

The following layers having the following compositions were coated on a cellulose triacetate film support having a subbing layer to prepare a multi-layer color photographic material as Sample 101.

Composition of Light-Sensitive Layer

Following abbreviations for the principal components used in the layers are used for brevity's sake.

ExC: Cyan Coupler

ExM: Magenta Coupler

ExY: Yellow Coupler

ExS: Sensitizing Dye

UV: Ultraviolet Light Absorber

HBS: High-Boiling Organic Solvent

H: Hardening Agent for Gelatin

The coating weights of the silver halide emulsions and colloidal silver are represented by $g/m^2$ in terms of silver. The amounts of the couplers, the additives are represented by $g/m^2$. The amounts of the sensitizing dyes are represented by moles per one mole of silver halide in the same layer.

| First Layer (antihalation layer) | |
|---|---|
| Black Colloidal Silver (in terms of silver) | 0.20 |
| Gelatin | 2.20 |
| UV-1 | 0.11 |
| UV-2 | 0.20 |
| Cpd-1 | $4.0\times10^{-2}$ |
| Cpd-2 | $1.9\times10^{-2}$ |
| HBS-1 | 0.30 |
| HBS-2 | $1.2\times10^{-2}$ |
| **Second Layer (interlayer)** | |
| Fine Grains of Silver Iodobromide (AgI content: 1.0 mol %; grain size | 0.15 |

-continued

| | |
|---|---|
| (in terms of an average of the diameters of the corresponding spheres): 0.07 μm) (in terms of silver) | |
| Gelatin | 1.00 |
| ExC-4 | $6.0 \times 10^{-2}$ |
| Cpd-3 | $2.0 \times 10^{-2}$ |
| Third Layer (low-sensitivity red-sensitive emulsion layer) | |
| Silver Iodobromide Emulsion A (in terms of silver) | 0.42 |
| Silver Iodobromide Emulsion B (in terms of silver) | 0.40 |
| Gelatin | 1.90 |
| ExS-1 | $6.8 \times 10^{-4}$ mol |
| ExS-2 | $2.2 \times 10^{-4}$ mol |
| ExS-3 | $6.0 \times 10^{-5}$ mol |
| ExC-1 | 0.40 |
| ExC-3 | 0.30 |
| ExC-4 | $2.3 \times 10^{-2}$ |
| Comparative Coupler (A) | $1.5 \times 10^{-2}$ |
| HBS-1 | 0.32 |
| Fourth Layer (intermediate-sensitivity red-sensitive emulsion layer) | |
| Silver Iodobromide Emulsion C (in terms of silver) | 0.85 |
| Gelatin | 0.91 |
| ExS-1 | $4.5 \times 10^{-4}$ mol |
| ExS-2 | $1.5 \times 10^{-4}$ mol |
| ExS-3 | $4.5 \times 10^{-5}$ mol |
| ExC-1 | 0.13 |
| ExC-2 | $6.2 \times 10^{-2}$ |
| ExC-4 | $4.0 \times 10^{-2}$ |
| ExC-6 | $3.0 \times 10^{-2}$ |
| Comparative Coupler (A) | $5.0 \times 10^{-3}$ |
| HBS-1 | $8.0 \times 10^{-2}$ |
| HBS-4 | $5.0 \times 10^{-2}$ |
| Fifth Layer (high-sensitivity red-sensitive emulsion layer) | |
| Silver Iodobromide Emulsion D (in terms of silver) | 1.50 |
| Gelatin | 1.20 |
| EXS-1 | $3.0 \times 10^{-4}$ mol |
| ExS-2 | $9.0 \times 10^{-5}$ mol |
| ExS-3 | $3.0 \times 10^{-5}$ mol |
| ExC-2 | $8.5 \times 10^{-2}$ |
| ExC-5 | $3.6 \times 10^{-2}$ |
| ExC-6 | $1.0 \times 10^{-2}$ |
| B-16 | $3.7 \times 10^{-2}$ |
| HBS-1 | 0.12 |
| RBS-2 | $6.0 \times 10^{-2}$ |
| HBS-5 | $6.0 \times 10^{-2}$ |
| Sixth Layer (interlayer) | |
| Gelatin | 1.00 |
| Cpd-4 | $8.0 \times 10^{-2}$ |
| HBS-1 | $8.0 \times 10^{-2}$ |
| Seventh Layer (low-sensitivity green-sensitive emulsion layer) | |
| Silver Iodobromide Emulsion E (in terms of silver) | 0.28 |
| Silver Iodobromide Emulsion F (in terms of silver) | 0.16 |
| Gelatin | 1.20 |
| ExS-4 | $7.5 \times 10^{-4}$ mol |
| ExS-5 | $3.0 \times 10^{-4}$ mol |
| ExS-6 | $1.5 \times 10^{-4}$ mol |
| ExM-1 | 0.40 |
| ExM-2 | 0.15 |
| ExM-5 | $3.5 \times 10^{-2}$ |
| Comparative Coupler (B) | $1.2 \times 10^{-2}$ |
| HBS-1 | 0.20 |
| HBS-3 | $2.5 \times 10^{-2}$ |
| HBS-4 | 0.10 |

-continued

| | |
|---|---|
| Eighth Layer (intermediate-sensitivity green-sensitive emulsion layer) | |
| Silver Iodobromide Emulsion G (in terms of silver) | 0.57 |
| Gelatin | 0.45 |
| ExS-4 | $5.2 \times 10^{-4}$ mol |
| ExS-5 | $2.1 \times 10^{-4}$ mol |
| ExS-6 | $1.1 \times 10^{-4}$ mol |
| ExM-1 | 0.10 |
| ExM-2 | $3.0 \times 10^{-2}$ |
| ExM-3 | $3.5 \times 10^{-2}$ |
| Comparative Coupler (B) | $8.5 \times 10^{-3}$ |
| HBS-1 | 0.10 |
| HBS-4 | $5.0 \times 10^{-2}$ |
| HBS-3 | $8.0 \times 10^{-3}$ |
| Ninth Layer (interlayer) | |
| Gelatin | 0.50 |
| HBS-1 | $2.0 \times 10^{-2}$ |
| Tenth Layer (high-sensitivity green-sensitive emulsion layer) | |
| Silver Iodobromide Emulsion H (in terms of silver) | 1.30 |
| Gelatin | 1.20 |
| ExS-4 | $3.0 \times 10^{-4}$ mol |
| ExS-5 | $1.2 \times 10^{-4}$ mol |
| ExS-6 | $1.2 \times 10^{-4}$ mol |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| HBS-1 | 0.20 |
| HBS-5 | $5.0 \times 10^{-2}$ |
| Eleventh Layer (yellow filter layer) | |
| Gelatin | 0.50 |
| Cpd-6 | $5.2 \times 10^{-2}$ |
| HBS-1 | 0.12 |
| Twelfth Layer (interlayer) | |
| Gelatin | 0.45 |
| Cpd-3 | 0.10 |
| Thirteenth Layer (low-sensitivity blue-sensitive emulsion layer) | |
| Silver Iodobromide Emulsion I (in terms of silver) | 0.20 |
| Gelatin | 1.00 |
| ExS-7 | $3.0 \times 10^{-4}$ mol |
| Comparative Coupler (1) | 0.60 |
| Comparative Coupler (B) | $3.0 \times 10^{-2}$ |
| B-32 | $5.0 \times 10^{-3}$ |
| HBS-1 | 0.15 |
| HBS-5 | $5.0 \times 10^{-2}$ |
| Fourteenth Layer (intermediate-sensitivity blue-sensitive emulsion layer) | |
| Silver Iodobromide Emulsion J (in terms of silver) | 0.19 |
| Gelatin | 0.35 |
| ExS-7 | $3.0 \times 10^{-4}$ mol |
| Comparative Coupler (1) | 0.22 |
| Comparative Coupler (B) | $1.0 \times 10^{-2}$ |
| B-26 | $1.0 \times 10^{-2}$ |
| HBS-1 | $7.0 \times 10^{-2}$ |
| HBS-4 | $3.0 \times 10^{-2}$ |
| Fifteenth Layer (interlayer) | |
| Fine Grains of Silver Iodobromide (AgI content: 2 mol %; uniform AgI type; grain size (in terms of an average of the diameters of the corresponding spheres); 0.20 μm) (in terms of silver) | 0.20 |
| Gelatin | 0.36 |

-continued

| | |
|---|---|
| Sixteenth Layer (high-sensitivity blue-sensitive emulsion layer) | |
| Silver Iodobromide Emulsion K (in terms of silver) | 1.55 |
| Gelatin | 1.00 |
| ExS-8 | $2.2 \times 10^{-4}$ mol |
| Comparative Coupler (1) | 0.21 |
| B-32 | $2.0 \times 10^{-2}$ |
| HBS-1 | $7.0 \times 10^{-2}$ |
| HBS-4 | $3.0 \times 10^{-2}$ |
| Seventeenth Layer (first protective layer) | |
| Gelatin | 1.80 |
| UV-1 | 0.13 |
| UV-2 | 0.21 |
| HBS-1 | $1.0 \times 10^{-2}$ |
| HBS-2 | $1.0 \times 10^{-2}$ |
| Eighteenth Layer (second protective layer) | |
| Fine Grains of Silver Chloride (grain size (in terms of an average of the diameters of the corresponding spheres) of 0.07 μm) (in terms of silver) | 0.36 |
| Gelatin | 0.70 |
| P-1 (diameter: 1.5 μm) | $2.0 \times 10^{-2}$ |
| P-2 (diameter: 1.5 μm) | 0.15 |
| P-3 | $3.0 \times 10^{-2}$ |
| W-1 | $2.0 \times 10^{-2}$ |
| H-1 | 0.35 |
| Cpd-7 | 1.00 |

About 200 ppm of 1,2-benzisothiazoline-3-one, about 1,000 ppm of n-butyl p-hydroxybenzoate and about 10,000 ppm of 2-phenoxyethanol in addition to the above-described ingredients were added to the thus-prepared sample, each amount being based on the amount of gelatin. Further, the sample contained P-4 to P-6, W-2 to W-4, F-1 to F-17, an iron salt, a lead salt, a gold salt, a platinum salt, an iridium salt, a rhodium salt and a palladium salt.

TABLE B

| Emulsion | Average AgI Content (%) | Grain Size in Terms of an Average of the Diameters of the Corresponding Spheres (μm) | Coefficient of Variation in Grain Size Distribution (%) | Grain Size in Terms of an Average of the Diameters of the Corresponding Circles (μm) | Average Thickness (μm) | Grain Structure | Form |
|---|---|---|---|---|---|---|---|
| A | 9 | 0.75 | 18 | 1.16 | 0.21 | triple structure | tabular |
| B | 3 | 0.50 | 10 | 0.50 | 0.50 | triple structure | cubic |
| C | 9 | 0.83 | 15 | 1.32 | 0.22 | triple structure | tabular |
| D | 5 | 1.20 | 15 | 1.90 | 0.32 | triple structure | tabular |
| E | 5 | 0.70 | 18 | 1.13 | 0.18 | triple structure | tabular |
| F | 3 | 0.48 | 10 | 0.48 | 0.48 | triple structure | octahedral |
| G | 7 | 0.80 | 15 | 1.25 | 0.22 | triple structure | tabular |
| H | 4.5 | 1.15 | 15 | 1.97 | 0.26 | triple structure | tabular |
| I | 1.5 | 0.55 | 20 | 0.90 | 0.14 | triple structure | tabular |
| J | 8 | 0.80 | 16 | 1.19 | 0.24 | triple structure | tabular |
| K | 7 | 1.45 | 14 | 2.31 | 0.38 | triple structure | tabular |

In the above Table B, (1) each emulsion was reduction sensitized by using thiourea dioxide and thiosulfonic acid during the formation of the grains according to the Examples of JP-A-2-191938;

(2) each emulsion was subjected to gold sensitization, sulfur sensitization and selenium sensitization in the presence of sodium thiocyanate and spectral sensitizing dyes described in each light-sensitive layer according to the Examples of JP-A-3-237450;

(3) low-molecular-weight gelatin was used in the preparation of the tabular grains according to the Examples of JP-A-1-158426; and (4) the tabular grains and regular crystal grains having a grain structure showed that dislocation lines as described in JP-A-3-237450 were observed through a high-pressure electron microscope.

(UV-1)
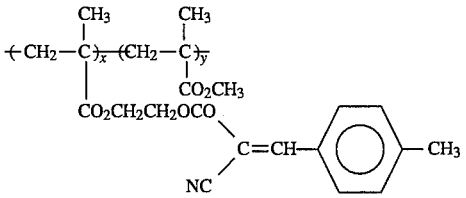
x/y = 7/3 (by weight)
(UV-2)
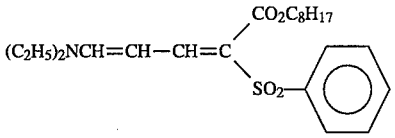
(ExC-1)
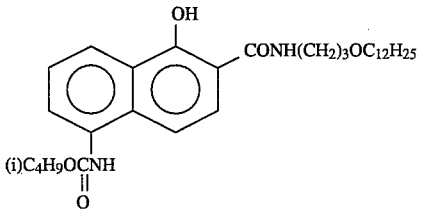
(ExC-2)
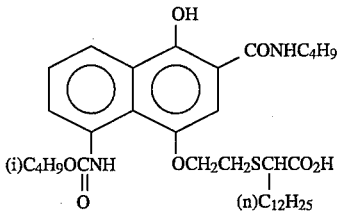
(ExC-3)
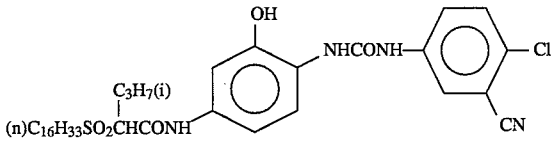
(ExC-4)
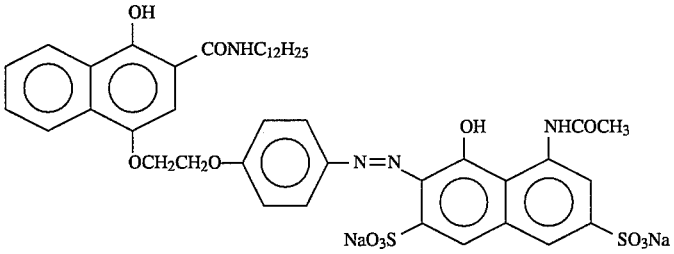
(ExC-5)
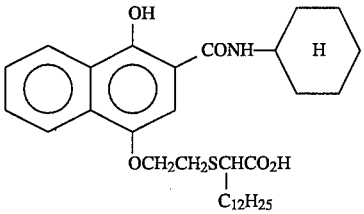

-continued
(ExC-6)
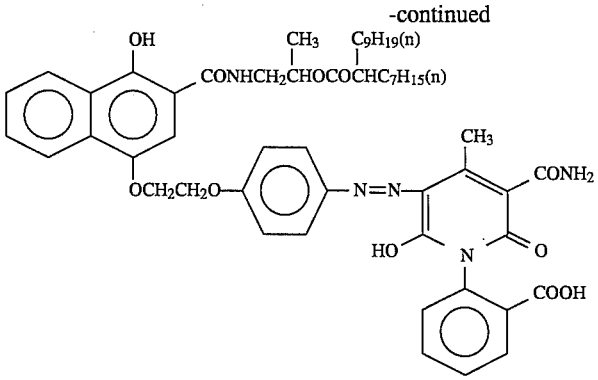
(ExM-1)
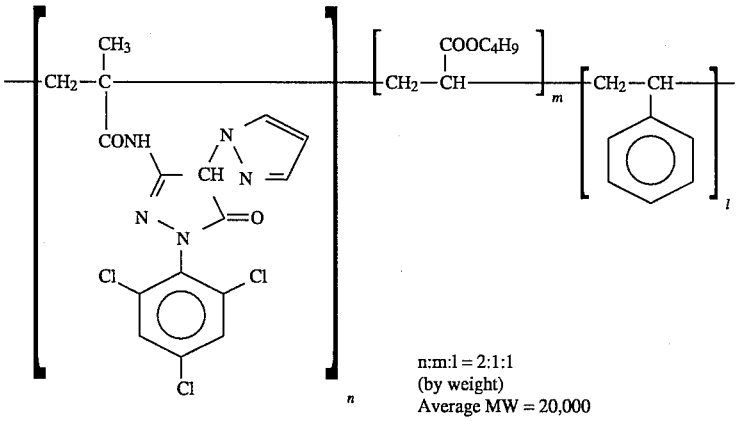
n:m:l = 2:1:1
(by weight)
Average MW = 20,000
(ExM-2)
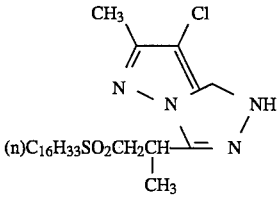
(ExM-3)
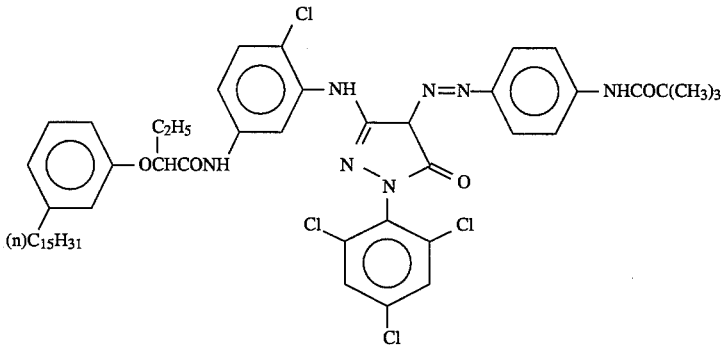

-continued
(ExM-4)
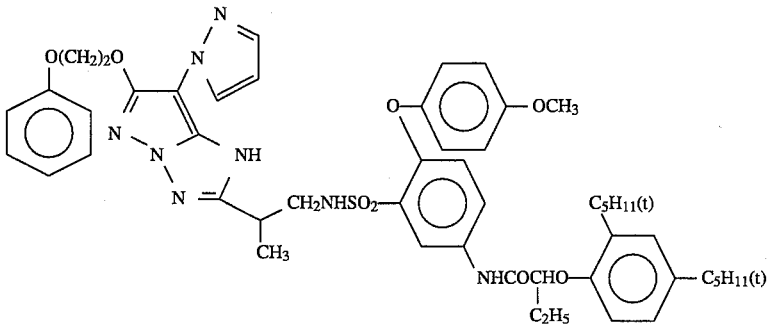
(ExM-5)
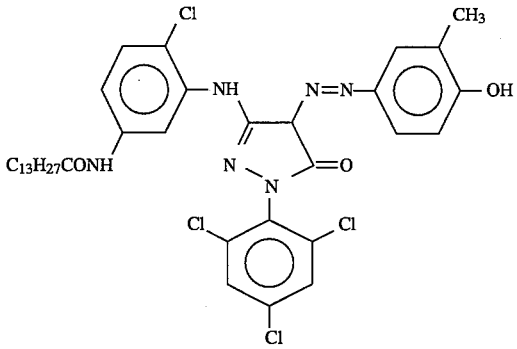
(ExM-6)
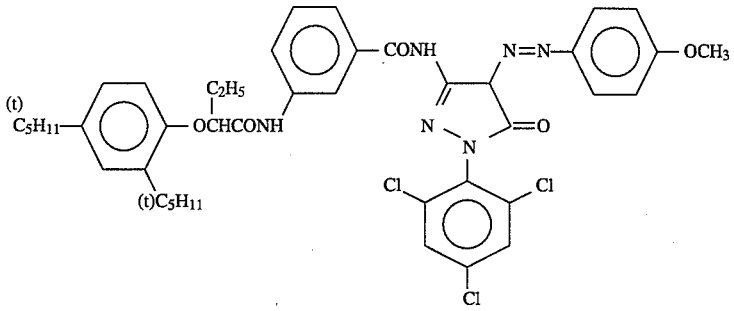
Comparative Coupler (A) described in U.S. Pat. No. 4,248,962
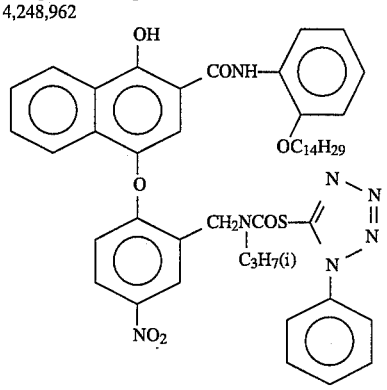
-continued
Comparative Coupler (B) described in JP-A-2-250053
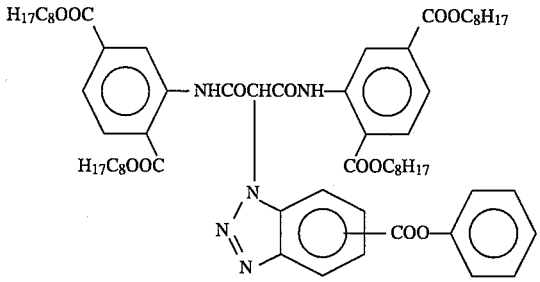
Comparative Coupler (I) described in RD No. 18053

-continued
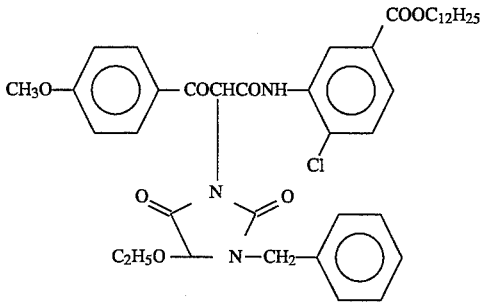
(Cpd-1)
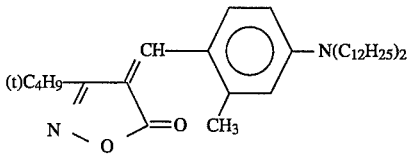
(Cpd-2)
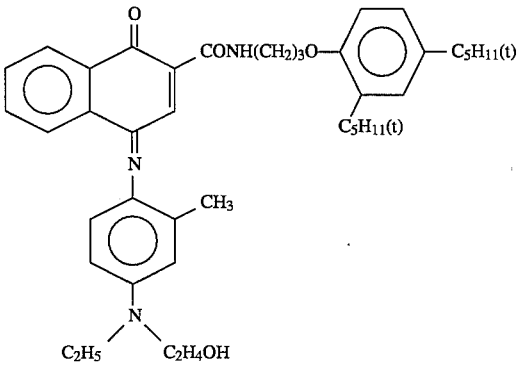
(Cpd-3)
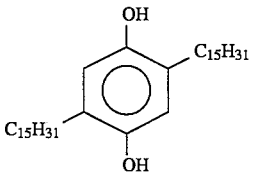
(Cpd-4)
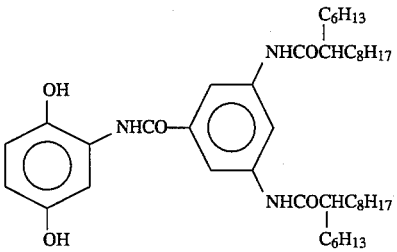
(Cpd-5)
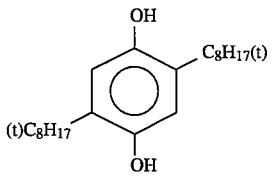
(Cpd-6)
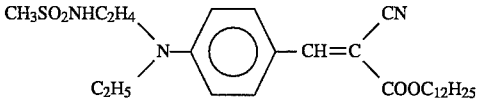
-continued
(Cpd-7)
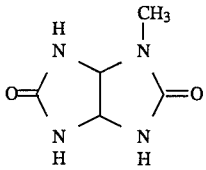
(HBS-1)
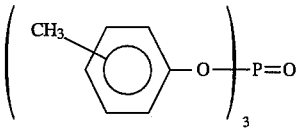
(HBS-2)
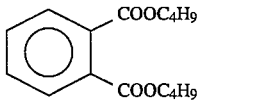
(HBS-3)
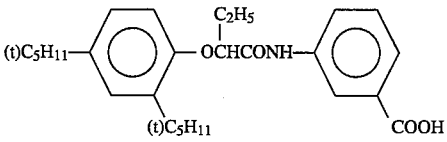
(HBS-4)
$(iso\text{-}C_9H_{19}O)_3P{=}O$
(HBS-5)
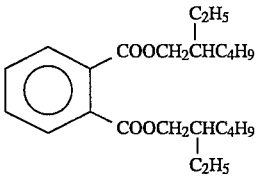
(ExS-1)
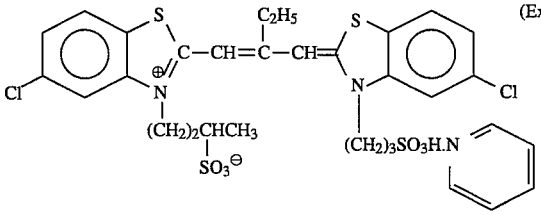
(ExS-2)
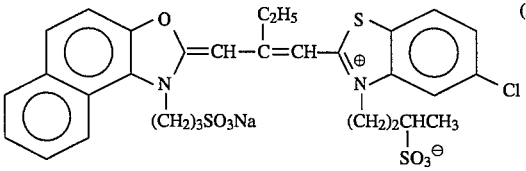
(ExS-3)
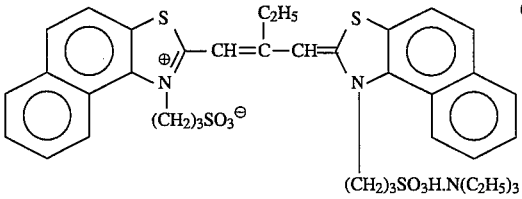
(ExS-4)
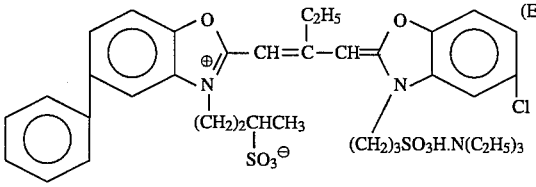

-continued
(ExS-5)
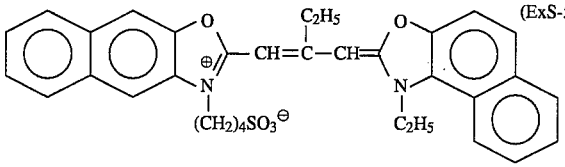
(ExS-6)
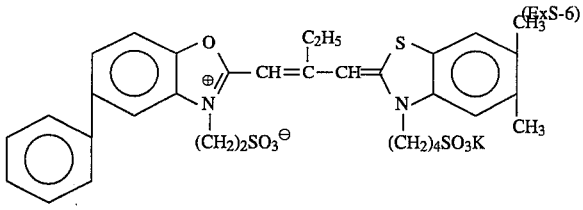
(ExS-7)
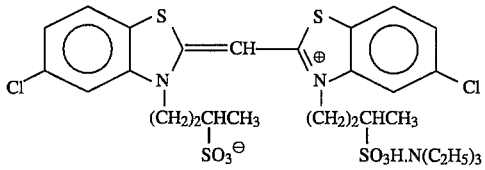
(ExS-8)
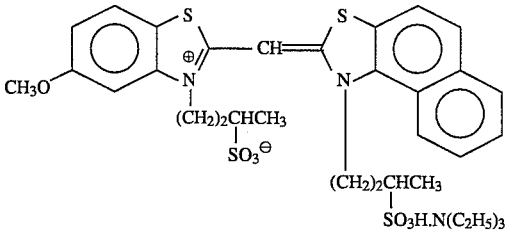
(P-1)
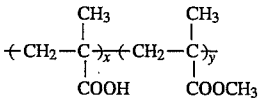
x/y = 10/90
(P-2)
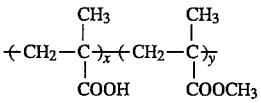
x/y = 40/60
(P-3)
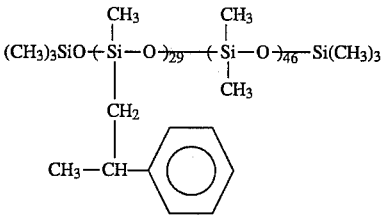
(P-4)
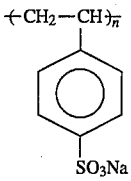
(molecular weight = about 750,000)
(P-5)
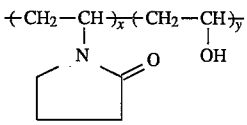
x/y = 70/30
-continued
(P-6)
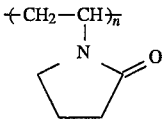
(mol. wt. about 10,000)
(W-1)
$C_8F_{17}SO_2NHCH_2CH_2CH_2OCH_2CH_2\overset{\oplus}{N}(CH_3)_3$
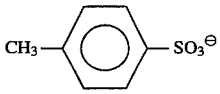
(W-2)
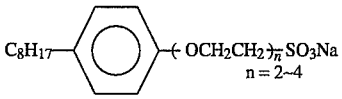
n = 2~4
(W-3)
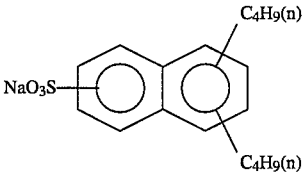
(W-4)
$NaO_3S-CHCOOC_{16}H_{33}$
$NaO_3S-CHCOOC_{16}H_{33}$
(H-1)
$CH_2=CH-SO_2-CH_2-CONH-CH_2$
$CH_2=CH-SO_2-CH_2-CONH-CH_2$
and
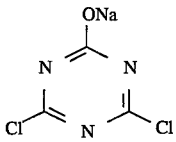
3:1 Mixture (by molar ratio)
(F-1)
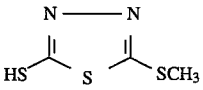
(F-2)
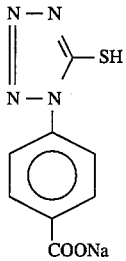
(F-3)
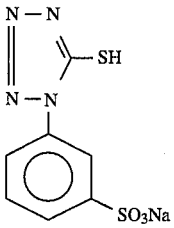

-continued (F-4)

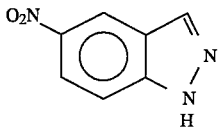

(F-5)

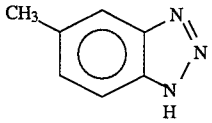

(F-6)

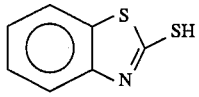

(F-7)

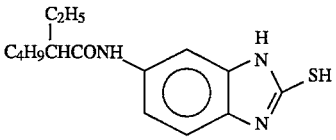

(F-8)

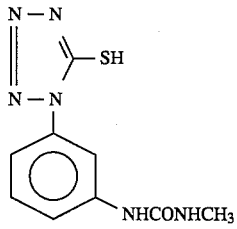

(F-9)

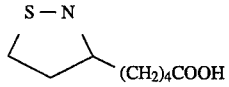

(F-10)

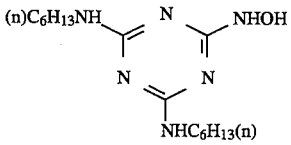

(F-11)

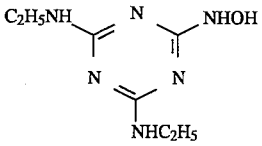

(F-12)

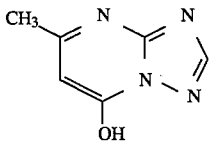

(F-13)

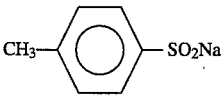

(F-14)

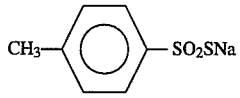

(F-15)

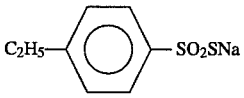

-continued (F-16)

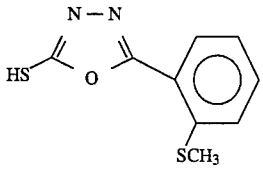

(F-17)

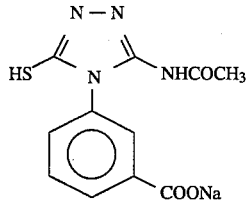

Sample 102 was prepared in the same manner as Sample 101, except that an equimolar amount 0f comparative Coupler (C) was used in place of Comparative Coupler (A) used in each of the third and fourth layers of Sample 101, and an equimolar amount of Comparative Coupler (D) was used in place of Comparative Coupler (B) used in each of the seventh, eighth, thirteenth and fourteenth layers of Sample 101.

Sample 103 was prepared in the same manner as Sample 101, except that an equimolar amount of Compound D-11 of general formula (I) according to the present invention was used in place of Comparative Coupler (A) used in each of the third and fourth layers of Sample 101, an equimolar amount of Compound D-16 of general formula (II) according to the present invention was used in place of Comparative Coupler (B) used in each of the seventh and eighth layers of Sample 101, and an equimolar amount of Compound D-8 of general formula (I) according to the present invention was used in place of Comparative Coupler (B) used in each of the thirteenth and fourteenth layers of Sample 101.

Sample 104 was prepared in the same manner as Sample 102, except that an equimolar amount of Coupler YB-9 of general formula (2) according to the present invention was used in place of Comparative Coupler (1) used in the 13th layer of Sample 102, an equimolar amount of a 1:1 (by molar ratio) mixture of YB-9 and Y-29 of general formula (YI) was used in place of Comparative Coupler (1) used in the 14th layer of Sample 102, and an equimolar amount of Y-29 was used in place of Comparative Coupler (1) used in the 16th layer of Sample 102.

Sample 105 was prepared in the same manner as Sample 103, except that an equimolar amount of YB-10 was used in place of Comparative Coupler (1) used in the 13th layer of Sample 103, an equimolar amount of a 1:1 (by molar ratio) mixture of YB-10 and Y-29 was used in place of Comparative Coupler (1) used in the 14th layer of Sample 103, and an equimolar amount of Y-29 was used in place of Comparative Coupler (1) used in the 16th layer of Sample 103 as in the preparation of Sample 104 above.

Comparative Couplers (C) and (D) are the following compounds.

Comparative Coupler (C)

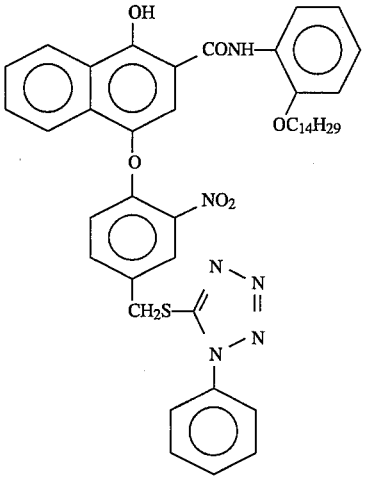

Comparative Coupler (D) described in JP-A-4-204940

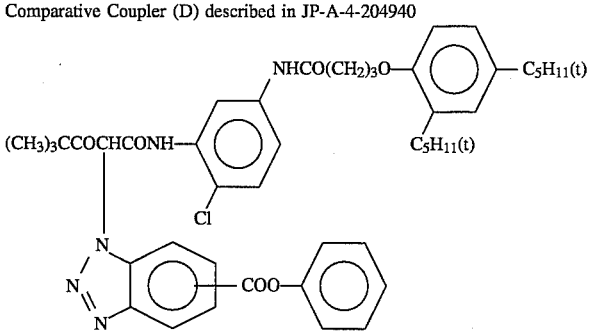

Samples 106 to 122 were prepared in the same manner as Sample 101, except that an equimolar amount of each of compounds of general formulas (I) and (II), couplers of general formulas (YI), (1) and (2) according to the present invention and Comparative Couplers (H) to (N) were used in place of Comparative Coupler (A) used in the 3rd and 4th layers, Comparative Coupler (B) used in the 7th, 8th, 13th and 14th layers and Comparative Coupler (1) used in the 13th, 14th and 16th layers of Sample 101 as shown in Table C below.

Comparative Couplers (H) to (N) are the following compounds.

Comparative Coupler (H) (compound similar to Coupler 32 disclosed in EP-A-354532)

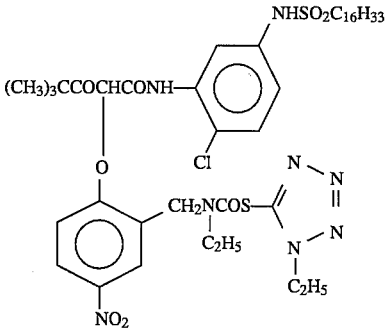

-continued

Comparative Coupler (I) (compound No. 6 disclosed in U.S. Patent 4,782,012)

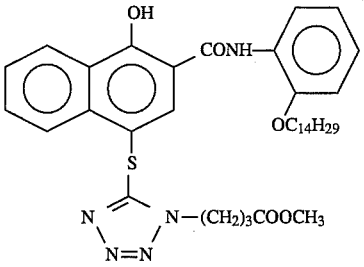

Comparative Coupler (J) (compound similar to Compound No. 11 disclosed in U.S. Patent 4,782,012)

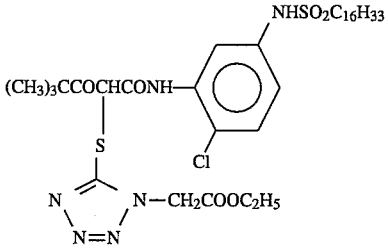

-continued
Comparative Coupler (K) (compound disclosed in U.S. Patent 3,227,554)
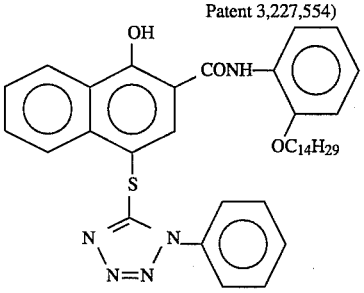
Comparative Coupler (L) (compound similar to [II-39] disclodsed in JP-A-59-149359)
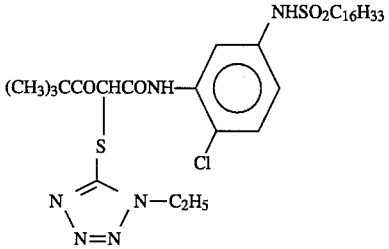
-continued
Comparative Coupler (M) (compound similar to that disclosed in EP-523, 423A1)
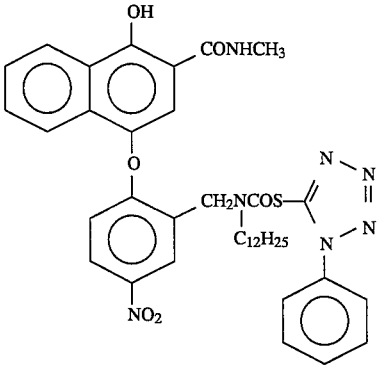
Comparative Coupler (N) (compound similar to Compound (10) disclosed in JP-B-63-776)
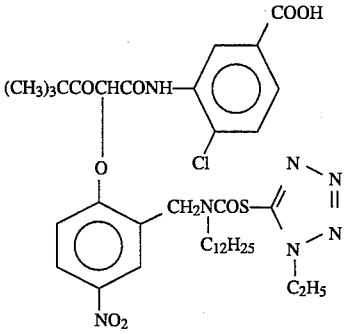

TABLE C

| Sample | Red-Sensitive Emulsion Layer | | Green-Sensitive Emulsion Layer | | Blue-Sensitive Emulsion Layer | | | | |
|---|---|---|---|---|---|---|---|---|---|
| No. | 3rd Layer | 4th Layer | 7th Layer | 8th Layer | 13th Layer | | 14th Layer | | 16th Layer |
| 101 (Comp. Ex.) | Comparative Coupler (A) | Comparative Coupler (A) | Comparative Coupler (B) | Comparative Coupler (B) | Comparative Coupler (1) | Comparative Coupler (B) | Comparative Coupler (1) | Comparative Coupler (8) | Comparative Coupler (1) |
| 102 (Comp. Ex.) | Comparative Coupler (C) | Comparative Coupler (C) | Comparative Coupler (C) | Comparative Coupler (C) | Comparative Coupler (1) | Comparative Coupler (D) | Comparative Coupler (1) | Comparative Coupler (D) | Comparative Coupler (D) |
| 103 (Comp. Ex.) | D-11 | D-11 | D-16 | D-16 | Comparative Coupler (1) | D-19 | Comparative Coupler (1) | D-19 | D-19 |
| 104 (Comp. Ex.) | Comparative Coupler (C) | Comparative Coupler (C) | Comparative Coupler (D) | Comparative Coupler (D) | YB-9 | Comparative Coupler (D) | Ya-9/Y-29 = 1/1 (molar ratio) | Comparative Coupler (D) | Y-29 |
| 105 (Invention) | D-11 = 1/1 | D-11 | D-16 | D-16 | YB-9 | D-19 | YB-9/Y-29 (molar ratio) | D-19 | Y-29 |
| 106 (Invention) | D-13 | D-13 | D-21 | D-21 | YB-10 | D-20 | Y-7 | D-20 | Y-11 |
| 107 (Invention) | D-2 | D-2 | D-18 | D-18 | YB-7 | D-17 | Y-9 | D-17 | Y-2 |
| 108 (Invention) | D-5 | D-5 | D-17 | D-17 | YB-2/YB-19 = 1/2 | D-12 | Ya-9 | D-12 | YB-13 |
| 109 (Invention) | D-6 | D-1 | D-19 | D-18 | Y-46 | D-26/Y-43 = 2/1 | Y-19 | D-21/YB-32 = 1/1 | YB-23 |
| 110 (Invention) | D-7/D-13 = 1/2 (molar ratio) | D-10/D-11 = 1/1 (molar ratio) | D-21/D-28 = 1/1 (molar ratio) | D-20/D-22 = 1/1 (molar ratio) | YB-6/YB-19 = 1/1 (molar ratio) | D-16/0-14 = 2/1 (molar ratio) | Y-16/Y-35 = 1/1 (molar ratio) | D-15/YB-33 = 1/2 (molar ratio) | YB-13/Y-29 = 1/2 (molar ratio) |
| 111 (Invention) | D-30 | D-30 | D-35 | D-37 | Y-46 | D-34 | Y-29 | D-33 | Y-29 |
| 112 (Invention) | D-I/D-31 = 1/1 (molar ratio) | D-11/D-31 = 1/1 (molar ratio) | D-38/D-41 = 1/1 (molar ratio) | D-17/D-43 = 2/1 (molar ratio) | Y-35 | D-32/D-37 = 1/2 (molar ratio) | Ye-11 | D-32/D-42 = 1/2 (molar ratio) | Y-23 |
| 113 (Invention) | D-17 | D-17 | D-17 | D-17 | YB-3 | D-12 | Y-2/Y-11 = 1/1 (molar ratio) | D-12 | Y-29 |
| 114 (Invention) | D-22 | D-37 | D-33 | D-18 | YB-3 | D-16 | Y-2/Y-11 = 1/1 (molar ratio) | D-17 | Y-29 |
| 115 (Invention) | D-21 | D-45 | D-16 | D-44 | YB-3 | D-34 | Y-2/Y-11 = 1/1 (molar ratio) | D-37 | Y-29 |
| 116 (Invention) | D-11 | D-11 | D-11 | D-11 | YB-3 | D-4 | Y-2/Y-11 = 1/1 (molar ratio) | D-4 | Y-29 |
| 117 (Invention) | D-30 | D-13 | D-6 | D-2 | YB-3 | D-8 | Y-2/Y-11 = 1/1 (molar ratio) | D-14 | Y-29 |
| 118 (Invention) | D-10 | D-1 | D-31 | D-13 | YB-3 | D-15 | Y-2/Y-11 = 1/1 (molar ratio) | D-9 | Y-29 |

TABLE C-continued

| Sample | Red-Sensitive Emulsion Layer | | Green-Sensitive Emulsion Layer | | Blue-Sensitive Emulsion Layer | | | | |
|---|---|---|---|---|---|---|---|---|---|
| No. | 3rd Layer | 4th Layer | 7th Layer | 8th Layer | 13th Layer | | 14th Layer | | 16th Layer |
| 119 (Comp. Ex.) | Comparative Coupler (A) | Comparative Coupler (A) | Comparative Coupler (A) | Comparative Coupler (A) | YB-3 | Comparative Coupler (B) | Y-2/Y-11 = 1/1 (molar ratio) | Comparative Coupler (H) | Y-29 |
| 120 (Comp. Ex.) | Comparative Coupler (I) | Comparative Coupler (I) | Comparative Coupler (I) | Comparative Coupler (I) | YB-3 | Comparative Coupler (J) | Y-2/Y-11 = 1/1 (molar ratio) | Comparative Coupler (J) | Y-29 |
| 121 (Comp. Ex.) | Comparative Coupler (K) | Comparative Coupler (K) | Comparative Coupler (K) | Comparative Coupler (K) | YB-3 | Comparative Coupler (L) | Y-2/Y-11 = 1/1 (molar ratio) | Comparative Coupler (L) | Y-29 |
| 122 (Comp. Ex.) | Comparative Coupler (M) | Comparative Coupler (M) | Comparative Coupler (M) | Comparative Coupler (M) | YB-3 | Comparative Coupler (N) | Y-2/Y-11 = 1/1 (molar ratio) | Comparative Coupler (M) | Y-29 |

Samples 101 to 122 were subjected to color development processing described below, and the following performances were examined.

(1) Photographic Characteristics

Samples 101 to 122 were subjected to gradation exposure to white light (4800° K.) and then color development processing. The density of each of three colors (B, G and R) of the processed samples was measured to obtain characteristic curves. The logarithm value of the reciprocal of an exposure amount providing a density of ($D_{min}$+0.2) is determined as the sensitivity (S) from the characteristic curve, and the relative value is calculated when the value of Sample 101 is referred to as 100. The results of the measurement of the B density are shown as $S_B$, G density as $S_G$ and R density as $S_R$ in Table D below.

The gradient of a straight line obtained by joining a point of an exposure amount providing a density of ($D_{min}$+0.3) to a point of an exposure amount providing a density of logE=1.5 on the high exposure amount side is referred to as γ (gamma) to determine the γ (gamma) values of three colors of B, G and R of each sample. The values are determined as $\gamma_{WR}$, $\gamma_{WG}$ and $\gamma_{WB}$. The relative γ (gamma) value is calculated when the value of Sample 101 is referred to as 1.00. The gamma values at the B density, G density and R density in terms of the relative value are shown in Table D below.

Samples 101 to 122 were exposed to light through a three color (B-G-R) separation filter, and then subjected to color development processing. The density of each sample was measured and the gamma value was determined from the characteristic curve in the above-described manner to obtain $\gamma_R$, $\gamma_G$ and $\gamma_B$. The ratios of the gamma values to the γ values ($\gamma_{WR}$, $\gamma_{WG}$, $\gamma_{WB}$) determined above from the samples subjected to gradation exposure to white light were calculated for each sample to examine the interlayer effect which is a criterion of the evaluation of color reproducibility. The gamma ratio ($\gamma_B/\gamma_{WB}$) of the B density, the gamma ratio ($\gamma_G/\gamma_{WG}$) of the G density and the gamma ratio ($\gamma_R/\gamma_{WR}$) of the R density are shown in Table D below. A value of greater than 1.00 means that the interlayer effect is greatly affected and color reproducibility is superior.

(2) Dye Image Preservability

The samples were subjected to gradation exposure to white light and then color development processing, and the density of each of B, G and R of the processed samples was measured. The samples were then stored at 60° C. and 70% RH for 5 weeks, and the density was again measured. The density after storage at a point of an exposure amount providing a density of ($D_{min}$+2.0) before storage under high temperature and humidity conditions was read, and a difference in the density was determined. A smaller difference in the density means that dye image fastness is higher and dye image preservability is better.

(3) Image Quality

The above samples subjected to gradation exposure through a B-G-R filter and then color development processing were exposed to light through a B filter. The density of the resulting yellow dye image was measured as B and G density. The G density ($G_1$) at a point of an exposure amount providing a B density of 2.0 was determined from the resulting characteristic curve. A value $\Delta B_G$ is calculated by subtracting the G density ($G_2$) of the minimum density area in the B density from $G_1$ and referred to as another criterion of the evaluation of color reproducibility.

Further, the density of the resulting magenta dye image obtained through a G filter was measured as G and R density. The R density ($R_1$) at a point of an exposure amount providing a G density of 2.0 was determined from the resulting characteristic curve. A value is calculated by subtracting the R density ($R_2$) of the minimum density area in the G density from $R_1$. The difference between the value thus obtained for each Sample and a value of ($R_1$–$R_2$) obtained in Sample 101 was referred to the evaluation of color reproducibility.

The coating weight of the each light-sensitive emulsion layer was controlled so that each gradation in the blue dye image area, green dye image area and red dye image area of Samples 101 to 122 became the same, thereby re-preparing samples. MTF patterns were exposed to white light in a conventional manner by using the resulting samples, and the samples were processed. The MTF value of yellow dye image in 40 cycle/mm at a density of ($D_{min}$+1.0) was measured to examine sharpness.

Processing was carried out in the following stages with the following processing solutions.

Samples which were separately imagewise exposed to light were processed (running processing) 1 $m^2$ by 1 $m^2$ per day until the amount of the replenisher of the color developing solution reached three times as large as the tank capacity, and processing was then carried out.

| Processing Stage | | | | |
|---|---|---|---|---|
| Stage | Time | Temp. (°C.) | Replenishment Rate (ml) | Tank Capacity (l) |
| Color Development | 3 min 5 sec | 38.0 | 23 | 2 |
| Bleaching | 50 sec | 38.0 | 5 | 5 |
| Bleaching-Fixing | 50 sec | 38.0 | — | 5 |
| Fixing | 50 sec | 38.0 | 16 | 5 |
| Rinse | 30 sec | 38.0 | 34 | 3.5 |
| Stabilization (1) | 20 sec | 38.0 | — | 3 |
| Stabilization (2) | 20 sec | 38.0 | 20 | 3 |
| Drying | 1 min 30 sec | 60 | | |

*Replenishment rate being per 1.1 m long by 35 mm wide of the photographic material (corresponding to one 24 Ex.)

The flow of the stabilizing solution was made by a countercurrent system. All of the overflow solution of rinsing water was introduced into the fixing bath. The bleaching-fixing bath was replenished in the following manner. A notch was provided at the upper part of the bleaching tank of the automatic processor and at the upper part of the fixing tank thereof so that all the overflow solution produced by the feed of the replenishers to the bleaching tank and the fixing tank was allowed to flow into the bleaching-fixing bath. The amount of the developing solution brought into the bleaching stage, that of the bleaching solution brought into the bleaching-fixing stage, that of the bleaching-fixing solution brought into the fixing stage, and that of the fixing solution brought into the rinsing stage were 2.5 ml, 2.0 ml, 2.0 ml and 2.0 ml, respectively, each amount being per 1.1 m long by 35 mm wide of the photographic material. Cross-over time was 6 seconds in each stage. The cross-over time was included within the processing time of the prestage.

The processing solutions had the following compositions.

| Color Developing Solution | | |
|---|---|---|
| | Tank Solution (g) | Replenisher (g) |
| Diethylenetriamine- | 2.0 | 2.0 |

-continued

| Color Developing Solution | Tank Solution (g) | Replenisher (g) |
|---|---|---|
| pentaacetic Acid | | |
| 1-Hydroxyethylidene-1,1-diphosphonic Acid | 2.0 | 2.0 |
| Sodium Sulfite | 3.9 | 5.1 |
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | 3.3 |
| 2-Methyl-4-[N-ethyl-N-(β-hydroxylethyl)amino]aniline Sulfate | 4.5 | 6.0 |
| Water to make | 1.0 l | 1.0 l |
| pH (adjusted with potassium hydroxide and sulfuric acid) | 10.05 | 10.15 |

| Bleaching Solution | Tank Solution (g) | Replenisher (g) |
|---|---|---|
| Ammonium 1,3-Diaminopropane-tetraacetato Ferrate Monohydrate | 130 | 195 |
| Ammonium Bromide | 70 | 105 |
| Ammonium Nitrate | 14 | 21 |
| Hydroxyacetic Acid | 50 | 75 |
| Acetic Acid | 40 | 60 |
| Water to make | 1.0 l | 1.0 l |
| pH (adjusted with ammonia water) | 4.4 | 4.4 |

Bleaching-Fixing Solution

A 15:85 (by volume) mixture of the above bleaching solution (tank solution) and the following fixing solution (tank solution) (pH 7.0).

| Fixing Solution | Tank Solution (g) | Replenisher (g) |
|---|---|---|
| Ammonium Sulfite | 19 | 57 |
| Aqueous Solution of Ammonium Thiosulfate (700 g/liter) | 280 ml | 840 ml |
| Imidazole | 15 | 45 |
| Ethylenediaminetetraacetic Acid | 15 | 45 |
| Water to make | 1.0 l | 1.0 l |
| pH (adjusted with ammonia water and acetic acid) | 7.4 | 7.45 |

Rinsing Water

Tap water was passed through a mixed bed column packed with an H type strongly acidic cation exchange resin (Amberlite IR-120B, a product of Rohm & Hass Co.) and an OH type strongly basic anion exchange resin (Amberlite IR-400) to thereby reduce the concentration of each of the calcium ion and the magnesium ion to 3 mg/liter or below. Subsequently, sodium dichlorinated iso-cyanurate (20 mg/liter) and sodium sulfate (150 mg/liter). The pH of the solution was in the range of 6.5 to 7.5.

Stabilizing Solution

Tank solution and replenisher being the same.

| Stabilizing Solution<br>Tank solution and replenisher being the same. | Amount (g) |
|---|---|
| Sodium p-Toluenesulfinate | 0.03 |
| Polyoxyethylene p-Monononylphenyl Ether (an average degree of polymerization: 10) | 0.2 |
| Disodium Ethylenediaminetetraacetate | 0.05 |
| 1,2,4-Triazole | 1.3 |
| 1,4-Bis(1,2,4-triazole-l-ylmethyl)-piperazine | 0.75 |
| Water to make | 1.0 l |
| pH | 8.5 |

The results obtained by conducting the above Tests (1) to (3) are shown in Table 4 below.

TABLE D-1

| | Photographic Characteristics | | | | Image Quality | |
|---|---|---|---|---|---|---|
| Sample No. | Sensitivity ($S_B$) | Gradation (relative γ) | γ Ratio ($\gamma_B/\gamma_{WB}$) | Dye Image Fastness | Color Reproducibility | MTF value (40 cycle/mm) |
| 101 (Comp. Ex.) | 100 (standard) | 1.00 (standard) | 1.07 | 0.18 | 0.08 | 0.41 |
| 102 (Comp. Ex.) | 100 | 1.01 | 1.09 | 0.16 | 0.08 | 0.39 |
| 103 (Comp. Ex.) | 101 | 1.03 | 1.10 | 0.15 | 0.06 | 0.43 |
| 104 (Comp. Ex.) | 104 | 1.07 | 1.11 | 0.15 | 0.06 | 0.41 |
| 105 (Invention) | 112 | 1.20 | 1.15 | 0.06 | 0.04 | 0.46 |
| 106 (Invention) | 111 | 1.18 | 1.15 | 0.06 | 0.04 | 0.45 |
| 107 (Invention) | 113 | 1.23 | 1.16 | 0.06 | 0.04 | 0.46 |
| 108 (Invention) | 110 | 1.17 | 1.15 | 0.06 | 0.04 | 0.45 |
| 109 (Invention) | 112 | 1.21 | 1.15 | 0.05 | 0.04 | 0.46 |
| 110 (Invention) | 112 | 1.22 | 1.16 | 0.05 | 0.04 | 0.46 |
| 111 (Invention) | 112 | 1.23 | 1.15 | 0.06 | 0.04 | 0.46 |
| 112 (Invention) | 112 | 1.22 | 1.16 | 0.05 | 0.04 | 0.46 |

TABLE D-2

| | G | | | | | | R | | | | |
|---|---|---|---|---|---|---|---|---|---|---|---|
| | Photographic Characteristics | | | Dye | Image Quality | | Photographic Characteristics | | | Dye | MTF value |
| Sample No. | Sensitivity ($S_G$) | Gradation (relative γ) | γ Ratio ($\gamma_G/\gamma_{WG}$) | Image Fastness | Color Reproducibility | MTF value (40 cycle/mm) | Sensitivity ($S_R$) | Gradation (relative γ) | γ Ratio ($\gamma_R/\gamma_{WR}$) | Image Fastness | (40 cycle/mm) |
| 101 (Comp. Ex.) | 100 (standard) | 1.00 (standard) | 1.09 | 0.08 | 0.00 (standard) | 0.29 | 100 (standard) | 1.00 (standard) | 1.08 | 0.06 | 0.19 |
| 102 (Comp. Ex.) | 101 | 0.98 | 1.07 | 0.08 | 0.05 | 0.28 | 101 | 0.98 | 1.06 | 0.06 | 0.18 |
| 103 (Comp. Ex.) | 108 | 1.05 | 1.12 | 0.06 | 0.00 | 0.31 | 105 | 1.04 | 1.13 | 0.05 | 0.21 |
| 104 (Comp. Ex.) | 101 | 0.98 | 1.08 | 0.08 | 0.00 | 0.29 | 101 | 0.98 | 1.06 | 0.06 | 0.18 |
| 105 (Invention) | 114 | 1.08 | 1.23 | 0.04 | −0.01 | 0.37 | 108 | 1.08 | 1.18 | 0.04 | 0.23 |
| 106 (Invention) | 113 | 1.08 | 1.21 | 0.04 | −0.01 | 0.36 | 108 | 1.08 | 1.18 | 0.04 | 0.23 |
| 107 (Invention) | 112 | 1.10 | 1.20 | 0.04 | −0.01 | 0.35 | 110 | 1.10 | 1.20 | 0.04 | 0.24 |
| 108 (Invention) | 114 | 1.07 | 1.22 | 0.04 | −0.01 | 0.36 | 107 | 1.07 | 1.17 | 0.04 | 0.22 |
| 109 (Invention) | 112 | 1.10 | 1.20 | 0.04 | −0.01 | 0.35 | 108 | 1.09 | 1.18 | 0.04 | 0.23 |
| 110 (Invention) | 113 | 1.08 | 1.21 | 0.04 | 0.00 | 0.36 | 107 | 1.07 | 1.17 | 0.04 | 0.22 |
| 111 (Invention) | 113 | 1.09 | 1.20 | 0.04 | −0.01 | 0.36 | 109 | 1.09 | 1.19 | 0.04 | 0.23 |
| 112 (Invention) | 113 | 1.08 | 1.22 | 0.04 | −0.01 | 0.36 | 108 | 1.08 | 1.18 | 0.04 | 0.24 |

TABLE D-3

| | Photographic Characteristics | | | | Image Quality | |
|---|---|---|---|---|---|---|
| Sample No. | Sensitivity ($S_B$) | Gradation (relative γ) | γ Ratio ($\gamma_B/\gamma_{WB}$) | Dye Image Fastness | Color Reproducibility | MTF value (40 cycle/mm) |
| 113 (Invention) | 116 | 1.27 | 1.18 | 0.05 | 0.04 | 0.47 |
| 114 (Invention) | 117 | 1.27 | 1.20 | 0.05 | 0.04 | 0.48 |
| 115 (Invention) | 116 | 1.27 | 1.18 | 0.05 | 0.04 | 0.47 |
| 116 (Invention) | 107 | 1.13 | 1.12 | 0.07 | 0.04 | 0.42 |
| 117 (Invention) | 108 | 1.13 | 1.13 | 0.07 | 0.05 | 0.42 |
| 118 (Invention) | 108 | 1.13 | 1.13 | 0.07 | 0.05 | 0.42 |
| 119 (Comp. Ex.) | 106 | 1.10 | 1.09 | 0.11 | 0.06 | 0.40 |
| 120 (Comp. Ex.) | 104 | 1.08 | 1.07 | 0.11 | 0.06 | 0.39 |
| 121 (Comp. Ex.) | 102 | 1.05 | 1.04 | 0.11 | 0.06 | 0.41 |
| 122 (Comp. Ex.) | 105 | 1.09 | 1.08 | 0.09 | 0.05 | 0.39 |

TABLE D-4

| | G | | | | | | R | | | | |
|---|---|---|---|---|---|---|---|---|---|---|---|
| | Photographic Characteristics | | | Dye | Image Quality | | Photographic Characteristics | | | Dye | MTF value |
| Sample No. | Sensitivity ($S_G$) | Gradation (relative γ) | γ Ratio ($\gamma_G/\gamma_{WG}$) | Image Fastness | Color Reproducibility | MTF value (40 cycle/mm) | Sensitivity ($S_R$) | Gradation (relative γ) | γ Ratio ($\gamma_R/\gamma_{WR}$) | Image Fastness | (40 cycle/mm) |
| 113 (Invention | 118 | 1.23 | 1.26 | 0.04 | −0.01 | 0.37 | 121 | 1.21 | 1.31 | 0.03 | 0.29 |
| 114 (Invention | 118 | 1.24 | 1.25 | 0.04 | −0.01 | 0.37 | 122 | 1.21 | 1.32 | 0.03 | 0.30 |
| 115 (Invention | 119 | 1.24 | 1.27 | 0.04 | −0.01 | 0.38 | 121 | 1.20 | 1.30 | 0.03 | 0.29 |
| 116 (Invention | 108 | 1.06 | 1.13 | 0.05 | 0.04 | 0.32 | 105 | 1.05 | 1.15 | 0.04 | 0.24 |
| 117 (Invention | 108 | 1.06 | 1.13 | 0.05 | 0.04 | 0.32 | 106 | 1.06 | 1.16 | 0.04 | 0.24 |
| 118 (Invention | 109 | 1.06 | 1.14 | 0,05 | 0.04 | 0.33 | 105 | 1.05 | 1.16 | 0.04 | 0.24 |
| 119 (Comp. Ex.) | 102 | 1.02 | 1.09 | 0.09 | 0.05 | 0.30 | 100 | 1.00 | 1.08 | 0.06 | 0.19 |
| 120 (Comp. Ex.) | 98 | 0.97 | 1.07 | 0.08 | 0.05 | 0.28 | 97 | 0.96 | 1.05 | 0.06 | 0.18 |
| 121 (Comp. Ex.) | 95 | 0.94 | 1.05 | 0.08 | 0.05 | 0.27 | 94 | 0.93 | 1.03 | 0.06 | 0.17 |
| 122 (Comp. Ex.) | 102 | 1.03 | 1.08 | 0.07 | 0.00 | 0.29 | 102 | 1.01 | 1.10 | 0.05 | 0.20 |

It is apparent from the results shown in Table D that, as to B density, Samples 105 to 118 containing the acylacetamide coupler of general formula (YI) and/or a coupler of general formulas (1) and (2), and/or coupler of general formula (I) or (II) provide a high sensitivity and a high color density, are excellent in dye image fastness, have a high interlayer effect, give high-purity dye images, are excellent in color reproducibility and sharpness, and provide a good image quality of sharpness in comparison with comparative Samples 101 to 104 and 119 to 122.

It is also apparent from the results shown in Table D that, as to G density and R density, Samples of the present invention containing compound of general formula (1) or (2) provide excellent photographic performances disclosed above, excellent dye image fastness and good image quality in the same way disclosed above.

Particularly, it is also apparent from the results of practical Samples 113 to 115 and 116 to 118 using compounds of formula (I) and (II) used in Samples 105 to 118 that, of compounds represented by formula (I) and (II), a compound ($A_2$) having no nondiffusing group at a position of mother nucleus moiety of coupler shown by formula (II) provides excellent photographic performances disclosed above and remarkable improvement in dye image fastness and image quality, in comparison with a compound ($A_1$) having nondiffusing group at a position of mother nucleus moiety of coupler shown by formula (I).

Compound of formula (II) makes a coupling reaction with an oxidant of color developer to release (TIME)a-DI, and simultaneously $A_2$ produces dye and then flows out from a film layer of photographic material to provide an effect that $A_2$ does not remain in a photographic material, since $A_2$ has no nondiffusing group, which is an advantage provided by using compound of formula (II) which releases A2 having any of cyan, yellow and magenta mother nucleus moiety of coupler. For the reason, compound of formula (II) is advantageously used in any color-sensitive layers with no limitation in amount thereof and with no deterioration of reproducibility.

EXAMPLE 2

Samples 101 to 122 of Example 1 were processed in the same manner as in Example 1, except that the composition of the color developing solution used in Example 1 was changed as described below, the processing temperature was 43.0° C., and the replenishment rate was 100 ml/m$^2$. The samples were processed with an automatic developing machine for one Sample and the performances thereof were evaluated in the same manner as in Example 1.

| Color Developing Solution | | |
|---|---|---|
| | Tank Solution (g) | Replenisher (g) |
| Diethylenetriamine-pentaacetic Acid | 2.0 | 4.0 |
| 1-Hydroxyethylidene-1,1-diphosphonic Acid | 2.0 | 2.0 |
| Sodium Sulfite | 3.9 | 6.0 |
| Potassium Carbonate | 37.5 | 39.0 |

-continued

| Color Developing Solution | Tank Solution (g) | Replenisher (g) |
|---|---|---|
| Potassium Bromide | 5.5 | — |
| Potassium Iodide | 1.3 mg | — |
| Hydroxylamine Sulfate | 4.0 | 6.0 |
| 2-Methyl-4-[N-ethyl-N-(β-hydroxylethyl)amino]aniline Sulfate | 10.0 | 19.0 |
| Water to make | 1.0 l | 1.0 l |
| pH (adjusted with potassium hydroxide and sulfuric acid) | 10.05 | 12.0 |

Color developing processing was carried out using the color developing solution disclosed above under high temperature conditions with a low replenishment rate as described above. It was found that Samples 105 to 118 of the present invention give the same results as those obtained in Example 1, provide excellent photographic characteristics, dye image preservability and image quality and have stable processability.

On the other hand, when the results of comparative Samples 101 to 104, 119, 121 and 122 are compared with those obtained in Example 1, photographic sensitivity and gradation are slightly lowered (−0.05), gamma values are low (−0.08), dye image preservability is slightly deteriorated (−0.02 to −0.01), the interlayer effect and sharpness are equal to those of Example 1 or are slightly lowered (−0.02), and a fluctuation in performances with the change of processing is found.

From the above results, it is apparent that DI of compound represented by the general formulas (I) and (II) is deactivated after processing, thereby stable photographic performances, excellent color image fastness and high image-quality can be obtained after running processing.

EXAMPLE 3

The following layers having the following compositions were coated on a PEN [2,6-naphthalenedicarboxylic acid/ethylene glycol (100/100 by mol)] support of 85 μm in thickness which was provided with a subbing layer and heat-treated.

The coating weights of the additives are represented by g/m$^2$. The coating weights of the silver halide emulsions and colloidal silver are represented by g/m$^2$ in terms of silver. The amounts of the sensitizing dyes are represented by moles per one mole of silver halide.

| Composition of Light-Sensitive Layer | |
|---|---|
| First Layer (antihalation layer) | |
| Black Colloidal Silver | 0.3 |
| Gelatin | 1.0 |
| Ultraviolet Light Absorber UV-I | 0.1 |
| Ultraviolet Light Absorber UV-II | 0.1 |
| Ultraviolet Light Absorber UV-III | 0.1 |
| Dispersion Oil Oil-1 | 0.2 |
| Dispersion Oil Oil-2 | 0.1 |
| Second Layer (interlayer) | |
| Gelatin | 1.0 |
| Coupler C-2 | 0.02 |
| Dispersion Oil Oil-1 | 0.01 |

-continued

| Composition of Light-Sensitive Layer | |
|---|---|
| Third Layer (low-sensitivity red-sensitive emulsion layer) | |
| Monodisperse Silver Iodobromide Emulsion (silver iodide content: 3 mol %; mean grain size: 1.0 μm) | 1.8 |
| Gelatin | 1.2 |
| Sensitizing Dye I | $1.4 \times 10^{-4}$ |
| Sensitizing Dye II | $7 \times 10^{-5}$ |
| Coupler C-1 | 0.5 |
| Coupler C-2 | 0.05 |
| Comparative Coupler (E) | 0.04 |
| Compound D | 0.1 |
| Dispersion Oil Oil-3 | 0.03 |
| Dispersion Oil Oil-4 | 0.05 |
| Fourth Layer (interlayer) | |
| Gelatin | 1.0 |
| Compound A | 0.1 |
| Fifth Layer (low-sensitivity green-sensitive emulsion layer) | |
| Monodisperse Silver Iodobromide Emulsion (silver iodide content: 3 mol %; mean grain size: 1.0 μm) | 1.4 |
| Monodisperse Silver Iodobromide Emulsion (silver iodide content: 3 mol %; mean grain size: 0.3 μm) | 0.3 |
| Gelatin | 0.8 |
| Sensitizing Dye III | $3 \times 10^{-4}$ |
| Sensitizing Dye IV | $1 \times 10^{-4}$ |
| Sensitizing Dye V | $1 \times 10^{-4}$ |
| Coupler C-3 | 0.4 |
| Coupler C-4 | 0.1 |
| Coupler C-5 | 0.1 |
| Coupler C-6 | 0.3 |
| Comparative Coupler (F) | 0.05 |
| Coupler C-11 | 0.08 |
| Compound C | 0.1 |
| Dispersion Oil Oil-3 | 0.3 |
| Dispersion Oil Oil-5 | 0.2 |
| Sixth Layer (interlayer) | |
| Gelatin | 1.0 |
| Compound A | 0.1 |
| Seventh Layer (low-sensitivity blue-sensitive emulsion layer) | |
| Monodisperse Silver Iodobromide Emulsion (silver iodide content: 3 mol %; mean grain size: 1.0 μm) | 0.7 |
| Monodisperse Silver Iodobromide Emulsion (silver iodide content: 3 mol %; mean grain size: 0.3 μm) | 0.2 |
| Gelatin | 1.0 |
| Sensitizing Dye VI | $2 \times 10^{-4}$ |
| Sensitizing Dye VII | $2 \times 10^{-4}$ |
| Comparative Coupler (2) | 0.73 |
| Comparative Coupler (3) | 0.38 |
| Comparative Coupler (G) | 0.05 |
| Dispersion Oil Oil-1 | 0.20 |
| Dispersion Oil Oil-5 | 0.10 |
| Eighth Layer (interlayer) | |
| Gelatin | 1.0 |
| Compound B | 0.1 |
| Ninth Layer (high-sensitivity red-sensitive emulsion layer) | |
| Polydisperse Silver Iodobromide Emulsion (silver iodide content: 6 mol %; mean grain size: 2.0 μm) | 2.3 |
| Gelatin | 1.2 |
| Sensitizing Dye I | $7 \times 10^{-5}$ |
| Sensitizing Dye II | $2 \times 10^{-5}$ |
| Coupler C-8 | 0.15 |
| Coupler C-1 | 0.15 |

-continued

| Composition of Light-Sensitive Layer | |
|---|---|
| Comparative Coupler (E) | 0.03 |
| Compound D | 0.1 |
| B-32 | $5.0 \times 10^{-3}$ |
| Dispersion Oil Oil-4 | 0.2 |
| Tenth Layer (interlayer) | |
| Gelatin | 1.0 |
| Coupler C-5 | 0.2 |
| Compound A | 0.1 |
| Eleventh Layer (high sensitivity green-sensitive emulsion layer) | |
| Polydisperse Silver Iodobromide Emulsion (silver iodide content: 5 mol %; mean grain size: 2.0 μm) | 2.0 |
| Gelatin | 1.0 |
| Sensitizing Dye III | $1 \times 10^{-4}$ |
| Sensitizing Dye IV | $3 \times 10^{-5}$ |
| Sensitizing Dye V | $3 \times 10^{-5}$ |
| Coupler C-6 | 0.04 |
| Coupler C-9 | 0.18 |
| Coupler C-10 | 0.04 |
| Comparative Coupler (F) | 0.03 |
| B-14 | $1.0 \times 10^{-2}$ |
| Compound C | 0.1 |
| Dispersion Oil Oil-1 | 0.40 |
| Dispersion Oil Oil-5 | 0.05 |
| Twelfth Layer (interlayer) | |
| Gelatin | 1.2 |
| Compound A | 0.1 |
| Thirteenth Layer (high-sensitivity blue-sensitive emulsion layer) | |
| Monodisperse Silver Iodobromide Emulsion (silver iodide content: 3 mol %; mean grain size: 2.1 μm) | 1.8 |
| Monodisperse Silver Iodobromide Emulsion (silver iodide content: 3 mol %; mean grain size: 1.2 μm) | 0.5 |
| Monodisperse Silver Iodobromide Emulsion (silver iodide content: 3 mol %; mean grain size: 0.3 μm; cubic) | 0.2 |
| Gelatin | 1.2 |
| Sensitizing Dye VI | $3 \times 10^{-4}$ |
| Sensitizing Dye VII | $1 \times 10^{-4}$ |
| Comparative Coupler (2) | 0.32 |
| Comparative Coupler (G) | 0.02 |
| B-16 | $1.5 \times 10^{-2}$ |
| Dispersion Oil Oil-1 | 0.11 |
| Fourteenth Layer (first protective layer) | |
| Coupler C-7 | 0.1 |
| Ultraviolet Light Absorber UV-I | 0.05 |
| Ultraviolet Light Absorber UV-II | 0.05 |
| Ultraviolet Light Absorber UV-III | 0.05 |
| Ultraviolet Light Absorber UV-IV | 0.05 |
| Ultraviolet Light Absorber UV-V | 0.05 |
| Gelatin | 0.6 |
| Dispersion Oil Oil-4 | 0.1 |
| Fifteenth Layer (second protective layer) | |
| Gelatin | 0.5 |
| Polymethyl methacrylate particles (diameter: 1.5 μm) | 0.2 |

Compounds used in this Example are as follows.

(C-1)

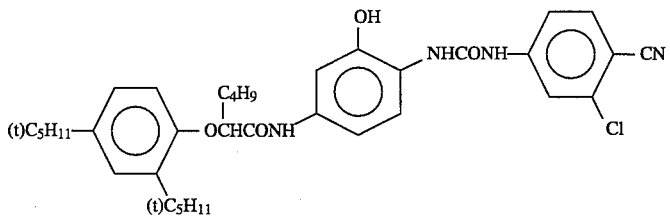

(C-2)

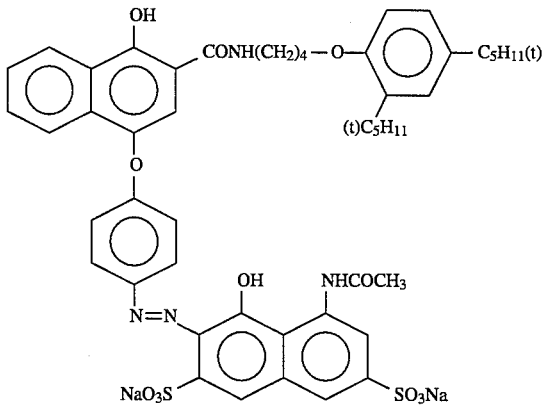

-continued
(C-3)
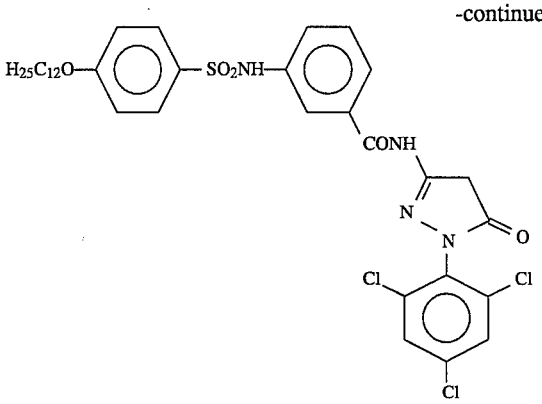
(C-4)
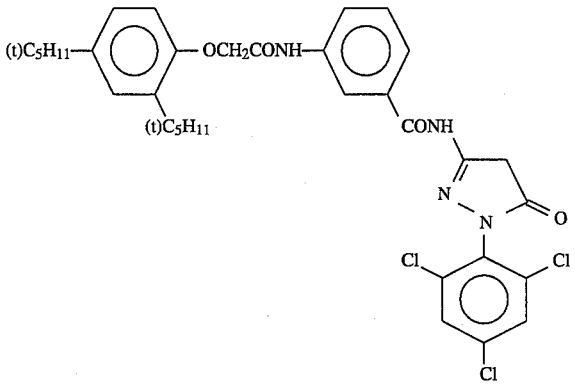
(C-5)
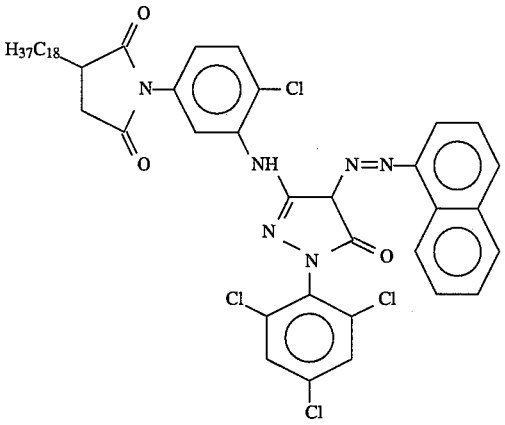
(C-6)
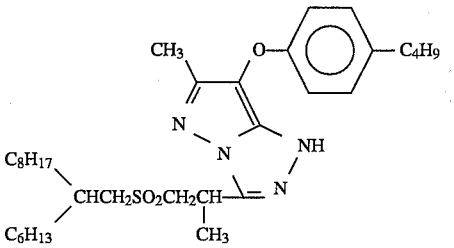
(C-7)
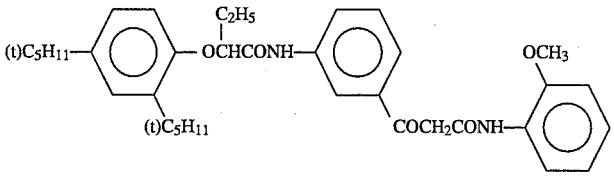

-continued
(C-8)
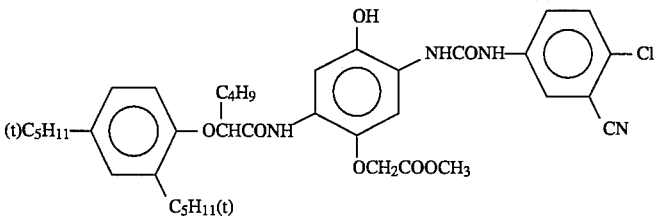
(C-9)
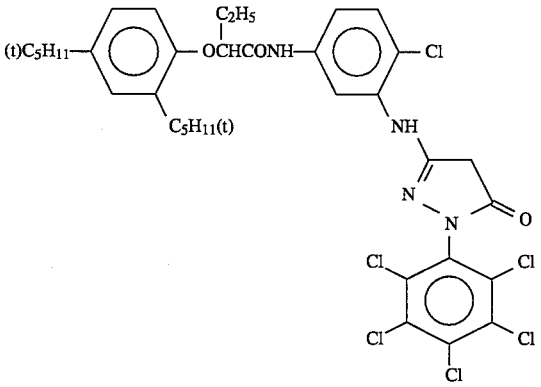
(C-10)
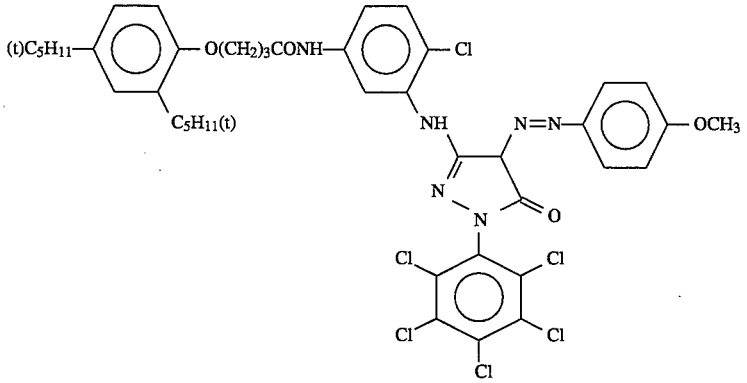
(C-11)
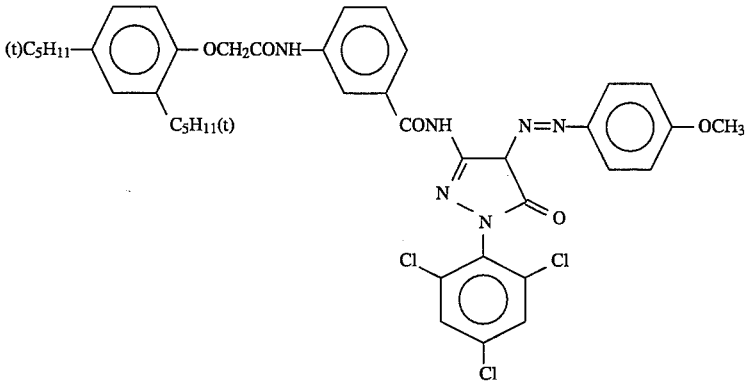

-continued
Comparative Coupler (2)
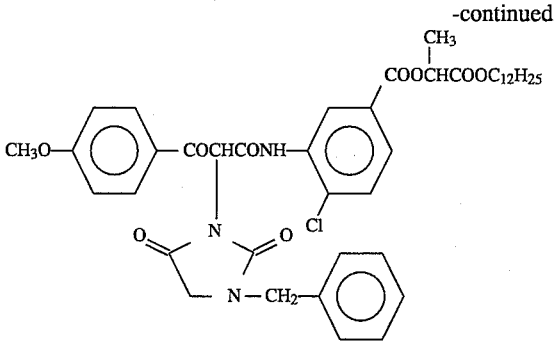
Comparative Coupler (3)
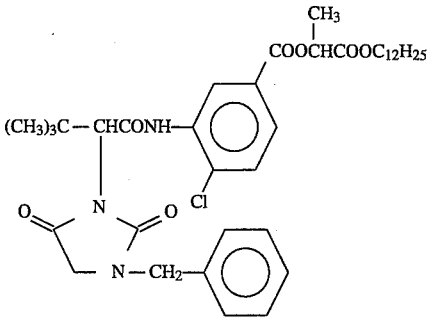
Comparative Coupler (E)
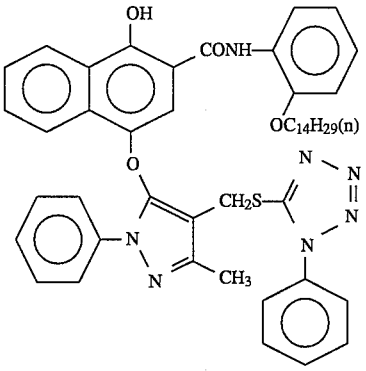
described in U.S. Pat. No. 4,421,845
Comparative Coupler (F)
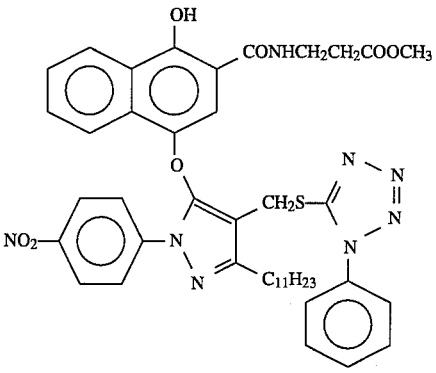
described in JP-A-63-037350

-continued
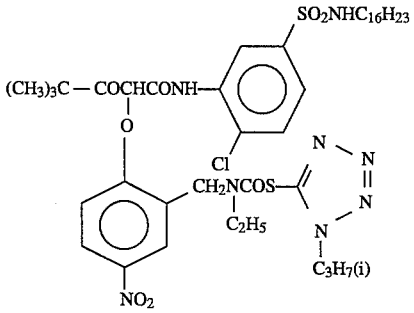
Comparative Coupler (g)
described in EP No. 354,532A
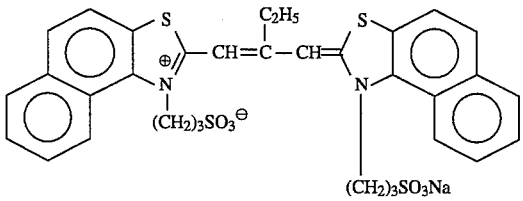
Sensitizing Dye I
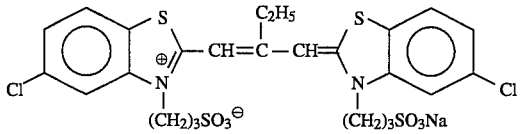
Sensitizing Dye II
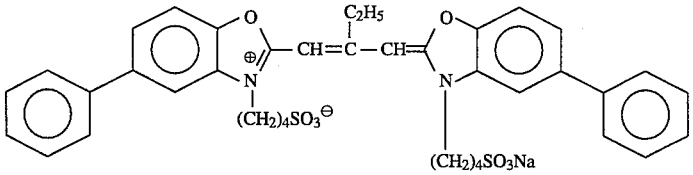
Sensitizing Dye III
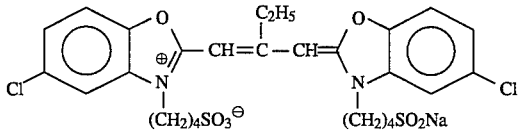
Sensitizing Dye IV
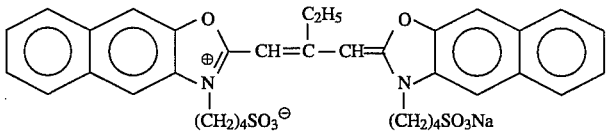
Sensitizing Dye V
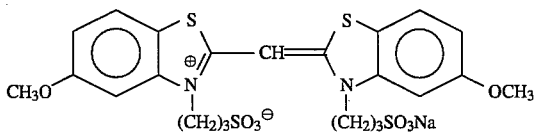
Sensitizing Dye VI
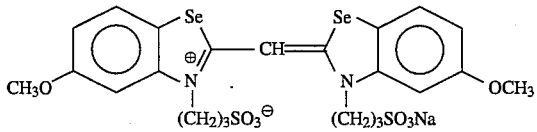
Sensitizing Dye VII
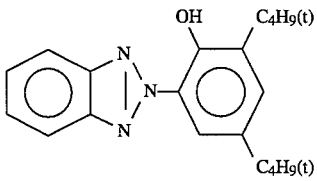
(UV-1)

-continued
(UV-II)
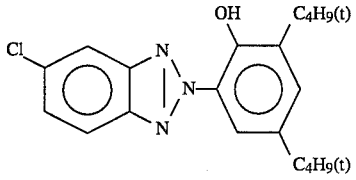
(UV-III)
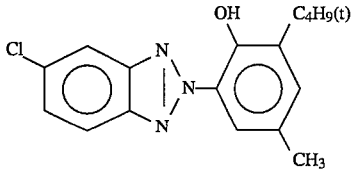
(UV-IV)
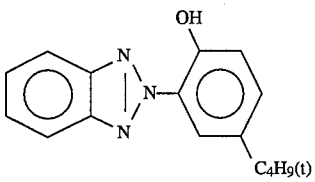
(UV-V)
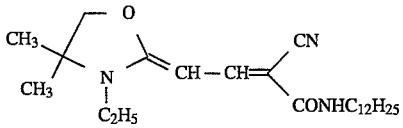
(Oil-1)
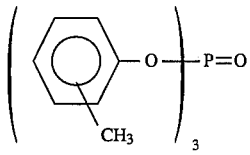
(Oil-2)
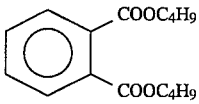
(Oil-3)
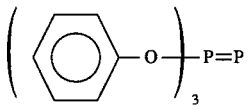
(Oil-4)
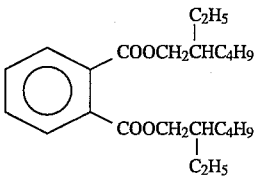
(Oil-5)
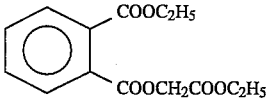
Compound A
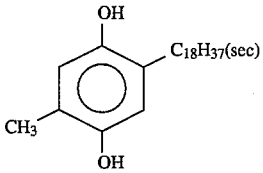

-continued
Compound B
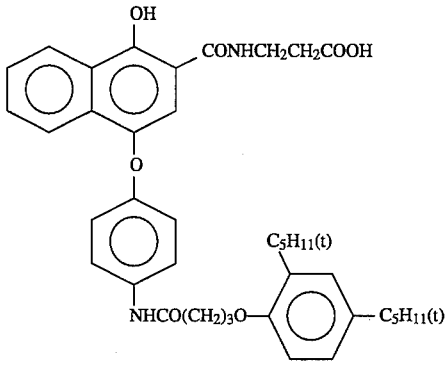
Compound C
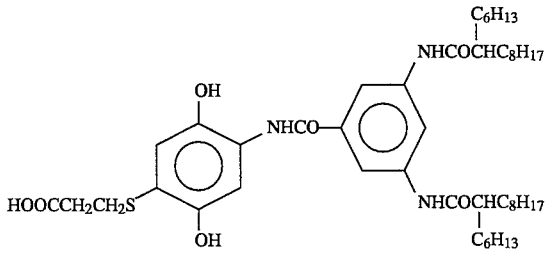
Compound D
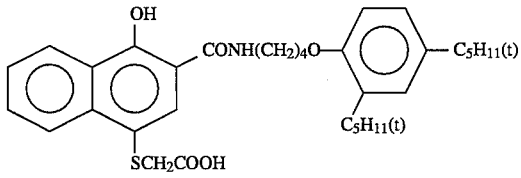
(W-I)
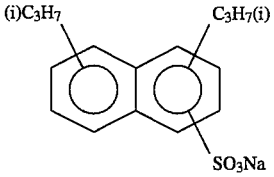
(W-II)
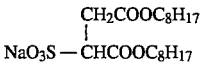
(H-1)
$[(CH_2{=}CHSO_2CH_2)_3CCH_2SO_2(CH_2)_3]_2N(CH_2)_2SO_3K$ and
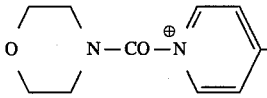
1:1 Mixture (by mol)
Formalin Scavenger
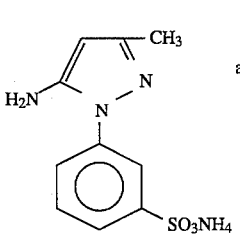
and
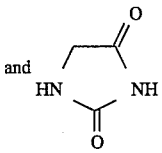
2:1 Mixture (by weight)
(ST-1)
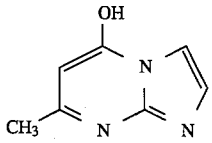

-continued

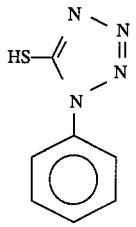

(AF-1)

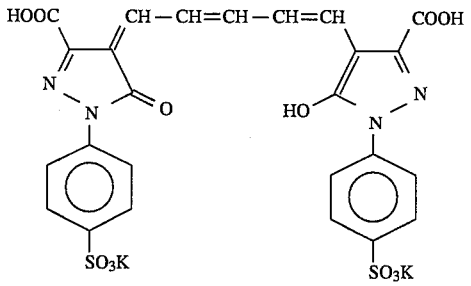

(AI-1)

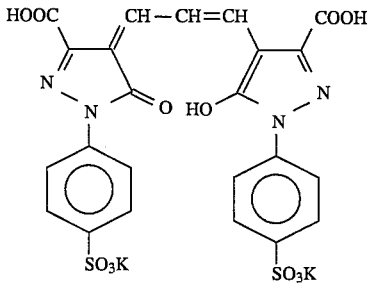

(AI-2)

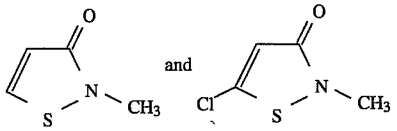

(DI-1)

1:1 Mixture (by mol)

Surfactants W-I and W-II, hardening agent H-1 and DI-1, in addition to the above-described ingredients, were added to each layer. Further, ST-1 and AF-1 were added to the light-sensitive layers, AI-1 was added to the third layer, and AI-2 was added to the fifth layer. Furthermore, the formalin scavenger was added to the 15th layer. The resulting sample is referred to as Sample 301.

Tabular non-light-sensitive fine silver halide grains of pure silver bromide having an average aspect ratio of 4.0, and a mean grain size of 0.15 μm, and tabular non-light-sensitive fine silver halide grains having a mean grain size of 0.20 μm and a mean grain size of 0.25 μm, and an average aspect ratio of 4.0 composed of silver iodobromide grains (silver iodide content: 2 mol %) each were prepared by the controlled double jet process. Grains having a mean grain size of 0.25 μm were coated in such an amount as to give a coating weight of 0.30 g/m$^2$ in the 8th layer (interlayer) of the above multi-layer color photographic material, grains having a mean grain size of 0.20 μm were coated in such an amount as to give a coating weight of 0.25 g/m$^2$ in the tenth layer, and grains having a mean grain size of 0.15 μm were coated in such an amount as to give a coating weight of 0.20 g/m$^2$ in the 12th layer, and fine grains of cubic silver iodobromide having a mean grain size of 0.3 μm in the 7th layer were replaced with an equal weight of the tabular grains to prepare a multilayer color photographic material as Sample 302.

Sample 303 was prepared in the same manner as Sample 301, except that the fine grains of non-sensitive silver halides in an equal weight were used in the 8th, 10th and 12th layers of Sample 301. The mean grain sizes used in these layers were the same as those used in Sample 302, but the crystal form of the grains was cubic.

Sample 334 was prepared in the same manner as Sample 301, except that 0.2 g of the monodisperse silver iodobromide emulsion (silver iodide content: 3 mol %; mean grain size: 0.3 μm) used in each of the 7th and 13th layers (blue-sensitive emulsion layer) was omitted.

Further, Samples 305 to 308 were prepared in the same manner as Samples 301 to 304, except that a 1:1 (by mol) mixture of D-11 and D-30 according to the present invention was used in place of Comparative Coupler (E) in each of the 3rd and 9th layers of each of Samples 302 to 304; D-37 was used in place of Comparative Coupler (F) used in the 5th layer and D-17 was used in place of Comparative Coupler (F) used in the 11th layer; D-42 was used in place of Comparative Coupler (G) used in the 13th layer and D-15 was used in place of Comparative Coupler (G) used in the 7th layer; Y-11 and YB-7 according to the present invention were used in place of Comparative Couplers (2) and (3) used in the 7th layer; and a 2:1 (by mol) mixture of Y-29 and Comparative Coupler (2) was used in place of Comparative Coupler (2) used in 13th layer.

The thus-prepared Samples 301 to 308 were exposed to white light, and processed with the color developing solution described in Example 2 and Samples separately image-wise exposed to light were running processed until the amount of the replenisher of the color developing solution reached three times the tank capacity of the color developing solution before the commencement of running processing. This was done to examine the fluctuation in photographic sensitivity between a point in time before the commencement of continuous processing and a point in time of obtaining a stationary processing state by running processing. The fluctuation was determined as a difference (ΔS) in sensitivity. Further, γ (gamma) ratio and sensitivity at a point in time at which processing reached the stationary state by running processing were determined in the same manner as in Example 1. The sensitivity of Sample 304 is referred to as standard. The results obtained from yellow dye images are shown in Table E below.

Furthermore, the dye image fastness and sharpness of the yellow dye images were examined. The results obtained are shown in Table E below.

TABLE E

| Sample No. | Fine Grains of Non-Sensitive Silver Halide: 7th layer | 8th layer | 10th layer | 12th layer | 13th layer | Coupler used | Photographic Characteristics: Sensitivity ($S_B$) | Gradation (relative γ) | Continuous Processing (ΔS) | Dye Image Fastness | Sharpness: MTF value [40 cycle/mm] |
|---|---|---|---|---|---|---|---|---|---|---|---|
| 301 (Comp. Ex.) | cubic | — | — | — | cubic | comparative coupler | 102 | 1.00 | 0.05 | 0.10 | 103 |
| 302 (Comp. Ex.) | tabular | tabular | tabular | tabular | cubic | comparative coupler | 107 | 0.98 | 0.05 | 0.10 | 105 |
| 303 (Comp. Ex.) | cubic | cubic | cubic | cubic | cubic | comparative coupler | 105 | 0.90 | 0.05 | 0.10 | 103 |
| 304 (Comp. Ex.) | — | — | — | — | — | comparative coupler | 100 (standard) | 1.00 (standard) | 0.04 | 0.10 | 100 (standard) |
| 305 (Invention) | cubic | — | — | — | cubic | coupler of invention | 112 | 1.20 | 0.00 | 0.06 | 113 |
| 306 (Invention) | tabular | tabular | tabular | tabular | cubic | coupler of invention | 120 | 1.20 | 0.00 | 0.06 | 118 |
| 307 (Invention) | cubic | cubic | cubic | cubic | cubic | coupler of invention | 117 | 1.20 | 0.00 | 0.06 | 115 |
| 308 (Invention) | — | — | — | — | — | coupler of invention | 108 | 1.20 | 0.02 | 0.06 | 108 |

It can be seen from the results shown in Table E that Samples 305 to 308 containing the compounds of general formula (I) or (II) and the couplers of general formulas (YI) and (2) according to the present invention have a high photographic sensitivity and a high color density, but scarcely cause a fluctuation in sensitivity even when processed at a low replenishment rate of the color developing solution. Moreover, they are excellent in dye image preservability and sharpness in comparison with Samples 301 to 304 containing comparative couplers.

Further, it can be seen from a comparison of Sample 304 with Samples 301 to 303 and a comparison of Sample 308 with Samples 305 to 307 that the photographic characteristics and sharpness can be improved when fine grains of non-sensitive silver halides are used in the non-sensitive layers which are adjacent to the high-sensitivity blue-sensitive, green-sensitive and red-sensitive emulsion layers and provided on the side nearer the support. It can also be seen that a remarkable effect of improving photographic characteristics and sharpness can be obtained by using the couplers of the present invention when Samples 301 to 304 are compared with the corresponding Samples 305 to 308.

EXAMPLE 4

Film units equipped with a lens were prepared from Samples 101 and 105 to 118 prepared in Example 1 according to the methods described in JP-B-2-32615 and JP-B-3-39784.

Various subjects were photographed under the same conditions by using these 15 types of the film units equipped with a lens. The films were subjected to color development processing by using an automatic processor FP-560B AL (a product of Fuji Photo Film Co., Ltd.). Subsequently, printing was made on Fuji Color Paper Super FA Type V by using Fuji Minilabochampion Printer Processor FA-140 (a product of Fuji Photo Film Co., Ltd.) (CP-45X was used in color development processing).

Patterns obtained by the printing of these 15 types of the samples were examined. It was found that color prints obtained from Samples 105 to 118 containing the couplers of the present invention are excellent in definition of the fine areas of the subjects, are bright in color, particularly yellow color, and have an improved image quality in comparison with the color print obtained from Sample 101.

Further, the dye image fastness of color negatives were examined under the same conditions as those of Example 1. It was found that Samples 105 to 118 containing the couplers of the present invention have improved fastness in comparison with Sample 101.

Samples 301 to 308 were examined in the same manner as described above, and it was found that Samples 305 to 308 containing the couplers of the present invention have an improved image quality and dye image fastness in comparison with Samples 301 to 304.

Particularly, it can be seen that Samples 305 to 307 are excellent in photographic performances and sharpness.

EXAMPLE 5

Samples 101 to 122 prepared in Example 1 were processed in the same manner as in Example 1, except that an equimolar amount of 2-methyl-4-[N-ethyl-N-(δ-hydroxybutyl)amino]aniline sulfate was used in place of 2-methyl-4-[N-ethyl-N-(β-hydroxyethyl)-amino]aniline sulfate used as the color developing agent in the color developing solution of Example 1, and that the developing time was shortened from 3 min 5 sec to 2 min 30 sec. The performances thereof were evaluated in the same manner as in Example 1.

It was found that Samples 105 to 118 of the present invention have high sensitivity and a high color density, are excellent in dye image preservability, have a high interlayer effect, provide dye images having a high color purity, are excellent in color reproducibility and sharpness, and provide a good image quality even when the color developing agent is changed and the color development time is shortened, in comparison with Comparative Samples 101 to 104 and 119 to 122.

It will be understood from the above disclosure that a silver halide color photographic material which has high sensitivity and a high color density, is excellent in dye image preservability, has a good interlayer effect and good hue, and is excellent in sharpness can be provided by using a compound of general formula (I) or (II) and an acylacetamide type coupler having an acyl group of general formula (YI) and/or a coupler of general formula (1) or (2) according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer, wherein the silver halide color photographic material contains (i) at least one compound represented by the following general formula (II) and (ii) at least one coupler represented by the following general formula (1) and (2):

$$A_2\text{-}(TIME)_a\text{-}DI \qquad (II)$$

wherein $A_2$ represents a group which does not have a non-diffusing group and releases $(TIME)_a$-DI by reaction with an oxidant of an aromatic primary amine developing agent; TIME represents a timing group which releases DI by cleavage between TIME and DI after release thereof from $A_2$; DI represents a development restrainer which is substantially deactivated after DI is dissolved out from the photographic material into a developing solution; and a represents 1 or 2 and when a is 2, the two TIME groups may be the same or different;

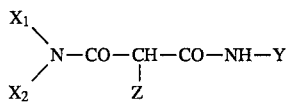

(1)

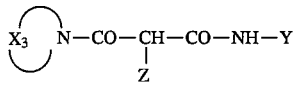

(2)

wherein $X_1$ and $X_2$ each represents an alkyl group, an aryl group or a heterocyclic group; $X_3$ represents an organic group necessary for forming a nitrogen containing heterocyclic group together with >N—; Y represents an aryl group or a heterocyclic group; and Z represents a group which is eliminated when the coupler is reacted with an oxidant of a developing agent; with the proviso that a moiety other than Z in a coupler represented by formula (1) or (2) contains a non-diffusing group.

2. The silver halide color photographic material as in claim 1, wherein fine silver halide grains which are substantially not sensitive to light are contained in the light-sensitive silver halide emulsion layer and/or a layer which is adjacent to the light-sensitive silver halide emulsion layer and provided on the side nearer the support.

3. The silver halide color photographic material as in claim 1, wherein the light-sensitive silver halide emulsion layer is a blue-sensitive silver halide emulsion layer.

4. The silver halide color photographic material as in claim 2, wherein the layer which is adjacent to the light-sensitive silver halide emulsion layer and provided on the side nearer the support is a non-sensitive layer.

5. The silver halide color photographic material as in claim 1, wherein the light-sensitive silver halide emulsion layer comprises two or more red-sensitive silver halide emulsion layers which are different in sensitivity from each other, two or more green-sensitive silver halide emulsion layers which are different in sensitivity from each other and two or more blue-sensitive silver halide emulsion layers which are different in sensitivity from each other, and these layers are arranged so as to meet the following conditions (a), (b), (c) and (d):

(a) the light-sensitive silver halide emulsion layer provided on the side which is farthest away from the support is the blue-sensitive silver halide emulsion layer (BH) having the highest sensitivity;

(b) the green-sensitive silver halide emulsion layer (GH) having the highest sensitivity and the red-sensitive silver halide emulsion layer (RH) having the highest sensitivity are provided between the BH and the blue-sensitive silver halide emulsion layer (Bh) having a lower sensitivity than that of the BH;

(c) the red-sensitive silver halide emulsion layer (RL) having the lowest sensitivity, the green-sensitive silver halide emulsion layer (GL) having the lowest sensitivity and the blue-sensitive silver halide emulsion layer (BL) having the lowest sensitivity are not provided on the side which is farther away from the support than the Bh; and (d) a non-sensitive layer is provided adjacent to the BH and on the side which is nearer the support, and fine silver halide grains which are substantially not sensitive to light are contained in the BH and/or the non-sensitive layer.

6. The silver halide color photographic material as in claim 1, wherein the layer which is adjacent to the light-sensitive silver halide emulsion layer and which is provided on the side nearer the support is a non-sensitized layer.

7. A silver halide color photographic material comprising a support having thereon at least one light-sensitive silver halide emulsion layer, wherein the silver halide color photographic material contains (i) at least one compound represented by the following general formula (II) and (ii) at least one acylacetamide coupler having an acyl group represented by the following general formula (YI) and at least one coupler represented by the following general formula (1) or (2):

$$A_2\text{-}(TIME)_a\text{-}DI \qquad (II)$$

wherein $A_2$ represents a group which does not have a non-diffusing group and releases $(TIME)_a$-DI by reaction with an oxidant of an aromatic primary amine developing agent; TIME represents a timing group which releases DI by cleavage between TIME and DI after release thereof from $A_2$; DI represents a development restrainer which is substantially deactivated after DI is dissolved out from the photographic material into a developing solution; and a represents 1 or 2 and when a is 2, the two TIME groups may be the same or different;

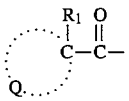

(YI)

wherein $R_1$ represents a substituent group; and Q represents a nonmetallic atomic group required for forming a three-membered to five-membered hydrocarbon group together with C or a three-membered to six-membered heterocyclic ring having at least one hetero-atom, as a member of the ring, selected from the group consisting of N, O, S and P, with the proviso that a non-diffusing group is present in the acylacetamide coupler in a moiety other than a releasing group;

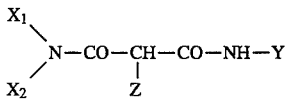

(1)

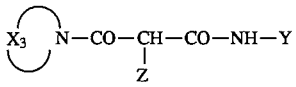

(2)

wherein $X_1$ and $X_2$ each represents an alkyl group, an aryl group or a heterocyclic group; $X_3$ represents an organic group necessary for forming a nitrogen containing heterocyclic group together with >N—; Y represents an aryl group or a heterocyclic group; and Z represents a group which is eliminated when the coupler is reacted with an oxidant of a developing agent; with the proviso that a moiety other than Z in a coupler represented by formula (1) or (2) contains a non-diffusing group.

8. The silver halide color photographic material as in claim 7, wherein fine silver halide grains which are substantially not sensitive to light are contained in the light-sensitive silver halide emulsion layer and/or a layer which is adjacent to the light-sensitive silver halide emulsion layer and provided on the side nearer the support.

9. The silver halide color photographic material as in claim 7, wherein the light-sensitive silver halide emulsion layer is a blue-sensitive silver halide emulsion layer.

10. The silver halide color photographic material as in claim 7, wherein the layer which is adjacent to the light-sensitive silver halide emulsion layer and provided on the side nearer the support is a non-sensitive layer.

11. The silver halide color photographic material as in claim 7, wherein the light-sensitive silver halide emulsion layer comprises two or more red-sensitive silver halide emulsion layers which are different in sensitivity from each other, two or more green-sensitive silver halide emulsion layers which are different in sensitivity from each other and two or more blue-sensitive silver halide emulsion layers which are different in sensitivity from each other, and these layers are arranged so as to meet the following conditions (a), (b), (c) and (d):

(a) the light-sensitive silver halide emulsion layer provided on the side which is farthest away from the support is the blue-sensitive silver halide emulsion layer (BH) having the highest sensitivity;

(b) the green-sensitive silver halide emulsion layer (GH) having the highest sensitivity and the red-sensitive silver halide emulsion layer (RH) having the highest sensitivity are provided between the BH and the blue-sensitive silver halide emulsion layer (Bh) having a lower sensitivity than that of the BH;

(c) the red-sensitive silver halide emulsion layer (RL) having the lowest sensitivity, the green-sensitive silver halide emulsion layer (GL) having the lowest sensitivity and the blue-sensitive silver halide emulsion layer (BL) having the lowest sensitivity are not provided on the side which is farther away from the support than the Bh; and (d) a non-sensitive layer is provided adjacent to the BH and on the side which is nearer the support, and fine silver halide grains which are substantially not sensitive to light are contained in the BH and/or the non-sensitive layer.

12. The silver halide color photographic material as in claim 7, wherein the layer which is adjacent to the light-sensitive silver halide emulsion layer and which is provided on the side nearer the support is a non-sensitized layer.

* * * * *